US011533785B2

(12) United States Patent
Pizzi et al.

(10) Patent No.: US 11,533,785 B2
(45) Date of Patent: Dec. 20, 2022

(54) ELECTRICAL HEATING DEVICE, IN PARTICULAR WITH PTC EFFECT

(71) Applicant: ELTEK S.P.A., Casale Monferrato (IT)

(72) Inventors: Marco Pizzi, Casale Monferrato (IT); Alberto Barbano, Casale Monferrato (IT); Luca Vercellotti, Casale Monferrato (IT); Mauro Zorzetto, Casale Monferrato (IT); Costanzo Gadini, Casale Monferrato (IT); Luca Costa, Casale Monferrato (IT)

(73) Assignee: ELTEK S.p.A., Casale Monferrato (IT)

( * ) Notice: Subject to any disclaimer, the term of this patent is extended or adjusted under 35 U.S.C. 154(b) by 481 days.

(21) Appl. No.: 16/611,023

(22) PCT Filed: Apr. 30, 2018

(86) PCT No.: PCT/IB2018/052970
§ 371 (c)(1),
(2) Date: Nov. 5, 2019

(87) PCT Pub. No.: WO2018/203206
PCT Pub. Date: Nov. 8, 2018

(65) Prior Publication Data

US 2020/0187307 A1 Jun. 11, 2020

(30) Foreign Application Priority Data

May 5, 2017 (IT) ..... 102017000048641

(51) Int. Cl.
*H05B 3/03* (2006.01)
*H05B 3/06* (2006.01)
(Continued)

(52) U.S. Cl.
CPC ..... *H05B 3/20* (2013.01); *H05B 3/03* (2013.01); *H05B 3/06* (2013.01); *H05B 3/146* (2013.01);
(Continued)

(58) Field of Classification Search
None
See application file for complete search history.

(56) References Cited

U.S. PATENT DOCUMENTS 2,557,983 A 6/1951 Linder
4,238,812 A * 12/1980 Middleman ..... A01K 63/065 219/505
(Continued)

FOREIGN PATENT DOCUMENTS

EP 1 168 888 1/2002
EP 2 946 977 11/2015
(Continued)

OTHER PUBLICATIONS

International Search Report for PCT/IB2018/052970 dated Jul. 26, 2018, 4 pages.
(Continued)

*Primary Examiner* — Joseph M. Pelham
(74) *Attorney, Agent, or Firm* — Nixon & Vanderhye P.C.

(57) ABSTRACT

An electrical heating device comprises: a first electrode layer (13), made of electrically conductive material; a second electrode layer (14), made of electrically conductive material; and a heating layer, made of a material having a PTC effect, wherein the first electrode layer (13) and the second electrode layer (14) face one another, with at least one part of the heating layer that is set between the first electrode layer (13) and the second electrode layer (14), in contact with them. At least one region (21) of the at least one from among the first electrode layer (13), the second elec-
(Continued)

trode layer (14), and said at least one part of the heating layer has a plurality of electrically non-conductive sites (30*a*, 30*b*, 30*c*), which are prearranged for bringing about: —an emission of heat by the heating device (10) in said at least one region (21) that is different from the emission of heat by the heating device (10) in at least one other region (22) of the at least one from among the first electrode layer (13), the second electrode layer (14), and said at least one part (15') of the heating layer (15); and/or —an emission of heat by the heating device (10) at the first electrode layer (13) that is different from the emission of heat by the heating device (10) at the second electrode layer (14).

19 Claims, 26 Drawing Sheets

(51) Int. Cl.

| | |
|---|---|
| ***H05B 3/20*** | (2006.01) |
| ***H05B 3/14*** | (2006.01) |
| *H05B 1/02* | (2006.01) |
| *H05B 3/34* | (2006.01) |

(52) U.S. Cl.
CPC ..... *H05B 1/0236* (2013.01); *H05B 3/34* (2013.01); *H05B 2203/02* (2013.01); *H05B 2203/037* (2013.01)

(56) References Cited

U.S. PATENT DOCUMENTS

| | | | | |
|---|---|---|---|---|
| 4,777,351 | A * | 10/1988 | Batliwalla | H05B 3/34 219/541 |
| 4,990,755 | A * | 2/1991 | Nishimura | H05B 3/146 219/549 |
| 6,423,951 | B1 * | 7/2002 | Elsasser | H05B 3/06 219/544 |
| 2017/0318625 | A1 * | 11/2017 | Boughiat | H05B 3/0014 |
| 2018/0272859 | A1 * | 9/2018 | Barbano | F24H 9/1872 |
| 2020/0015325 | A1 * | 1/2020 | Zhao | H05B 3/06 |
| 2020/0022224 | A1 * | 1/2020 | Ching | H05B 3/145 |
| 2020/0163161 | A1 * | 5/2020 | Pizzi | H05B 1/0236 |

FOREIGN PATENT DOCUMENTS

| | | |
|---|---|---|
| EP | 2 947 957 | 11/2015 |
| EP | 3 013 119 | 4/2016 |
| FR | 2 592 544 | 7/1987 |
| FR | 2 875 669 | 3/2006 |
| WO | 2017/068416 | 4/2017 |

OTHER PUBLICATIONS

Written Opinion of the ISA for PCT/IB2018/052970 dated Jul. 26, 2018, 7 pages.

* cited by examiner

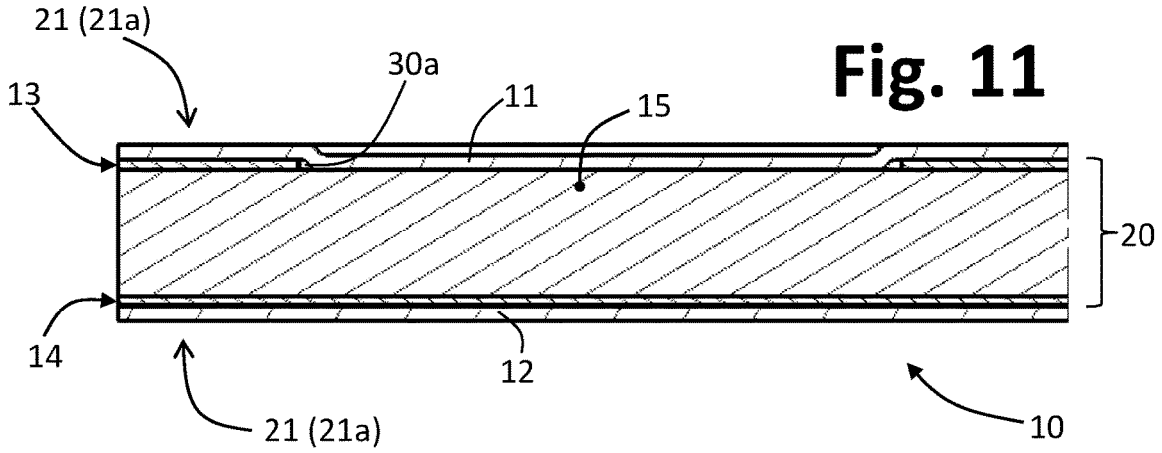
Fig. 11
Fig. 12
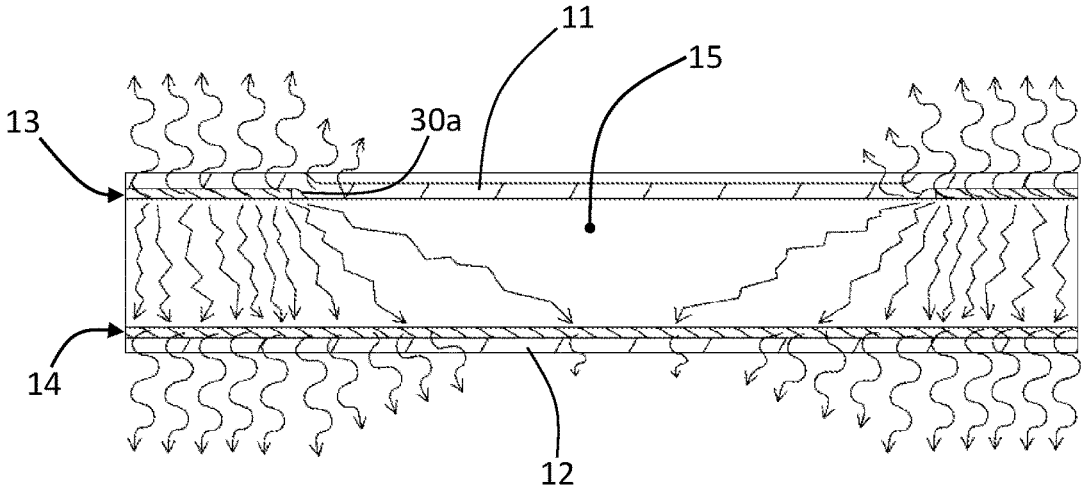
Fig. 13
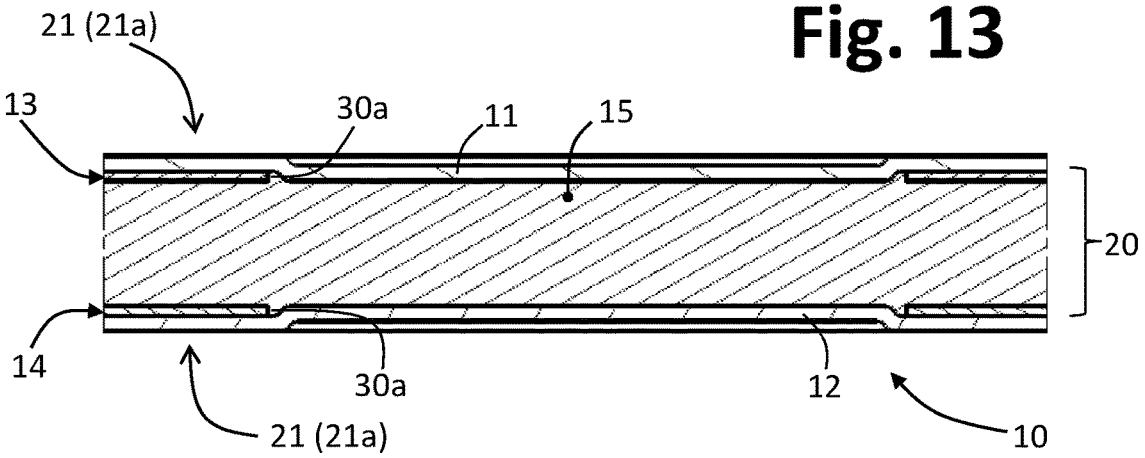

Fig. 14
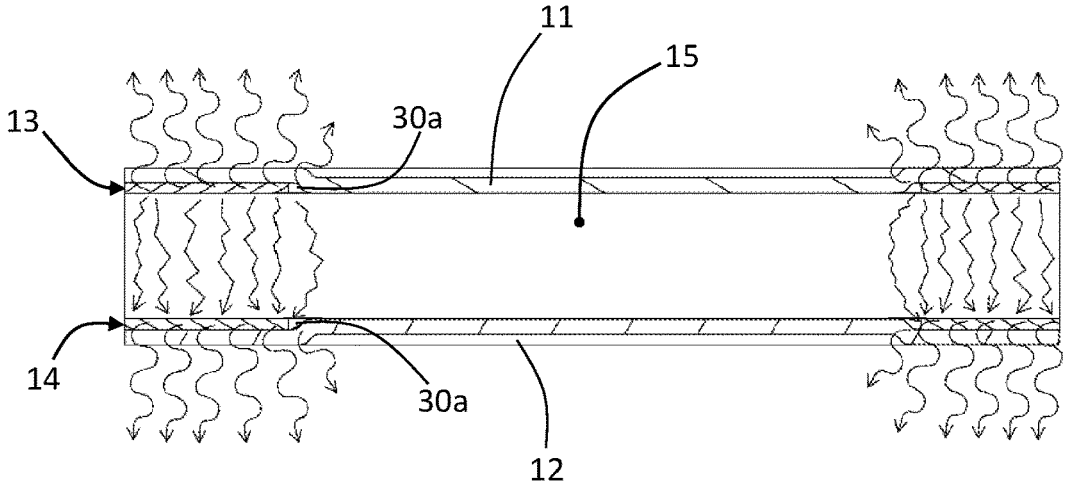
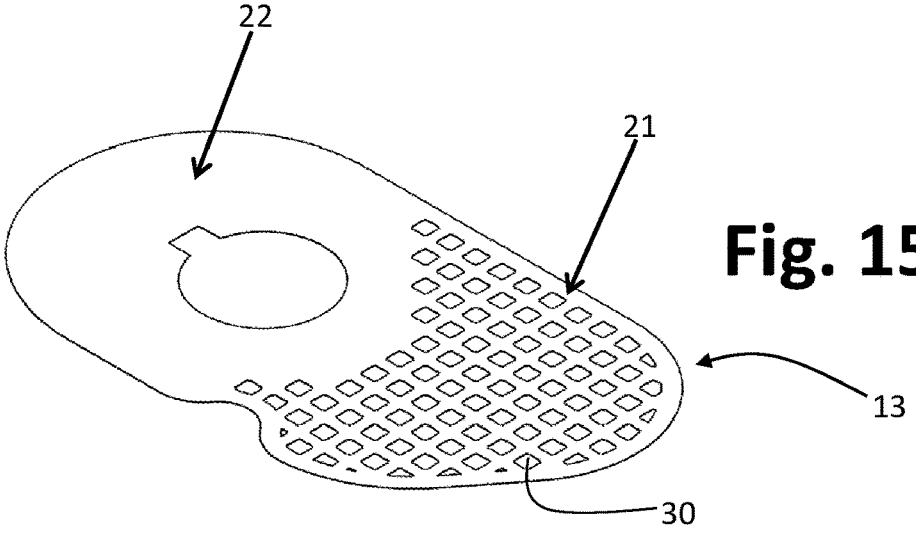
Fig. 15
Fig. 16
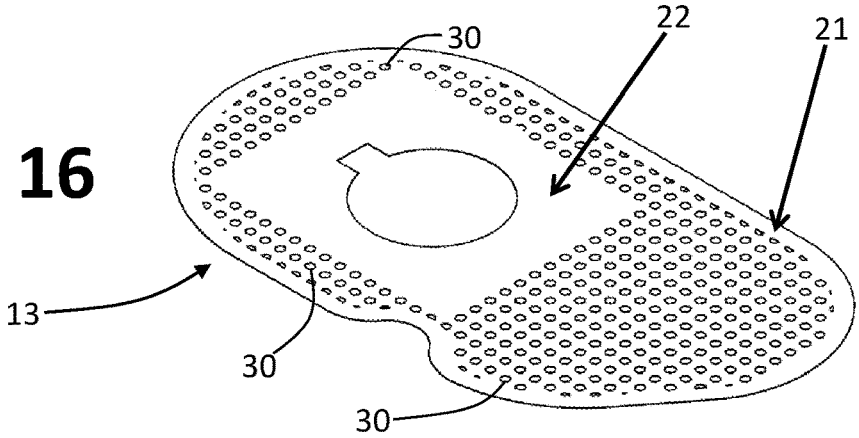

Fig. 17
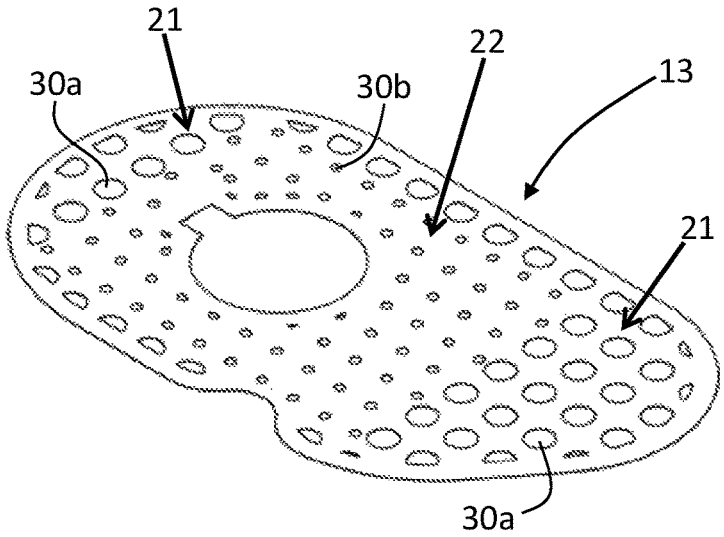
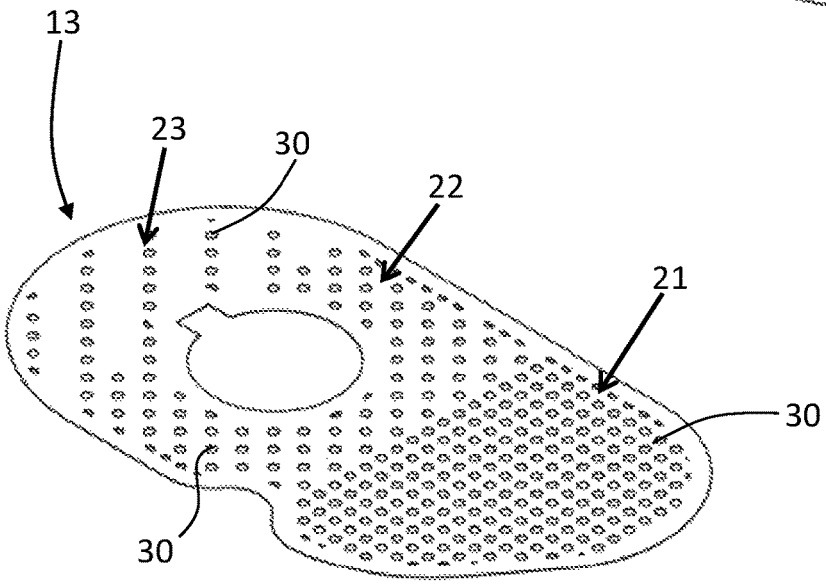
Fig. 18
Fig. 19
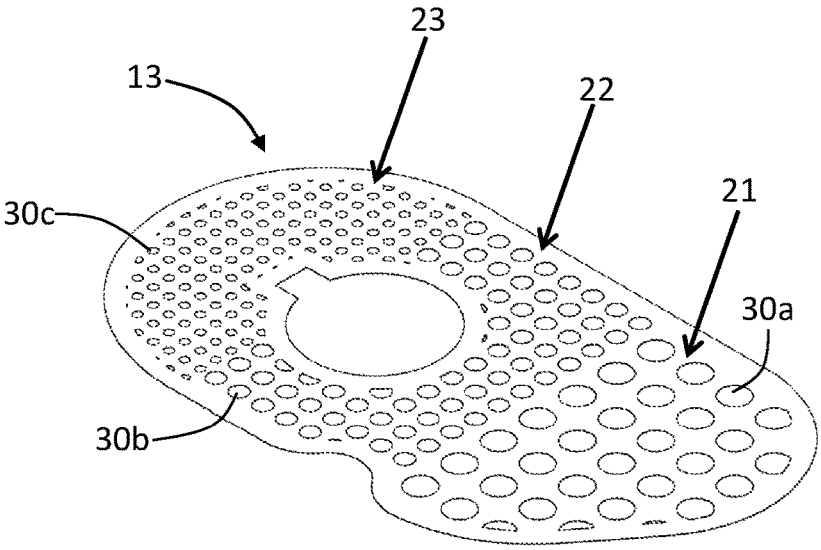

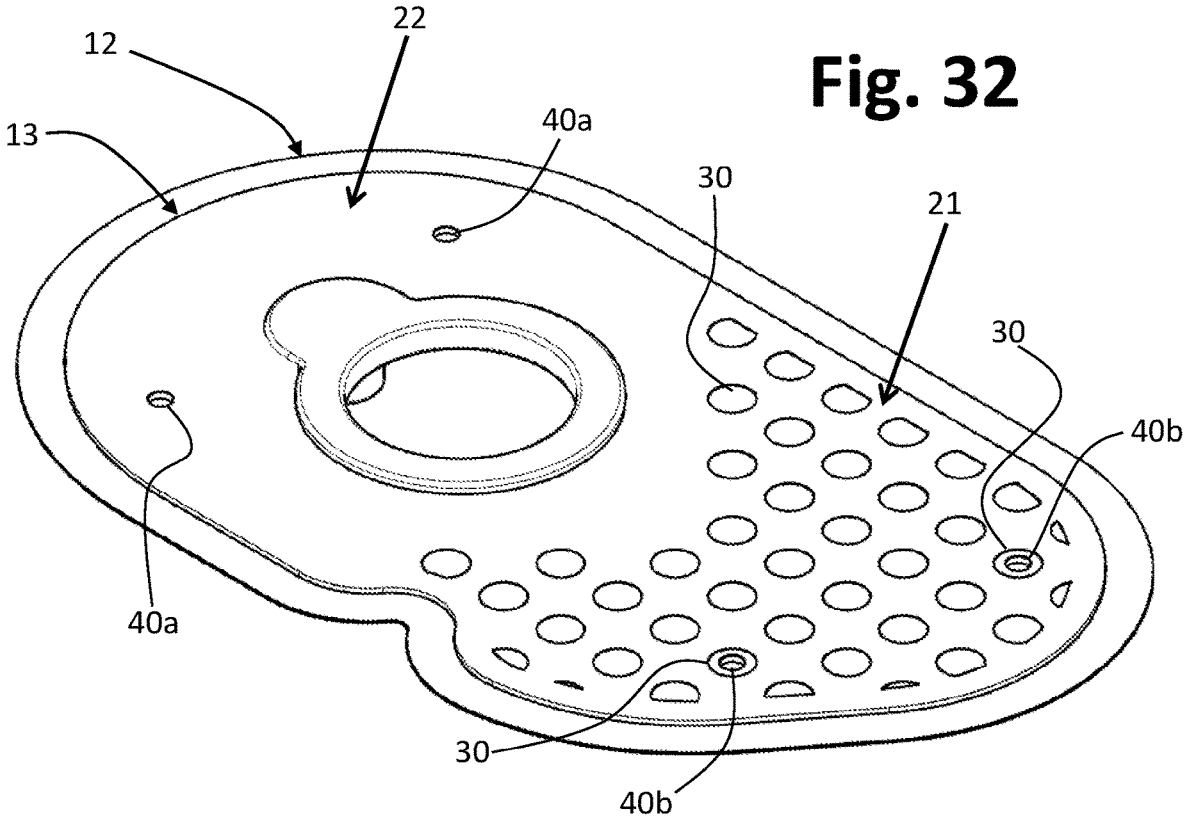
Fig. 32
Fig. 33
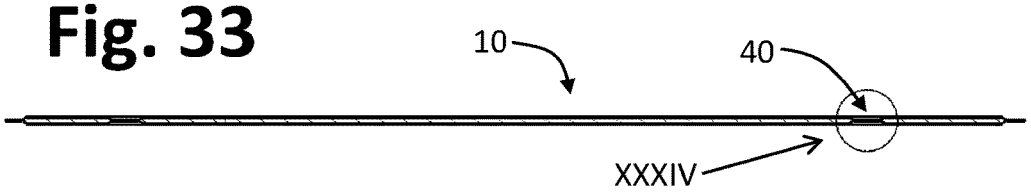
Fig. 34
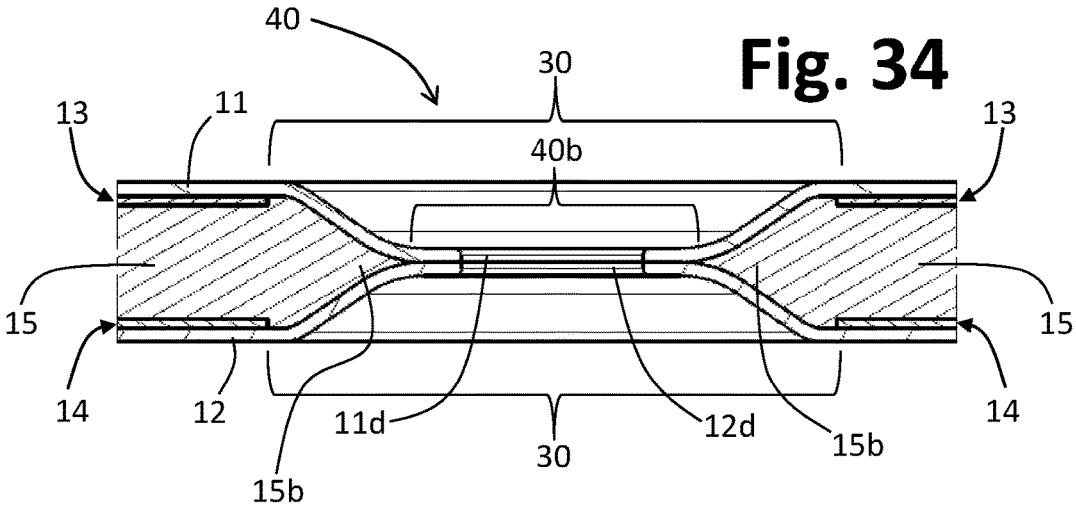

Fig. 44
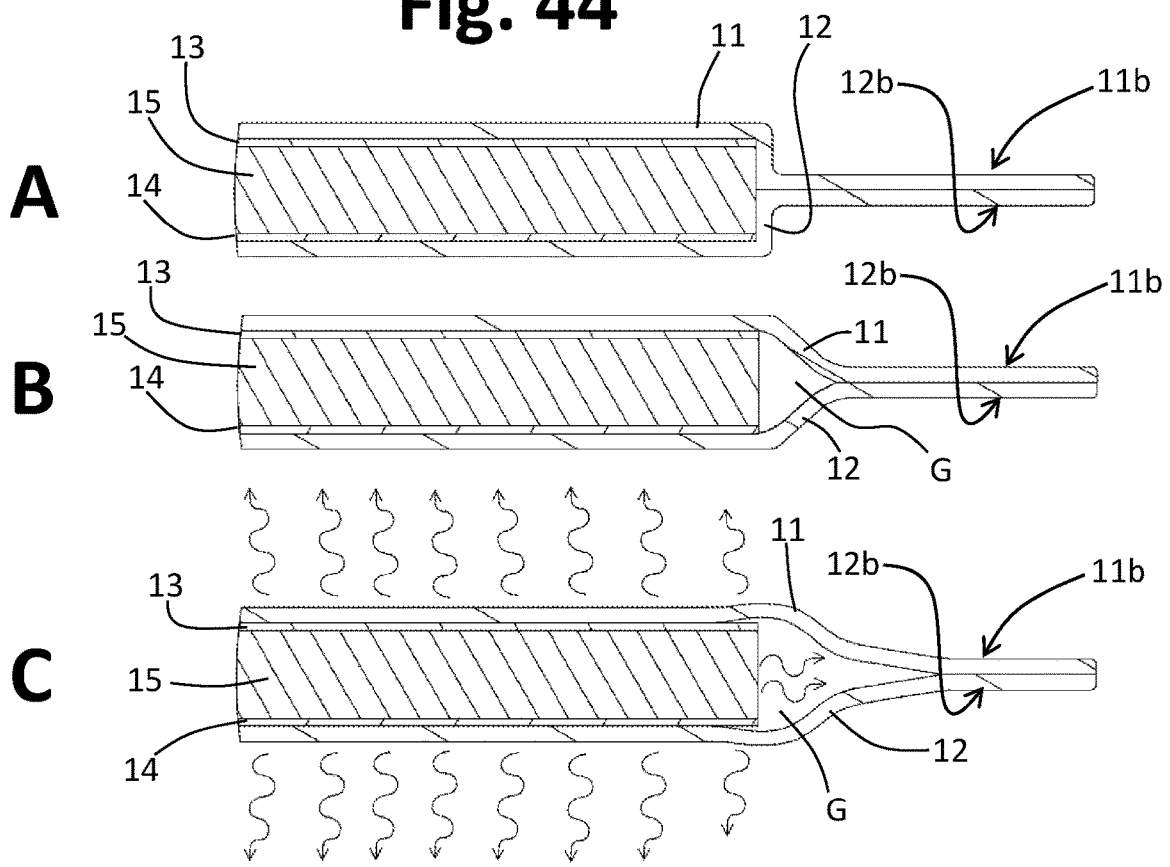
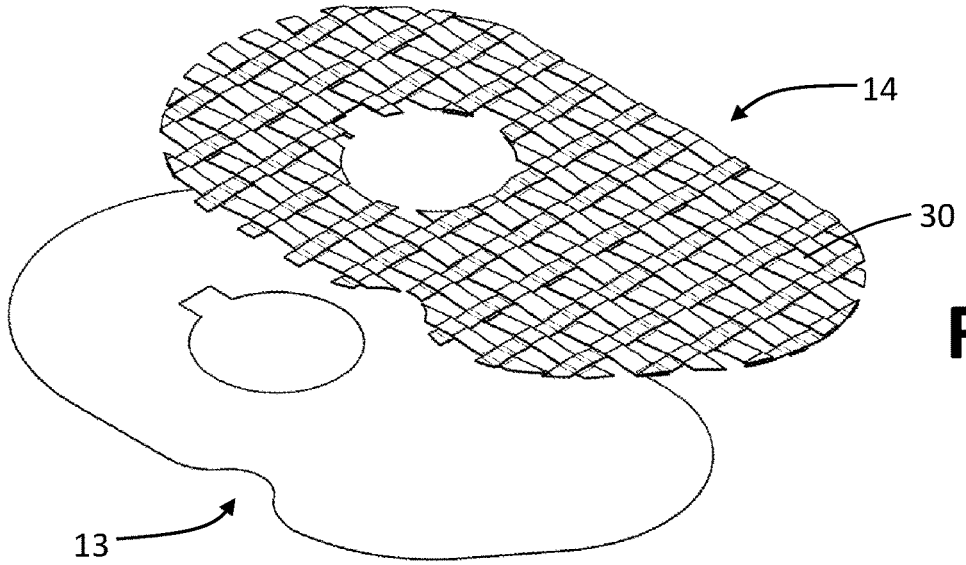
Fig. 45

Fig. 46
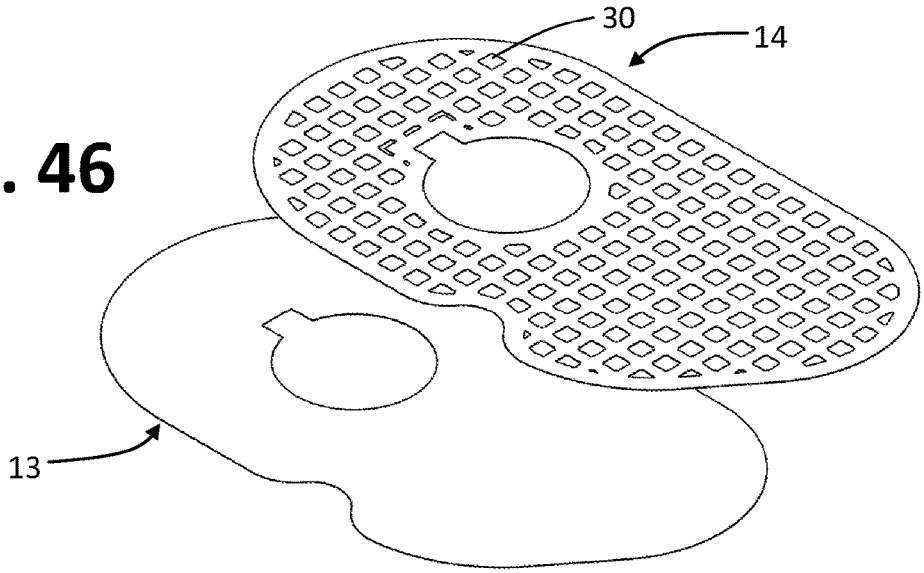
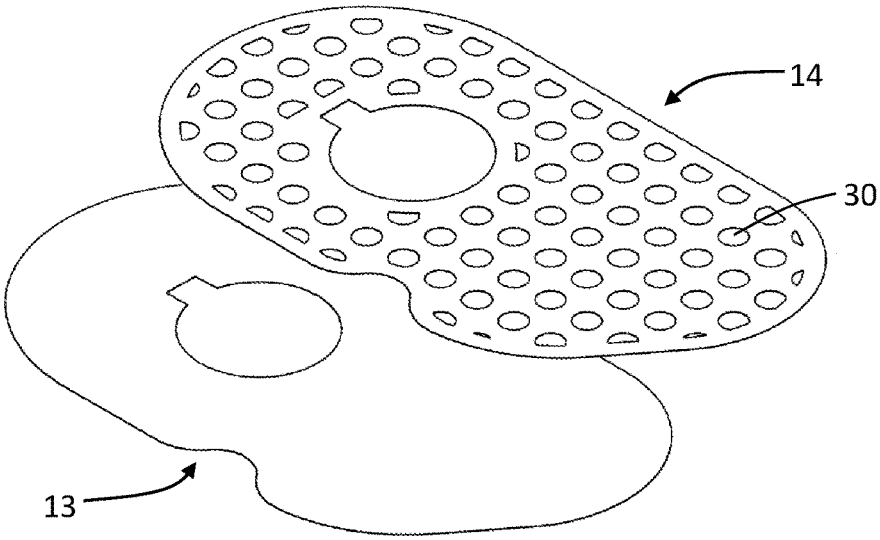
Fig. 47
Fig. 48
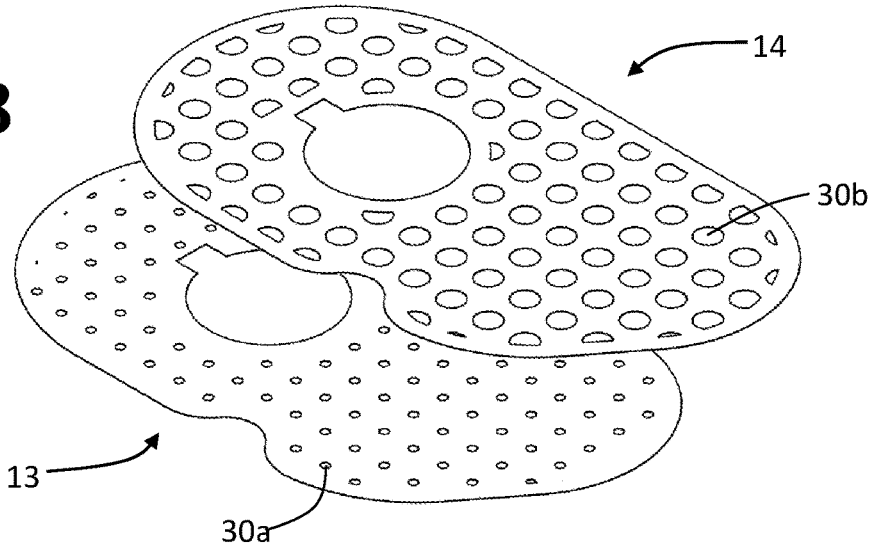

Fig. 60
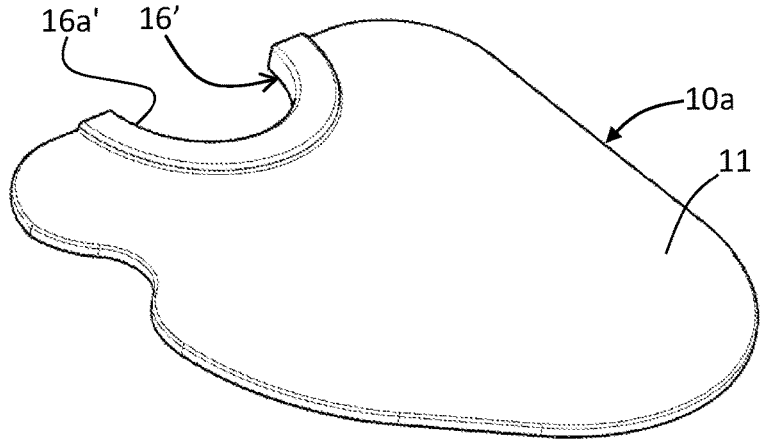
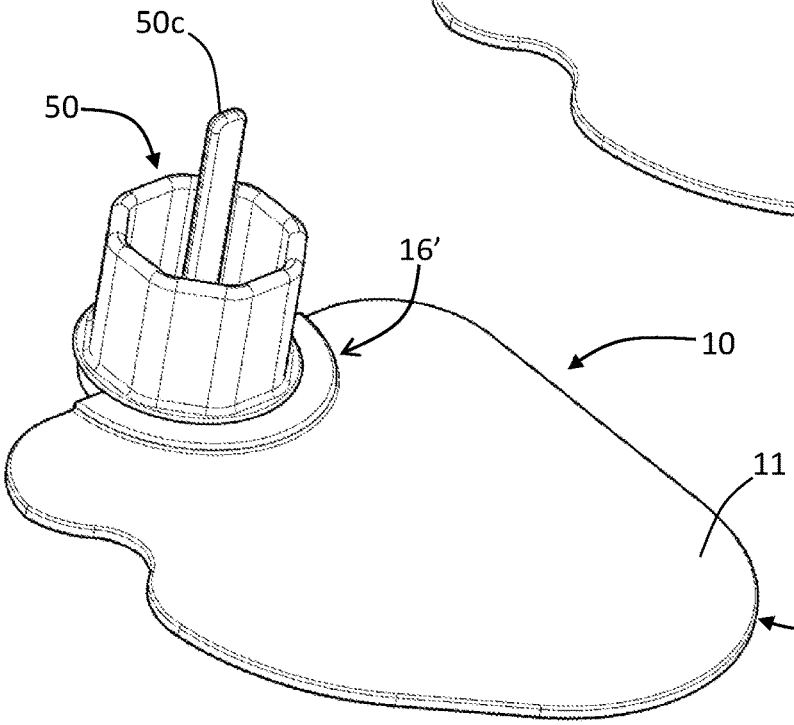
Fig. 61
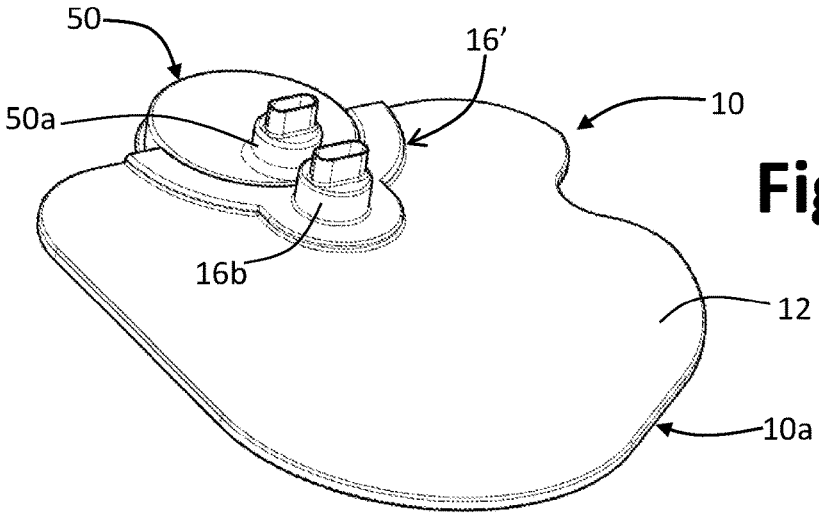
Fig. 62

ELECTRICAL HEATING DEVICE, IN PARTICULAR WITH PTC EFFECT

This application is the U.S. national phase of International Application No. PCT/IB2018/052970 filed Apr. 30, 2018 which designated the U.S. and claims priority to IT Patent Application 102017000048641 filed May 5, 2017, the entire contents of each of which are hereby incorporated by reference.

FIELD OF THE INVENTION

The present invention relates to electrical heating devices, in particular devices based upon the use of materials distinguished by an electrical resistance with positive temperature coefficient (PTC), namely, ones having a PTC effect, preferably materials comprising at least one polymer.

The invention has been developed with particular reference to electrical heating devices designed to be associated to, or integrated in, vehicle components, such as heaters for tanks, heaters for filters, heaters for batteries or electrical accumulators, heaters for substances subject to freezing, heaters for devices or substances that change their properties or characteristics as the temperature varies, or again heaters used for heating aeriform fluids, such as air for environments or air subject to forced circulation on the surface of such heaters.

The invention finds a preferred application in the sector of components or tanks designed to be in contact with, or contain, a fuel, or water, or a liquid that contains water, or a liquid additive, or a reducing agent, in particular a liquid necessary for operation of an internal-combustion engine and/or for operation of a system for treatment of exhaust gases of an internal-combustion engine, including ADI (Anti-Detonant Injection) systems. The heating devices according to the invention can in any case be applied also in sectors other than the preferential ones referred to above.

PRIOR ART

Exhaust-gas-emission systems of some types of vehicles must be devised with a view to reducing the release of nitrogen oxides ($NO_x$) into the atmosphere. A system particularly widespread for this purpose is based upon the process known as SCR (Selective Catalytic Reduction), which enables reduction of nitrogen oxides of the gases by means of injection of a reducing agent into the exhaust line. These treatment systems presuppose that the reducing agent is dosed and injected into the flow of the exhaust gases in order to convert nitrogen oxide ($NO_x$) into nitrogen ($N_2$) and water ($H_2O$). For this purpose, the vehicle is equipped with a tank containing the reducing agent, associated to which are suitable means for carrying out dosed injection of the agent itself into the SCR system.

The reducing agent is typically constituted by urea in aqueous solution, which is liable to freeze when the tank is exposed to low temperatures (indicatively temperatures lower than −11° C.). For this reason, the tank must be equipped with a heating device so that, in the case of freezing, the liquid agent can be liquefied and then injected into the exhaust line. The heating device is in general mounted inside the tank, or else integrated in, or associated to, a component of the tank that is sealingly mounted in an opening of the tank itself. The heating device is in general of the type that bases its own operation on the use of a material having a PTC effect, this material possibly being a ceramic-based or else a polymer-based material.

In general, known heating devices comprise a plurality of heating elements, each having an electrical resistor formed by a solid mass of the material with PTC effect, typically a mass of ceramic material shaped like a small disk. In some solutions, each heating element comprises a PTC resistor set between two respective metal electrodes, and the electrodes of the various heating elements are connected together, for example in parallel and/or in series with one another, for the purposes of electrical supply. In other solutions, a plurality of PTC resistors are arranged between two electrodes in common, typically in the form of metal plates or disks. In applications of this type, the heating device is generally without a casing of its own, and the body that houses it—for example, the body of a component of the tank or of a functional module associated to the tank—must be shaped for defining seats or housings for the various parts of the heating device (see, for example, EP 2 650 497 A1).

Heating devices of this type in general have a small extension in a radial direction, since they have to be positioned in the vicinity of the bottom wall of the tank, at or in the proximity of an opening for outlet or delivery of the reducing agent. This positioning is basically dictated by the need to render rapidly available a certain amount of the reducing agent, even in the case of freezing of the latter. Proper operation of the system for treatment of exhaust gases presupposes in fact dosing and injection of the reducing agent into the exhaust gases substantially immediately after engine ignition.

For this reason, the emission of heat allowed by the heating device occurs in a relatively concentrated area, i.e., in the vicinity of the outlet of the tank, with a consequent reduced contribution to melting of the frozen part of the reducing agent that, inside the tank, is located relatively far from the outlet of the tank itself. Certainly, the size of the heating device could be increased in a radial direction in order to heat an area substantially corresponding to the entire bottom wall of the tank. However, in addition to complicating further construction and mounting of the heating device, and of the component on which the device is mounted, such an approach would lead to a considerable increase in electric power consumption, such an increase being typically proportional to the area of the heater and/or to the heated area. Similar problems may also be encountered in heating devices used in other sectors.

Provision of heating devices equipped with a casing of their own in general entails problems linked to deformations (for example, expansion and contraction) of the PTC-effect material and/or of the corresponding metal electrodes due to the heating and cooling cycles. Such deformations lead to relative movements between the parts made of different materials, including the material or materials of the casing, with possible risks of failure. This problem is particularly felt in the case of laminar electrodes that cover the opposite surfaces of the mass of PTC-effect material practically entirely.

For this reason, it is advisable to provide a casing that covers the heating element (the PTC-effect material with the corresponding electrodes), but that is distinct from or independent of the latter (see, by way of simple, CN202455551U), at times with suitable empty spaces that will enable also relative movements to counter the aforementioned deformations. In the case of heaters with a sealed casing, however, the presence of air in these empty spaces reduces propagation of the heat generated given that the air operates as thermal insulator and is itself subject to variations in volume that depend upon the temperature, and this may cause anomalies in operation of the device.

AIM AND SUMMARY OF THE INVENTION

The object of the present invention is basically to eliminate one or more of the drawbacks referred to above. In this context, an object of the invention is to provide an electrical heating device that is as a whole simple and economically advantageous to produce, as well as being able to heat relatively extensive areas, but at the same time enabling a limited electric-power consumption. An auxiliary aim of the invention is to provide an electrical heating device having a corresponding casing body that is simple and inexpensive to produce and reliable.

One or more of the above aims, and other aims still, which will emerge clearly hereinafter, are achieved, according to the present invention, by an electrical heating device, a motor-vehicle component, and a method for obtaining an electrical heating device that present the characteristics specified in the annexed claims. The claims form an integral part of the technical teaching provided herein in relation to the invention.

BRIEF DESCRIPTION OF THE DRAWINGS

The characteristics, advantages, and further aims of the present invention will emerge clearly from the ensuing detailed description, with reference to the annexed drawings, which are provided purely by way of non-limiting example and in which:

FIG. 11 is a partial and schematic cross-sectional view of an electrical heating device according to possible embodiments of the invention;

FIG. 12 is a partial and schematic cross-sectional view aimed at representing the pattern of electrical and heat-emission paths and in the portion of the heating device of FIG. 11;

FIG. 13 is a partial and schematic cross-sectional view of an electrical heating device according to possible embodiments of the invention;

FIG. 14 is a partial and schematic cross-sectional view aimed at representing the pattern of electrical and heat-emission paths in the portion of the heating device of FIG. 13;

FIGS. 15, 16, 17, 18, 19, 20, and 21 are schematic perspective views of electrodes of electrical heating devices according to possible embodiments of the invention;

FIG. 32 is a schematic perspective view of the heating device of FIG. 30, with a part of casing removed;

FIG. 33 is a schematic cross-sectional view according to the line XXXIII-XXXIII of FIG. 31;

FIG. 34 illustrates at a larger scale the detail XXXIV of FIG. 33;

FIG. 44 is a partial and schematic representation aimed at highlighting possible problems of assembly and/or operation of an electrical heating device;

FIGS. 45, 46, 47, 48, and 49 are schematic perspective views of pairs of electrodes of electrical heating devices according to possible embodiments of the invention;

FIG. 60 is a schematic perspective view of an electrical heating device according to possible embodiments of the invention;

FIGS. 61 and 62 are schematic perspective views of the heating device of FIG. 60 combined with a different functional device;

DESCRIPTION OF PREFERRED EMBODIMENTS OF THE INVENTION

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" and the like that may be present in various points of this description do not necessarily refer to one and the same embodiment. Moreover, particular conformations, structures, or characteristics defined in this description may be combined in any adequate way in one or more embodiments, which may even be different from the ones represented. The reference numbers and spatial references (such as "upper", "lower" "top", "bottom", "up", "down", etc.) provided herein are used only for convenience and hence do not define the sphere of protection or the scope of the embodiments. In the present description and in the attached claims, the generic term "material" must be understood as comprising also mixtures, compositions, or combinations (for example, multilayer films) of a number of different materials.

Figure 1:
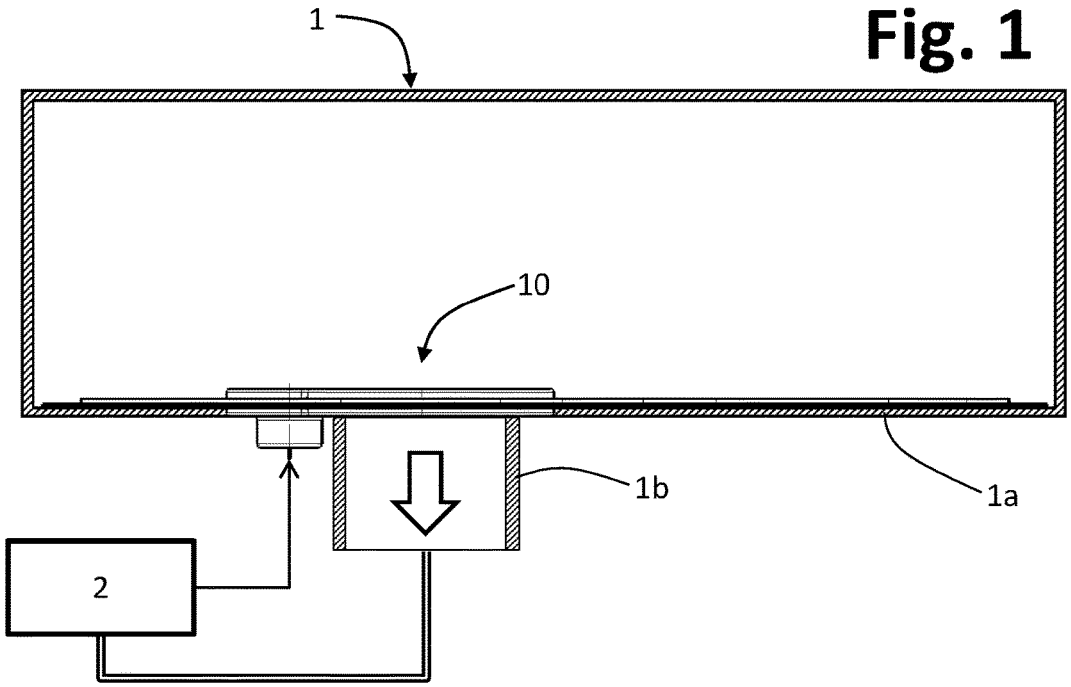
FIG. 1 is a schematic cross-sectional view of a generic container of a substance, equipped with an electrical heating device according to possible embodiments of the invention, represented in side elevation.

With initial reference to FIG. 1, designated as a whole by 1 is a generic container, for example a tank of a vehicle: as already mentioned, on the other hand, the component 1 may also be a duct or a container of some other type, for example the container of a filter or the casing of an electrical accumulator.

In what follows, it is assumed that the above container is a tank that is designed to contain a liquid, such as an additive or a reducing agent, and forms part of a system on board a vehicle, for example a system for reducing emissions of an internal-combustion engine or for treatment of the exhaust gases of an internal-combustion engine, represented as a whole by the block 2. In various embodiments, the system 2 is a treatment system of the SCR type, with injection of a reducing agent into the exhaust-gas line as explained in the introductory part of the present description, which is used for abatement of emissions of nitrogen oxides and particulate matter, in particular in motor vehicles with diesel engines. The aforesaid reducing agent may hence be urea in solution of distilled water, as for example the is commercially known by the name AdBlue™. In other embodiments, the treatment system 2 may be of the type that envisages injection of water directly into an internal-combustion engine, for reducing emissions and/or for preventing phenomena of spontaneous detonation, such as an ADI system. The container 1 (hereinafter referred to for simplicity also just as "tank") could in any case be used for other purposes and/or in sectors other than the automotive one, and could be designed to contain a different liquid that requires heating, such as a fuel or a washing agent, or some other liquid or substance.

The body of the tank 1 has a bottom wall 1*a*, where an outlet or opening 1*b* for the liquid is defined. In various embodiments, the opening 1*a* may be sized for insertion and/or mounting of at least one further functional device, such as a device comprising sensor means, for example a module of the type known as UDM (Urea-Delivery Module).

In various embodiments, set on the bottom wall 1*a* of the tank 1 is an electrical heating device according to the invention, designated as a whole by 10. In the example, the heating device is controlled, i.e., electrically supplied, by means of the system 2.

An electrical heating device 10 according to possible embodiments of the invention, for example suitable for the use described with reference to FIG. 1, is represented schematically in different views in FIGS. 2-3 and, in exploded view, in FIG. 4.

Figure 2:
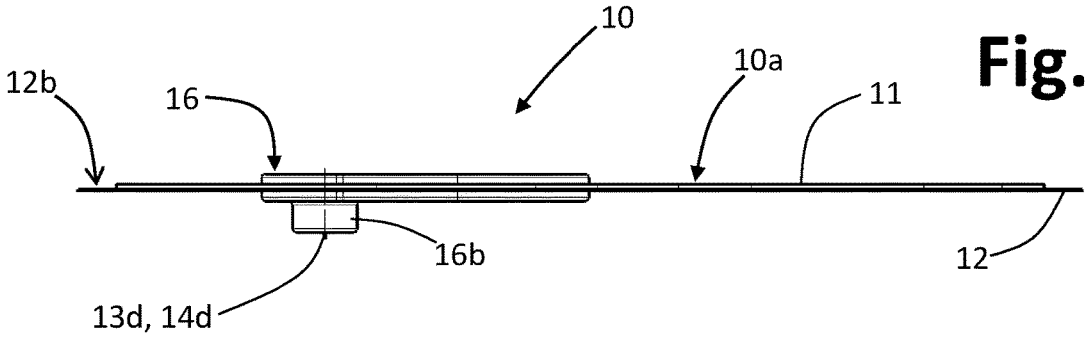
FIGS. 2 and 3 are schematic views, namely, a side elevation and a top plan view, respectively, of an electrical heating device according to possible embodiments of the invention.
Figure 3:
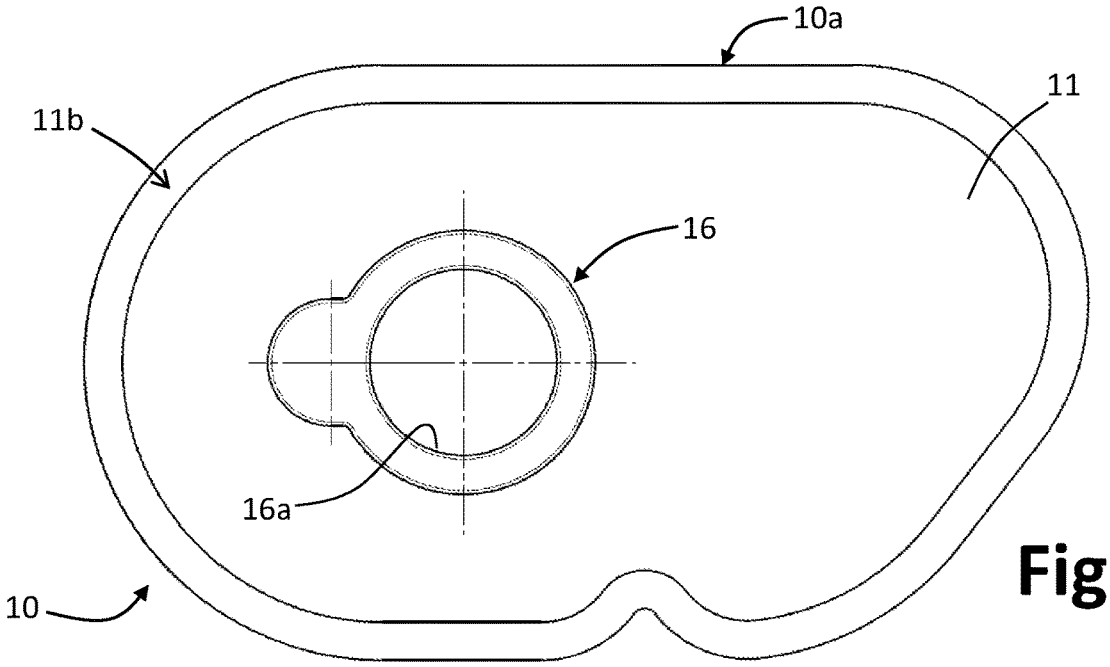
Figure 4:
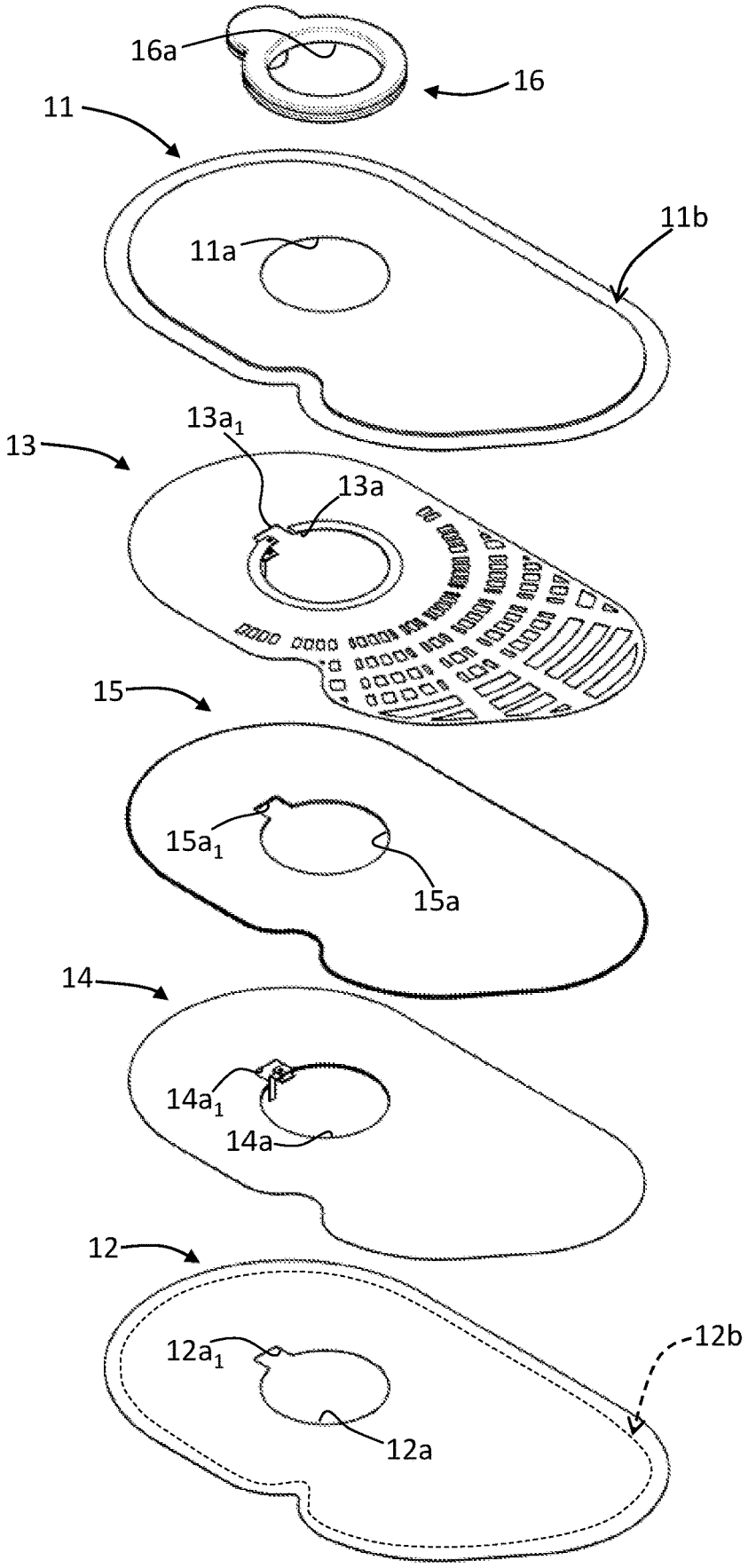
FIGS. 4 and 5 are partially exploded schematic views of an electrical heating device according to possible embodiments of the invention.

As will be appreciated for example in FIG. 4, in preferred embodiments, the heating device 10 comprises a plurality of functionally different layers, which are relatively thin and are set on top of one another at respective major faces so as to form a substantially planar or laminar structure, as emerges clearly from FIG. 2. In various embodiments, the peripheral profile of the device 10 is shaped to follow at least in part the profile of the tank. Preferentially, the aforesaid planar structure is at least in part flexible, thanks to the small thickness and an albeit minimal elasticity or intrinsic compliance (yielding) of the layers that make it up, at the same time presenting a corresponding structural stiffness that enables the device 10 to maintain the shape assigned thereto, as will emerge hereinafter.

This type of layered structure makes it possible to provide in a simple way a device 10 even having a relatively extensive surface, at the same time with an as a whole very reduced encumbrance in height. In this way, the device 10 can be easily set up against a supporting surface, for example on the bottom wall 1*a* of the tank 1 of FIG. 1. In the case of FIG. 1, the device 10 has overall perimetral dimensions and extension such as to cover substantially the entire bottom wall 1*a* of the tank 1, or a prevalent part thereof: for this purpose, for example, in possible embodiments the heating device is previously fixed within a part of the tank 1 prior to complete formation or closing of the latter (for example, via welding of two parts of the tank).

It should be noted that, in the present description and in the attached claims, the term "layer" used to identify certain components of the heating device 10 according to its preferred embodiments, is not to be understood in a limiting sense. In this perspective, in various embodiments, the components 11-15 described and identified hereinafter as "layers" may have a structure and/or shape and/or thickness other than what has been exemplified, albeit respecting the functions envisaged according to the invention (for example, the components 11 and 12 could be replaced by rigid or overmoulded walls, or by deposited layers of electrically insulating material or material having a high value of electrical resistance; the components 13 and 14 could be replaced by thick plates of electrically conductive material; the component 15 could be replaced by a solid mass of any shape of a material that is at least in part resistive or semiconductor or of the PTC-effect type, or in any case such as to provide a thermistor).

In various embodiments, the device 10 comprises a coating or casing 10*a* made of electrically insulating material. With reference also to FIG. 4, such a casing comprises two opposite walls 11 and 12, a first electrode layer 13 made of electrically conductive material, a second electrode layer 14 made of electrically conductive material, and a heating layer 15, made of a polymeric material, preferably a material having a PTC effect. The casing 10*a* may be omitted, for example when the device according to the invention does not require a specific protection in regard to the medium that is to be heated (for example, when the device is used for heating air or other fluid that is not aggressive from the chemical standpoint).

The two electrode layers 13 and 14 are arranged facing, preferably substantially parallel to one another and with respect to the heating layer 15, with at least one part of the heating layer 15 that is set between the two electrode layers 13 and 14 in contact with these, at respective opposite major faces. This layered structure provides a heating element, designated as a whole by 20 in FIG. 5, which in various embodiments is sealingly enclosed in the casing 10*a* of FIGS. 2-3, the opposite walls of which are here constituted by two casing layers 11 and 12.

In various embodiments, the casing layers 11 and 12, i.e., the two opposite walls of the casing 10*a*, are set on top of the two electrode layers 13 and 14, respectively. Preferably, the casing layers 11 and 12 have a larger width than the electrode layers 13 and 14, in order to provide peripheral areas of respective contact and/or superposition of the casing layers 11 and 12. In various embodiments, the casing layers 11 and 12 are sealingly joined together in respective peripheral superposition areas, designated by 11*b* and 12*b*, for example via gluing or welding, such as thermal welding or laser welding.

In various embodiments, the layers 11, 12, 13, 14, and 15 each have a through opening, the openings being designated, respectively, by 11*a*, 12*a*, 13*a*, 14*a*, and 15*a* in FIG. 4, and preferably having substantially the same diameter, and the layers 11-15 being set on top of one another in such a way that the through openings 11*a*-15*a* are substantially coaxial with one another or at least in part face one another.

In various embodiments, on the openings 11*a*-13*a* a body for providing fluid-tightness or sealing, designated as a whole by 16, is applied, preferably via overmoulding (or possibly via elastic mounting), the body 16 being configured for insulating the device 10 with respect to the outside also at the openings 11*a*-13*a*. As will emerge from what follows, the body 16 can also perform the function of protection of some electrical-connection elements of the device 10, and for this purpose the body 16 is preferentially made of electrically insulating material.

In various embodiments, also the body 16 defines a through opening, designated by 16*a*. The presence of the opening 16*a* of the body 16 and of the openings 11*a*-15*a* of the layers 11-15 is particularly advantageous, for example in applications of the type represented in FIG. 1, where the device 10 is set up against a wall 1*a* provided with a passageway for the fluid, here represented by the outlet 1*b* of the tank 1. It may be noted that the device 10 could also be associated on the outside of the wall 1*a* of FIG. 1, or else be associated to a wall other than the bottom one, not necessarily provided with an opening. As will be seen, according to possible embodiments, the through opening 16*a* of the body 16, or a seat defined by said body, can also be used for coupling of the heating device 10 to another functional device, for example a UDM device (typically defining a duct for the liquid, and/or a pump, and/or sensors, and/or a further heater), or another similar device for fuel tanks.

The presence of a passage or of an axial opening that traverses the device 10 in the direction of its thickness (i.e., with reference to the example illustrated, the ensemble of the through openings 11*a*-16*a*) does not constitute an essential characteristic of the invention. In the same way, also the presence of the body 16 must be understood as optional. A sealing, and/or electrically insulating body applied or overmoulded on the casing 10*a* can in any case be provided in embodiments in which the electrical-connection terminals of the device 10 are positioned in a different way from the embodiments exemplified herein.

In various embodiments, at least part of the casing 10*a*, preferably the entire casing 10*a*, can be provided via moulding or overmoulding of a polymer on the layers 13, 14, and 15. Such a casing can advantageously be shaped for providing one or more further elements, such as at least one of the following: a body of an electrical connector, elements for fixing the device 10 to the tank 1, a passageway for the fluid, at least part of the outlet of the tank 1, a seat for coupling with some other device (such as a UDM), etc.

As will be seen, in the non-limiting examples provided herein, the electrical-connection terminals 13*d*, 14*d* of the device 10 project in a substantially axial direction (or vertical direction, as viewed in the figures), but in possible variant embodiments—for example one in which the device is without the aforesaid axial passage—the connection terminals may be located in some other position, for example in the proximity of the outer profile or of the peripheral areas 11*b* and 12*b*, or else could project from the casing 10*a* in a substantially radial direction (or horizontal direction, as viewed in the figures), preferably coated at least in part by a sealing, and/or electrically insulating body, i.e., by a body of an electrical connector.

The casing layers 11 and 12 or, more in general, the casing 10*a*, are preferentially made of a material chemically resistant to the environment where the device 10 is installed or to the medium that is to be heated, for example the reducing agent contained in the tank 1 of FIG. 1. The material in question, preferably a polymeric material, is moreover of the type capable of withstanding the operating temperatures of the heating device 10, roughly comprised between −40° C. and +90° C. Similar considerations apply to the material used for the body 16 possibly present, which is preferably a thermoplastic material.

Figure 5:
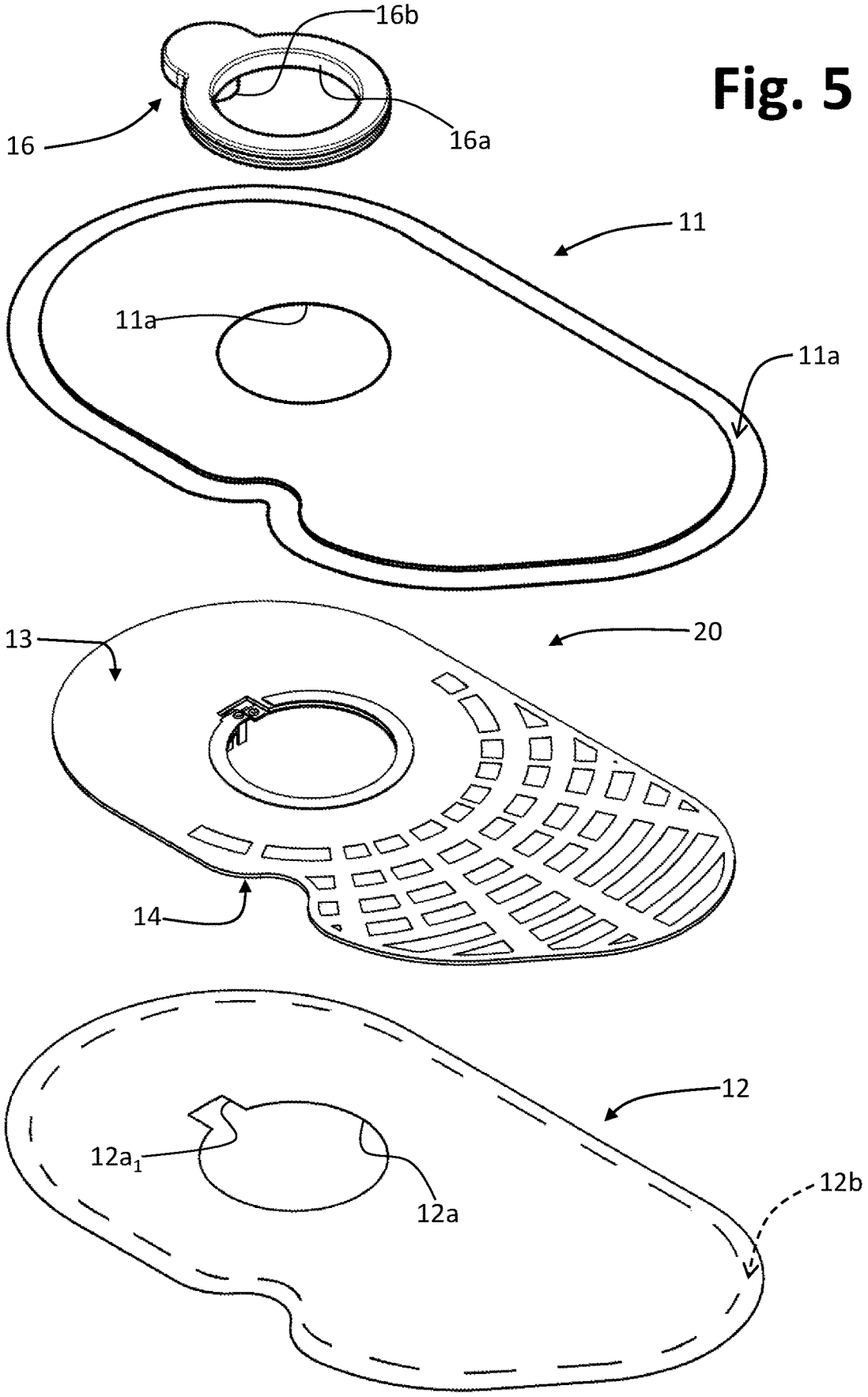

In preferential embodiments, as has been said, the casing 10*a* is formed by the two layers 11 and 12, set on top of one another and sealingly joined at least in the respective perimetral regions 11*b* and 12*b*, with the heating element 20 set in between, as exemplified in FIG. 5; the layers 11 and 12 may possibly be sealingly joined together also in intermediate areas or openings.

In various embodiments, the casing layers 11 and 12 are constituted by respective films of polymeric material. Preferred materials are, for example, polypropylene (PP), polyethylene (PE), high-density polyethylene (HDPE), thermoplastic polyurethane (TPU), ethylene vinyl alcohol (EVOH), polyoxymethylene (POM), and thermoplastic elastomer (TPE).

According to possible embodiments, the layers 11 and 12 in turn have a multilayer structure; i.e., they are themselves constituted by a plurality of layers of different materials, which possibly have different technical characteristics (for example, in terms of thermal conductivity, electrical insulation, barrier properties in regard to the external environment, flexibility, etc.): for example, the layers 11 and/or 12 may comprise two or more layers, each made of one and the same material, preferably chosen from the ones referred to above (PP, PE, HDPE, TPU, EVOH, POM, TPE), or else may comprise combinations of two or more layers of different materials, preferably chosen from the ones referred to above (PP, PE, HDPE, TPU, EVOH, POM, TPE); in the case of a multilayer structure, the layers 11 and/or 12 may also include at least one metal layer to provide a barrier to the penetration of liquid, and/or vapour, and/or gas.

In general, the layers 11 and 12 may each have a thickness of between 0.1 mm and 2 mm, in particular when they are in the form of films.

In possible variant embodiments, instead of being obtained using films 11, 12 of polymeric material, the casing 10*a* may be obtained using protective layers consisting of resins, coatings, or other substances deposited or overmoulded at least in part on the electrode layers 13, 14 and/or on the heating layer 15: in these cases, the thickness of the layers 11, 12 (or of the walls that perform their function) may, for example, be up to 3 or 4 mm.

It will be appreciated that, in various preferential embodiments, the casing 10*a* is very simple and inexpensive to produce in so far as the casing layers 11 and 12 may, for example, be obtained via simple operations of blanking or dinking, starting from webs or films of the material of interest. The layers 11, 12 thus obtained can be laid on the two opposite major faces of the heated element 20, for example via lamination. As has been said, when necessary, the layers 11 and 12 can be sealingly joined along their peripheral superposition areas 11*b* and 12*b*, for example via welding or gluing (they may, however, be joined via moulding, also in a single piece). The body 16 may possibly be overmoulded on the semifinished product thus obtained.

In various embodiments, the layers 11 and 12 are arranged so as to adhere in part to the electrode layers 13, 14 and in part to the heating layer 15, in particular, at edges or parts of the latter that project from the electrode layers, or else directly at the opposite major faces of the heating layer 15 when, as will be seen, the electrode layers 13-14 are englobed in the material of the layer 15 itself. Consequently, in various embodiments, a polymeric material of the casing 10*a* of the device 10 is directly in contact with at least part of the material of the heating layer 15, in particular when the heating layer itself comprises a polymeric material, preferably a polymer of the casing 10*a* and a polymer of the heating layer 15, that are compatible with one another or are such as to form bonds with one another, such as chemical and/or structural bonds between the polymeric chains: thanks to this characteristic, the adhesion or fixing of the casing on the heating element, including the electrode layers and heating layer, is improved.

The electrode layers 13 and 14 are preferentially, but not necessarily, made of one and the same electrically conductive material, such as a metal material (for example, selected from among stainless steel, brass, bronze, aluminium, or alloys thereof) or an electrically conductive polymeric material. In various embodiments, at least one of the electrode layers 13 and 14 is formed by a material in sheet or laminar form, or a meshed material, or again a fabric material (including electrically conductive non-woven fabrics). One or both of the electrode layers 13 and 14 may possibly be obtained also by depositing an electrically conductive material directly on the heating layer 15 or on the casing layers 11 and 12, on a respective face, for example using silk-screen techniques or else overmoulding or co-moulding techniques. Of course, it is also possible to use or combine different materials and types of electrode (for example, one electrode layer may be obtained starting from a metal lamina, and the other electrode layer may be obtained starting from an electrically conductive fabric). Also the electrode layers 13 and 14 may possibly have a multilayer structure.

In general, the electrode layers 13 and 14 can each have a thickness of from a few microns (for example, in the case of a deposition process) up to 3 mm (for example, in the case of a blanking or photo-etching process). It will be appreciated that, by virtue of their preferably small thickness, the electrode layers 13, 14 may also be relatively flexible or deformable. Also the electrode layers 13 and 14 may, for example, be obtained via simple blanking or dinking operations, starting from sheets, or webs, or laminas, or films, or pieces of the material of interest or else, as has been said, using known deposition techniques.

In preferred embodiments, the heating layer 15 is made of a material having a PTC effect. In various embodiments, the material constituting the layer 15 is a polymer-based material (i.e., comprising at least one polymer), for example a composite material having a matrix formed by a polymer or by a mixture of a number of polymers and by a corresponding filler, for example an electrically conductive filler and/or a thermally conductive filler.

In various embodiments, the material of the layer 15 is a co-continuous polymeric composite with PTC effect, having a matrix that comprises at least two immiscible polymers and at least one electrically conductive filler in the matrix. In preferred embodiments of this type, at least one of the immiscible polymers is high-density polyethylene (HDPE) and at least another one of the immiscible polymers is polyoxymethylene (POM). The electrically conductive filler is preferentially constituted by particles having micrometric or nanometric dimensions, preferably comprised between 10 nm and 20 μm, very preferably between 50 nm and 200 nm, possibly aggregated to form chains or branched aggregates of dimensions comprised between 1 μm and 20 μm. Preferential materials for the electrically conductive filler are carbonaceous materials, such as carbon black, or graphene, or carbon nanotubes, or mixtures thereof.

The HDPE and the POM are preferentially in relative percentages of between 45% and 55% of the sum of their weights. Preferentially, the electrically conductive filler is confined or mostly confined in the HDPE, in a weight percentage of between 10 wt % and 45 wt %, preferably between 16 wt % and 30 wt %, taking to be 100 the sum of the weights of the HDPE and of the electrically conductive filler. For this purpose, the HDPE and the electrically conductive filler can be mixed together, in particular via extrusion, prior to subsequent mixing with the POM, which also in this case can be obtained preferentially via extrusion.

The high melting point of the POM enables, during extrusion of the composite, the two HDPE-POM phases to be kept better separated, reducing the possibility of migration of the carbonaceous filler into the POM (contributing to this effect is the fact that the filler is preferentially previously mixed with just the HDPE). The higher melting point of the POM as compared to other known polymers likewise enables a more stable final structure to be obtained: the PTC effect of the composite material limits self-heating to a maximum temperature of approximately 120° C. POM moreover has a high crystallinity, roughly comprised between 70% and 80%: this means that, in the proposed preferential co-continuous composite, any migration of filler from the HDPE to the POM is more unlikely to occur, thereby preventing loss of performance of the PTC-effect material, for example due to heating and passage of electric current. The higher crystallinity of POM also renders the composite particularly resistant from the chemical standpoint and bestows high stability thereon. On the other hand, the crystallinity of HDPE is typically comprised between 60% and 90%: in this way, a high concentration of the conductive filler is obtained in the amorphous domains, with corresponding high electrical conductivity.

In various preferential embodiments, the composite that forms the heating layer 15 includes a thermally conductive filler, preferably comprising a material having a value of thermal conductivity higher than 200 W/(m·K) at 25° C. A preferred material in this sense is, for example, boron nitride (NB). Preferentially, with reference to the example HDPE+POM referred to previously, the thermally conductive filler is confined or mostly confined in the POM, in particular in a weight percentage comprised between 5 wt % and 70 wt %, preferably between 15 wt % and 30 wt %, taking to be 100 the sum of the weights of the POM and of the electrically conductive filler. For this purpose, the POM and the thermally conductive filler can be mixed together, in particular via extrusion, prior to mixing with the HDPE, which is possibly pre-mixed with a corresponding electrically conductive filler.

For further details as regards to the preferred polymeric co-composite indicated for providing the heating layer 15, i.e., having a matrix that comprises HDPE and POM, the reader is referred to the Italian patent application No. IT102017000038877, the teachings of which are incorporated herein for reference.

In general, the heating layer 15 can have a thickness of between 0.5 mm and 5 mm. Also in this case, considering its small thickness and its basically polymeric nature, the heating layer 15 may, if need be, present a certain bending capacity.

Also the heating layer 15 may possibly be obtained via simple operations of blanking or dinking, starting from a sheet or web of the starting PTC-effect polymer. However, as already mentioned, according to possible variant embodiments of the invention, the layer 15 can be overmoulded on or co-moulded with the layers 13-15.

In various embodiments, provision of the heating layer 15 by means of a polymer-based material (i.e., a material comprising at least one polymer) is advantageous in order to improve adhesion or fixing between the heating element 20, which integrates the layer 15, and the corresponding casing 10*a*, when the latter is present. In this perspective, in various embodiments, the material of the layer 15 and the material of the casing are mutually compatible or such as to form bonds, such as chemical or structural or mechanical bonds, or comprise one or more materials or components in common. For instance, with reference to a material of the heating layer 15 that includes HDPE and/or POM, the material of the casing 10*a*, i.e., of the casing layer 11 and/or layer 12, may itself comprise PE or HDPE and/or POM: in this way, on the parts of casing that are set on top of the heating layer a better adhesion or bonding will be obtained between the corresponding materials, for example between the chains of the polymer that is in common. More in general, the materials of the layer 11 and/or 12 and the material of the layer 15 comprise polymers designed to melt at least in part and bond to one another, for example in the course of a hot lamination or of an overmoulding, and/or designed to bind to one another, for example chemically and/or mechanically (as in the case exemplified previously of the layers 11, 12, and 15 that include PE or HDPE and/or POM).

In preferential embodiments, the electrode layers 13 and 14 have substantially similar overall perimetral dimensions, i.e., the shape and perimetral dimensions of the electrode layer 13 are substantially similar to the shape and perimetral dimensions of the electrode layer 14. More in general, preferentially, the electrode layers 13 and 14 define respective superposition areas that are substantially similar, whereby it is meant that the facing areas of the two electrode layers, with at least part of the heating layer set in between, are substantially similar. It should be noted, for this purpose, that the terms "superposition areas" or "facing areas" are meant to designate a "theoretical" area, i.e., without considering the electrically non-conductive (or substantially electrically insulating) sites described hereinafter.

At least one part of the heating layer 15, preferably a part having a substantially constant thickness, is set between the two electrode layers 13 and 14. Preferentially, also the layer 15 has overall perimetral dimensions substantially similar to those of the electrode layers 13 and 14, but not excluded is the case of a part of the layer 15 that projects beyond the edges of the layers 13, 14 or else that does not reach as far as the aforesaid edges. Moreover, as will be seen, in possible embodiments, the electrode layers 13, 14 are at least in part embedded in the heating layer 15, or else the latter is shaped so as to define recesses for housing the aforesaid layers 13, 14. Hence, in these embodiments, only a part of the layer 15 is effectively set between the layers 13 and 14: in these cases, preferably, part of the material of the casing 10*a* is directly in contact with part of the material of the heating layer 15.

The casing layers 11 and 12, in the embodiments that envisage them, preferentially have a peripheral profile substantially similar to that of the layers 13-15 (or at least to the profile of the one from among the layers 13-15 that has largest dimensions), but of larger dimensions in order to enable definition of the corresponding superposition areas 11*b* and 12*b* for peripheral sealing of the casing 10*a*.

Figure 6:
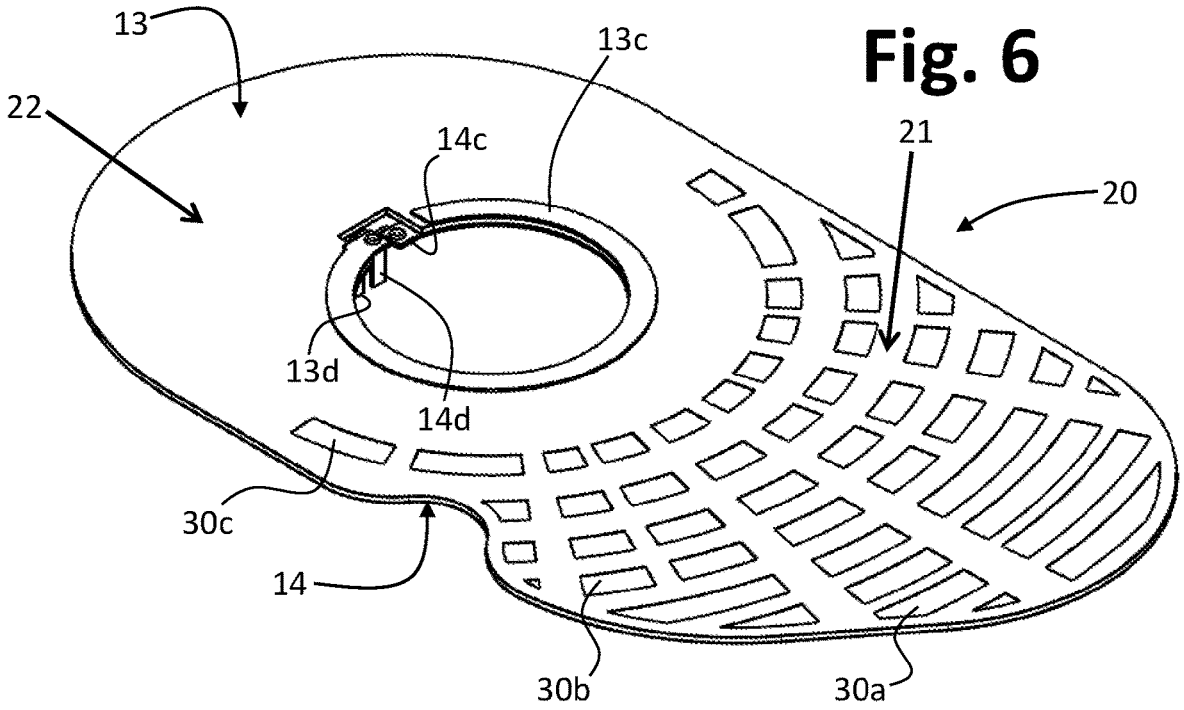
FIGS. 6 and 7 are schematic perspective views from different angles of an electrical heating device according to possible embodiments of the invention.
Figure 7:
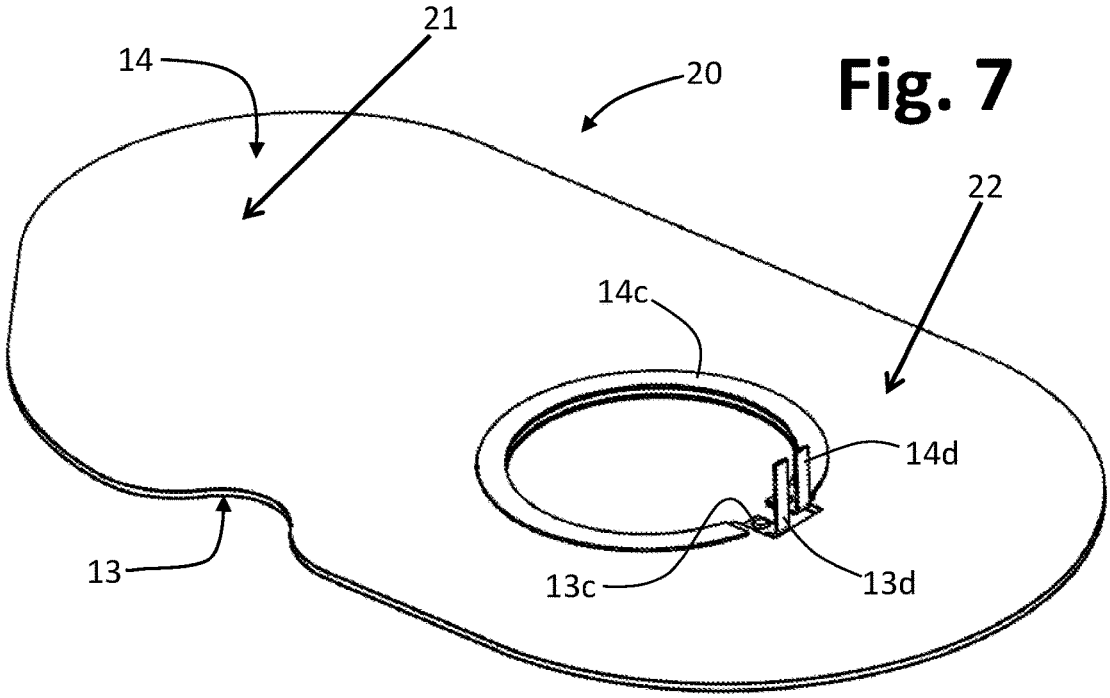

In FIGS. 6 and 7, the heating element 20 is represented in isolation, viewed from two opposite sides, in an embodiment in which the layers 13-15 are provided with the respective through openings (13*a*-15*a*, FIG. 4). In embodiments of this type, it may prove advantageous to envisage that the electrical-connection terminals of the device 10 are located in the proximity of the corresponding through opening and/or extend in an axial direction. For this purpose, in various embodiments, associated to each electrode layer 13 and 14 is a corresponding connection element 13*c* and 14*c* made of electrically conductive material, which may, for example, be obtained by shaping part of the corresponding electrode, or else be welded or glued via an electrically conductive adhesive on the face of the corresponding electrode layer opposite to the heating layer 15.

The connection elements 13*c* and 14*c* may, for example, be arranged in such a way that a part thereof projects at a corresponding passage close to the through openings 13*a* and 14*a*, for instance, a passage constituted by a radial extension of the through openings 13*a* and 14*a*. These passages or radial extensions of the openings 13*a* and 14*a* are designated by $\mathbf{13}a_1$ and $\mathbf{14}a_1$ in FIG. 4. Similar passages or extensions $\mathbf{12}a_1$ and $\mathbf{15}a_1$ are defined also around the profile of the openings 12*a* and 15*a* of the layers 12 and 15. The radial extensions or passages $\mathbf{12}a_1$-$\mathbf{15}a_1$ are in positions that coincide on the corresponding layers 12-15, i.e., so that they are superimposed. In various embodiments, these passages or extensions $\mathbf{12}a_1$, $\mathbf{14}a_1$, and $\mathbf{15}a_1$ are sealed, for example, via the sealing body 16.

The connection elements 13*c* and 14*c* preferably have a small thickness and are, for example, in the form of a shaped metal lamina, shaped, for instance, as an open ring, with an internal diameter substantially corresponding or close to the diameter of the through opening 13*a* and 14*a* of the corresponding electrode layer 13 and 14. In various embodiments, the elements 13*c* and 14*c* are substantially designed to provide an electrical-distribution element, which is particularly useful in the case of connection to electrode layers made of fabric or meshwork. In various embodiments, the connection elements 13*c* and 14*c*, preferably in the form of a shaped metal lamina, are welded to the respective electrode layers 13 and 14, for example when the latter are in the form of a wire mesh in such a way as to guarantee mutual electrical connection and mechanical fixing.

As may be noted, in particular in FIGS. 6-7, a portion of the elements 13*c* and 14*c* projects in an area corresponding to the respective extension $\mathbf{13}a_1$ and $\mathbf{14}a_1$ and, on this portion, the elements 13*c* and 14*c* are electrically connected to a respective terminal 13*d* and 14*d* that extends in an axial direction, either directly or with a part of the respective electrode layer set in between.

Figure 8:
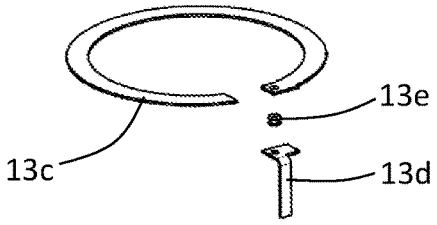
FIG. 8 is a schematic perspective view of electrical-connection elements that can be used in an electrical heating device according to possible embodiments of the invention.
Figure 9:
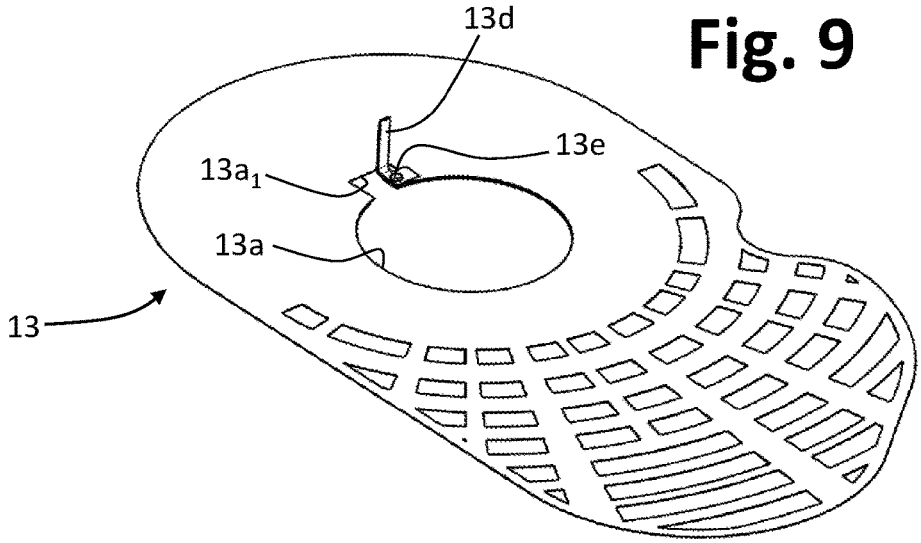
FIG. 9 is a schematic perspective view of an electrode of an electrical heating device according to possible embodiments of the invention, with associated thereto the electrical-connection elements of FIG. 8.

In the example of FIG. 8, the terminal 13*d* presents a right-angled bend, to define a base that is fixed to the aforesaid projecting portion of the corresponding connection element 13*c*, for example by means of a rivet 13*e* or the like. The aforesaid arrangement may be similar for the element 14*c* and the corresponding terminal 14*d*, which here will have, however, a length slightly smaller than that of the terminal 13*d* (the difference in length is substantially equal to the thickness of the layers 13-15 and of the element 14*c*). As may be appreciated in FIGS. 6-7, the two terminals 13*d* and 14*d* are mounted so as to extend substantially alongside one another, without coming into contact with one another, with the terminal 13*d* that traverses the radial extensions of the layers 13-15, preferably to form an electrical connector, in particular a male connector, or connection terminals for electrical wiring.

The heating element 20 thus obtained is then equipped with the casing 10*a* if the presence of the casing is necessary or preferable in view of the application for which the heating device is designed (for example, it is useful for protecting the device from chemically aggressive liquids or agents, whereas, if the device is used for heating a forced flow of air or some types of fuel, the casing may be omitted). Hence, with reference to the examples illustrated so far, the casing layers 11 and 12 are set on top of the two opposite major faces of the heating element 20, for example via lamination, with the terminals 13*d* and 14*d* that pass also through the radial extension $\mathbf{12}a_1$ of the opening 12*a* of the layer 12. The layers 11 and 12 are then joined (sealingly, if this is necessary in view of the application of the device 10) in the respective peripheral superposition areas 11*b* and 12*c*. Next, the body 16 is applied to the semifinished product, in particular via overmoulding and/or resin bonding. The body 16, in addition to sealing the layered structure at the through openings 11*a*-15*a*, as already mentioned above, is preferentially also shaped for defining a portion 16*b* (FIGS. 2 and 5) that partially encloses and electrically insulates the terminals 13*d* and 14*d* from one another. These terminals project axially from the aforesaid portion 16*b*, for their connection to a corresponding wiring or supply and control circuit, for example belonging to the system 2 of FIG. 1.

The heating device according to the invention is configured so as to present areas with diversified emission of heat. In general, the definition "emission of heat" may here be understood as an emission of heat referred to a unit surface or to a surface of predefined area, or else as a power or heating density or else as an emittance, for example, expressed in $W/cm^2$ or $W/dm^2$ or other unit of measurement suitable for the purpose. In this perspective, the phrase "areas with diversified emission of heat" may be understood as referring to areas subject to a different distribution or intensity of heat emission, or to a different power or heating density, or to a different emittance, referred to a unit surface or a predefined surface. The emission of heat may regard each of the electrode layers 13, 14 and/or the heating layer 15 given that the electrode layers can behave as dissipator of the heat emitted by the heating layer, in particular in the case of metal electrodes or electrodes that are in any case thermally conductive.

The solution of providing areas of diversified heat emission is based upon the consideration that, in various applications, it may prove convenient to provide a heating device that enables a different distribution of heat emission to be obtained, such as an higher, or more concentrated, heat emission in at least one first area to be heated, and at the same time a lower, or less concentrated, heat emission also in at least one further area to be heated.

An example of such an application is the preferential one previously mentioned with reference to FIG. 1, i.e., a tank 1 in which it is necessary to guarantee a fast heating of a certain area, for example an area close to an outlet 1*b* of the tank itself, and at the same time ensure also a certain degree of heating in at least one other area, for example an area peripheral with respect to the outlet 1*b*. In this way, for example in the case of a tank 1 that contains a frozen liquid, the heating performed in the vicinity of the outlet 1*b* ensures rapid melting of the liquid in this area, and hence a fast or better supply to the corresponding system on board the vehicle, such as the treatment system 2. On the other hand, the milder heating in the areas of the bottom 1*a* of the tank 1 further away from the outlet 1*b* in any case enables a faster melting of the contents of the tank 1 as a whole.

Of course, a known heating device could be sized for heating uniformly an area substantially corresponding to that of the entire bottom 1*a* of the tank 1, but this, in addition to complicating construction of the device, would imply an excessive use of electric power in proportion to the actual needs. Considering that the flow rate of the reducing agent or other liquid at outlet from the tank 1 may be limited, is in fact sufficient to heat and melt the liquid rapidly just in the area close to the outlet 1*b*, it being possible to heat and melt the liquid more slowly in the other areas of the tank.

According to a different approach, the tank 1 could be equipped with a number of heating devices, of which a first heater with higher thermal emission in a first area in the vicinity of the outlet 1*b* and at least one second heater in a second area peripheral with respect to the first area, with the second heater distinguished by a lower heat emission, and then by a lower consumption: also in this case, however, construction of the heating system would be as a whole complicated and costly, as likewise its control.

Hence, in accordance with the invention, the differentiated emission of heat by the device 10 is obtained via a particular structuring of at least one from among the electrode layer 13, the electrode layer 14, and the heating layer 15.

According to a first aspect, at least one of the first and second electrode layers 13 and 14 has at least one region in contact with a corresponding region of the heating layer 15, and the region of the layer 13 and/or of the layer 14 and/or of the layer 15 is provided with a plurality of electrically non-conductive sites. The electrically non-conductive sites are prearranged for bringing about an emission of heat by the heating device 10 in the aforesaid region that is different from the emission of heat by the heating device 10 in at least another region of the first electrode layer 13 and/or of the second electrode layer 14 and/or of the heating layer 15, or else that is different from the emission of heat by the heating device 10 at the other one of the first and second electrode layers 13 and 14.

In this way, within each electrode layer 13 and 14 and the heating layer 15 homologous regions may be provided distinguished by a different emission of heat, or else the emission of heat at one electrode layer may be different from the emission of heat at the other electrode layer.

For instance, in the first case mentioned, with a preferably substantially parallel and stacked arrangement of the layers 13-15, in each of the electrode layers 13 and 14 a plurality of regions may be identified in contact with the heating layer, in homologous positions of the two electrode layers, with these regions that are prearranged for diversified emission of heat. With reference, for example, to FIGS. 6-7 or to FIG. 10, two such regions for the electrode layer 13 comprise at least one first region and one second region, designated by 21 and 22, respectively. At least the first region 21 of the electrode layer 13 has a plurality of first electrically non-conductive sites, prearranged for defining in the aforesaid first region 21 of the electrode layer 13 an overall area of contact thereof with the heating layer 15 that is smaller than the overall area of the first region 21 itself. On the other hand, in the non-limiting example illustrated, the second region 22 of the electrode layer 13 is substantially completely electrically conductive (i.e., devoid of the aforesaid electrically non-conductive sites), and is prearranged for having an overall area of contact with the heating layer 15 that is substantially the same as or close to the overall area of the second region 22 itself. It should be noted that, by "overall area" is meant a "theoretical" area, i.e., without considering the aforesaid electrically non-conductive sites, whereas by "overall area of contact" is meant the area of the electrode layer effectively in contact with the heating layer (i.e., basically, the difference between the aforesaid theoretical area and the sum of the areas of the individually electrically non-conductive sites). In the non-limiting examples of FIGS. 6-7, or of FIG. 10, the aforesaid electrically non-conductive sites are constituted by through holes or cavities of the electrode layer 13, some of which are designated by 30*a*, 30*b* and 30*c*.

In this way, as will emerge more clearly hereinafter, the emission of heat (or heating power density or emittance, measured in $W/cm^2$ or $W/dm^2$) by the heating device 10 in the first region 21 is lower than the emission of heat in the second region 22. Moreover, the emission of heat in the first region 21 of the electrode layer 13 and in the corresponding first region 21 of the second electrode layer 14 is lower than the emission of heat in the second region 22 of the electrode layer 13 itself and in the corresponding second region 22 of the electrode layer 14.

In other embodiments, described hereinafter, the electrode layers and the electrically non-conductive sites may be prearranged in such a way that the emission of heat by one electrode layer is different from the emission of heat by the other electrode layer.

Figure 10:
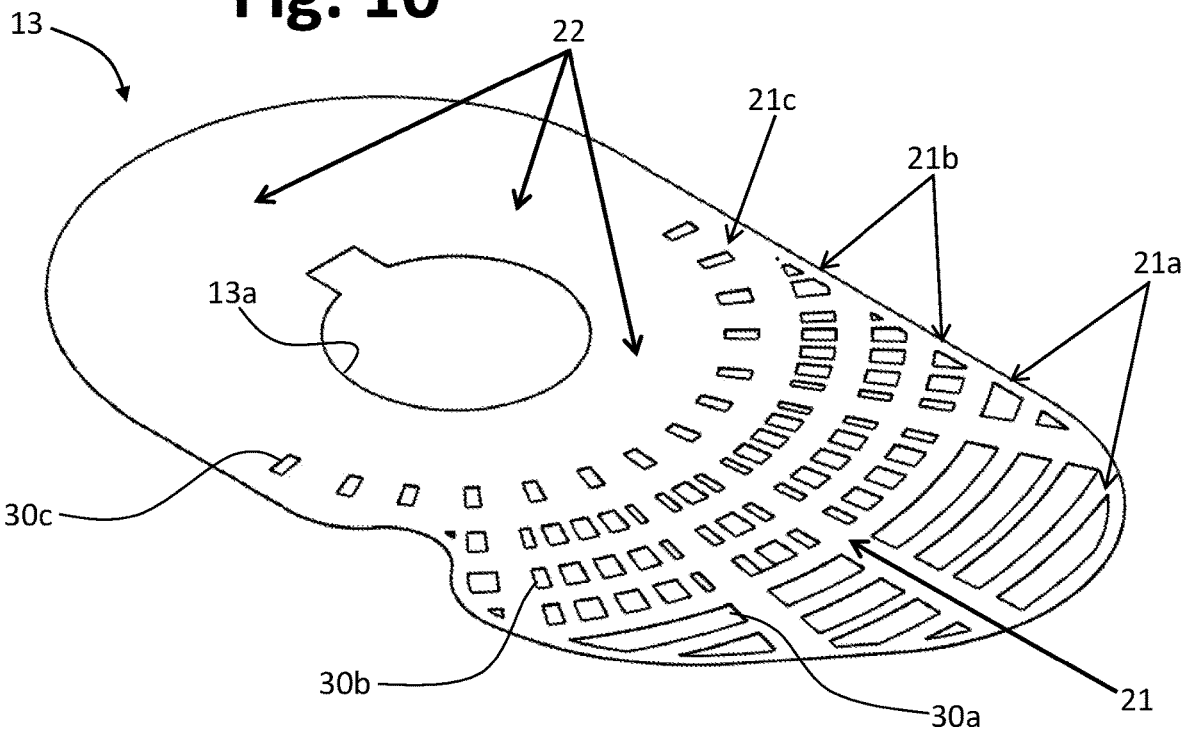
FIG. 10 is a schematic perspective view of an electrode of an electrical heating device according to possible embodiments of the invention.

With reference to the case of FIG. 10 (or of FIGS. 6-7), it will be appreciated how the region 21 is distinguished by the presence of a plurality of electrically non-conductive sites 30*a*, 30*b*, and 30*c*, i.e., of openings or through holes in the layer 13, whereas the region 22 is substantially devoid of electrically non-conductive sites, i.e., devoid of openings or through holes in the layer 13 (without obviously considering the openings 13*a* and 14*a*, which are not defined for the purposes of a variation of heat emission). In what follows, for reasons of brevity and where not otherwise specified, the electrically non-conductive sites will also be defined as "holes".

Basically, then, the holes are arranged or distributed on at least one electrode layer so as to be absent or in a smaller number in the areas where it is desired to obtain greater heating (i.e., a higher power density), as for example the area close to the outlet 1*b* of FIG. 1, and be in a larger number, or have larger dimensions in the area or areas where it is desired to obtain less heating (i.e., a lower power density), as, for example, the peripheral areas of the bottom 1*a* of FIG. 1. As explained hereinafter, a similar behaviour occurs at the other electrode layer, even when this is without holes.

FIG. 10 lends itself also to illustrating the case where one and the same region configured as a whole for a lower heat emission, here represented by the region 21, can in turn be divided into a plurality of subregions, designated by 21*a*, 21*b*, and 21*c*. From another standpoint, hence, in the electrode 13 of FIG. 10 there may be identified a region 22 with higher heat emission and three regions 21*a*, 21*b* and 21*c* with lower heat emission, where in turn the heat emission is differentiated in the regions 21*a*, 21*b* and 21*c*.

In the example, the subregion 21*a* is the one distinguished by the lowest heat emission and is provided with holes 30*a* with largest cross section, whereas the subregions 21*b* and 21*c* are distinguished by respectively increasing heat emissions: this is obtained, in the case of the subregion 21*c*, by holes 30*c* that are in a number a little greater than in the subregion 21*a*, but that have a decidedly smaller cross section than the holes 30*a*; the subregion 21*b* has instead holes 30*b* with an intermediate cross section as compared to the holes 30*a* and 30*c*, but in a decidedly higher number.

In more general terms, the greater the ratio between the total area of the holes of a given region (i.e., the sum of the areas of the individual holes) of an electrode layer and the overall or "full" area of the same region (i.e., its theoretical area in the absence of holes), the lower the emission of heat in this region.

The above concept may be clarified with reference to FIGS. 11 and 12, which illustrate schematically in cross-sectional view a portion of a heating device 10. In the case of FIG. 11, a portion of the electrode layer 13 of FIG. 10 is visible, corresponding to a hole 30*a* of its region 21 (or subregion 21*a*). The electrode layer 14 is devoid of holes, albeit itself identifying a region 21 (or subregion 21*a*) in a homologous position with respect to that of the electrode layer 13. In the example, the casing layer 11 is shaped so as to come into contact with, and preferably be fixed to, the heating layer 15 in an area corresponding to the hole designated by 30*a*, for example locally glued on the layer 15 at the hole 30*a*.

FIG. 12 represents schematically the distribution of the electric current in the case of the configuration of FIG. 11, with the consequent distribution and intensity of heat generated by the layer 15. Represented schematically within the layer 15—via broken-line arrows—are generic paths of the electric current (from the electrode layer 13 to the electrode layer 14). Corresponding to the greater length of an electrical path is a higher electrical resistance, and hence a lower current intensity, with consequent lower heating power: the heat emission (i.e., the different distribution of the heating power) is represented schematically by the wavy arrows present on the outside. As may be noted, in the full areas of the two electrode layers 13 and 14 that are parallel to one another and in contact with the layer 15, the heat emission is maximum, whereas it is lower in the perimetral area of the hole 30*a* of the electrode layer 13, and is substantially absent in the hole 30*a* itself; on the other hand, the emission of heat decreases with approach to the centre of the area of the electrode layer 14 defined by the hole 30*a*.

FIGS. 13 and 14 illustrate in a similar way the case of a heating device 10 in which both of the electrode layers 13 and 14 present at least one region 21 (or subregion 21*a*) provided with holes; for example, they are both similar to the electrode layer 13 of FIG. 10. In this case, both of the casing layers 11 and 12 may be shaped so as to come into contact with the heating layer 15, and preferably be locally fixed to the latter, in the area of the respective holes 30*a*. FIG. 14 represents schematically the distribution of the electric current in the case of the configuration of FIG. 13, as already described above in relation to FIGS. 11-12. There may be noted, in this case, a substantially similar heat emission at the two electrode layers 13 and 14. In the full areas of the two electrode layers 13 and 14 that are parallel to one another and in contact with the layer 15, heat emission is maximum; it is lower at the perimetral area of the hole 30*a* of the respective electrode layer 13 and 14, and is substantially absent around the hole 30*a* itself for the two electrode layers 13 and 14. It will be appreciated that, in various embodiments, the two electrode layers 13 and 14 may be the same as one another, also as regards the configurations of the respective holes or electrically non-conductive sites provided.

Of course, the holes provided in the various regions 21 and 22 could also differ for the electrode layer 13 and the electrode layer 14, for example by envisaging in the region 21 of the layer 14 holes that have a shape, and/or size, and/or density different from those of the holes provided in the corresponding region 21 of the layer 14.

With reference, for example, to FIGS. 6-7, it will be appreciated that, in a device 10 that includes an electrode layer 13 substantially configured as in FIG. 10 and the other electrode layer devoid of holes, heat emission will be maximum in the regions 22 of the two electrode layers 13 and 14 (these regions being devoid of holes, and thus presenting as a whole a behaviour substantially similar to what is represented at right-hand and left-hand ends of FIG. 12); instead, heat emission will be lower in the regions 21 of the two electrode layers 13 and 14, which have a behaviour similar to what is represented as a whole in FIG. 12. The same may be said in the case where both of the electrode layers 13 and 14 are configured as in FIG. 10 (i.e., as in FIGS. 13 and 14), with the difference that in this case, in the regions 21 of the two electrode layers, heat emission will be lower still.

Of course, the holes provided in the electrode layer 13 and/or in the electrode layer 14 may be configured in multiple different ways or be combined with one another according to various configurations, according to the production requirements, for example in terms of shape, and/or arrangement, and/or size, and/or density on the electrode layer. For instance, exemplified in FIG. 15 is the case of an electrode layer 13 divided in a transverse direction into two regions 21 and 22, where the region 21 is provided with a substantially orderly array of holes 30 that have a square or quadrangular cross section, whereas the region 22 is substantially devoid of holes.

FIG. 16 illustrates, instead, the case of an electrode layer 13, the region 22 of which is surrounded practically entirely by the region 21, here provided with small holes 30 arranged in a substantially orderly way. Likewise, FIG. 17 illustrates the case of an electrode layer 13, the region 21 of which surrounds the region 22, but the latter is provided with holes 30*b*, which have a smaller cross section and a lower density than the holes 30*a* of the region 21. FIG. 18 exemplifies the case of an electrode layer 13 having three different regions 21, 22, and 23 configured for corresponding differentiated heat emissions, which have holes 30 of substantially equal cross section, but distributed in a different way, i.e., with maximum density in the region 21, intermediate density in the region 22, and minimum density in the region 23, with these regions 21, 22, and 23 that will consequently have a lower heat emission, an intermediate heat emission, and a higher heat emission, respectively. Likewise, in the case of FIG. 19 three regions 21, 22, and 23 are provided, having respective holes 30*a*, 30*b*, and 30*c* with a homogeneous shape, but with different dimensions of cross section and density.

As has been mentioned previously, the electrode layers 13 and 14 may be formed via blanking or dinking, in particular when they are obtained starting from material in the form of a sheet, or web, or plate, for example from a metal sheet or a mesh or an electrically conductive fabric. Obviously, the operation of blanking or dinking will be prearranged so as to obtain also the necessary holes on the electrode layer considered. For instance, operations of blanking or dinking are suitable for providing electrodes according to FIGS. 6-7, 10, 15-19.

Figure 20:
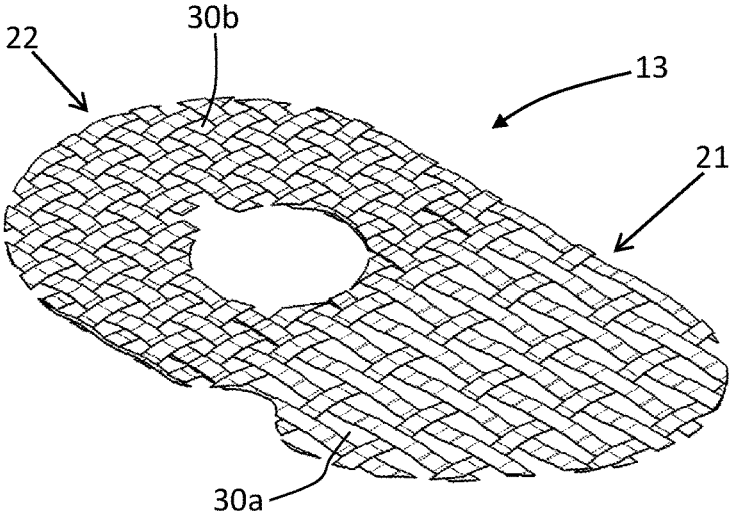

FIG. 20 illustrates the case of an electrode layer 13 made of an electrically conductive fabric, obtained from interwoven straps, for example metal straps or strips of electrically conductive fibre, for example carbon fibre, where both of the regions 21 and 22 are provided with holes 30*a*, 30*b*—corresponding to the openings between the warp and weft—where the larger dimensions of the holes 30*a* that constitute electrically non-conductive sites can be obtained by spacing differently some straps in the region 21 as compared to the region 22, as in the case exemplified in the figures for the region 21, or else by varying the width of the straps in the two regions 21 and 22, and maintaining their centre-to-centre distance substantially constant.

Figure 21:
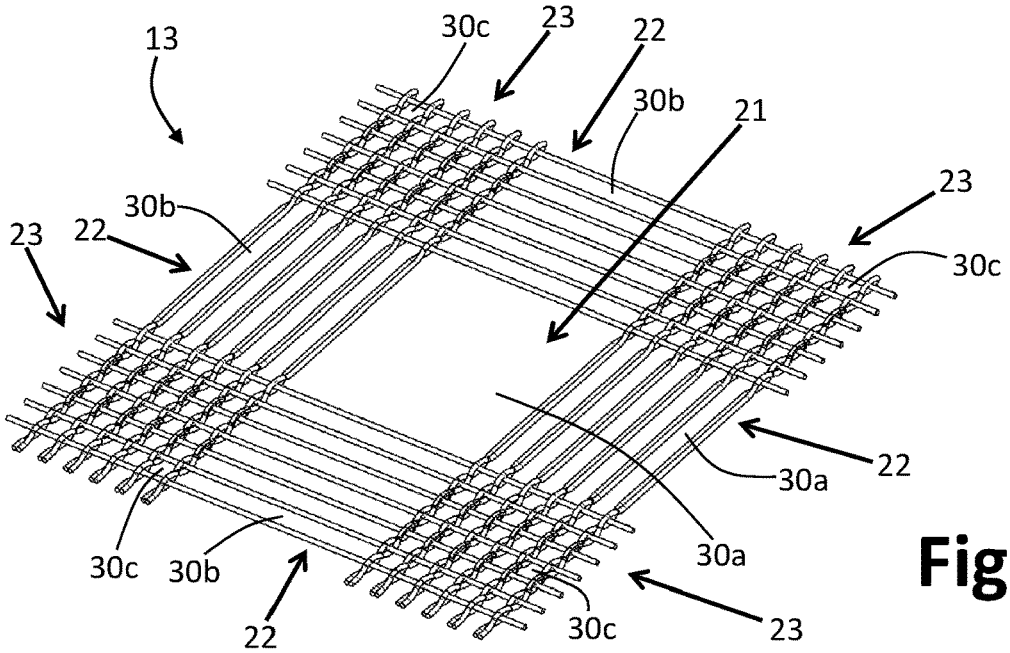

FIG. 21 illustrates a further example of electrode layer 13 formed substantially like a fabric, with warp and weft formed by wires or similar elements of electrically conductive material, for example a metal material or an electrically conductive fibre, such as carbon fibre.

In various embodiments, the warp and weft are arranged so as to define regions provided with differently sized holes. In the example illustrated, for instance, the warp and weft are arranged so as to define a sort of frame, with a central region 21 practically corresponding to a single hole 30*a* of maximum dimensions, and four angular regions 23 in which the warp and weft define holes 30*c* of minimum dimensions. The regions 22 that extend between the regions 23 are defined by just weft yarns or else just warp yarns, thus obtaining holes 30*b* of intermediate dimensions with respect to the central hole 30*a* and the holes 30*c*. As may be appreciated, heat emission will hence be minimum in the region 21, maximum in the regions 23, and intermediate in the regions 22.

Figure 22:
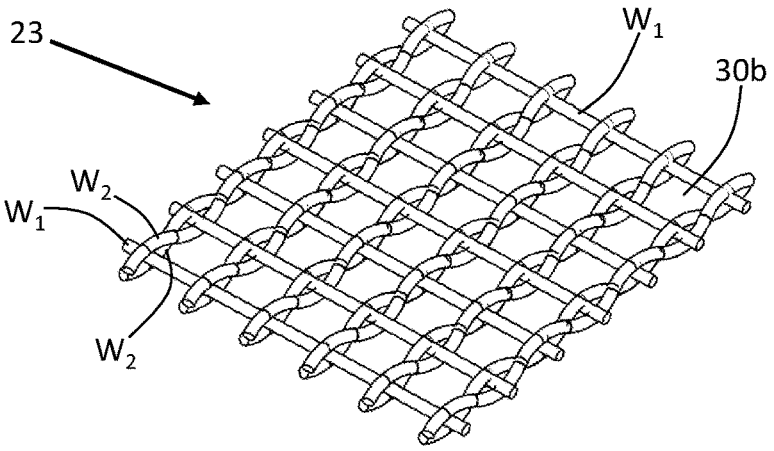
FIG. 22 is a detail at a larger scale of FIG. 21.

In various embodiments in which at least one electrode layer is formed by a fabric (not necessarily according to the configuration of FIG. 21), the fabric itself may be formed using a double-warp structure, i.e., one in which a first warp alternates with a second warp, in the opposite direction. Such a case is exemplified in FIG. 22, where a weft yarn is designated by $W_1$, while two double warp yarns are designated by $W_2$. The use of such a double warp—known also as "English gauze" in the textile sector—is particularly advantageous in the application here proposed in order to stabilise the warp itself, in particular during the steps of coupling the corresponding electrode layer 13 and/or 14 with the heating layer 15. This advantage is maximised in the case of a coupling by overmoulding of the layer 15 on the layer 13 and/or on the layer 14, in so far as the force of the plastic material injected under pressure in a mould, in the course of overmoulding of the layer 15 on the electrode layer, would tend to shift the threads that make up the latter, with consequent faulty operation of the heater, for example owing to a wrong distribution of the holes and/or areas with different heat emission.

As has been said, what has been described and exemplified in the figures with reference to the electrode layer 13 may apply also in relation to the electrode layer 14.

In various embodiments, at least one of the electrode layers 13 and 14, preferably both, is in the form of grid or mesh, for example obtained by making through incisions (staggered cuts) in a length of metal web and then deforming or stretching the lengths until passages 30*d* (FIG. 24) are obtained having a substantially rhomboidal or square shape.

In a meshed structure of this type, there may hence be made the specific holes 30*e* provided according to the teachings provided herein, i.e., the electrically non-conductive sites specifically provided for determining the type of heat emission, i.e., ones having a function different from that of the regular series of passages that are typically provided in common meshed structures or in certain fabrics. As may be seen in FIG. 23 and in the corresponding detail of FIG. 24, the holes 30*e*—which constitute the sites specifically provided for determining the type of heat emission—are additional to the passages 30*d* proper of the meshed structure of the electrode layer 13, and have a larger size and/or a different distribution.

In various embodiments, at least one of the electrode layers, preferably both of the layers 13 and 14, is at least partially embedded in the material of the heating layer 15, in such a way that the corresponding casing layer 11 or 12 will adhere directly on at least part of the surface of the heating layer 15, at one of the two opposite major faces of the latter. This solution is particularly advantageous in so far as the layer 15 has its two opposite major faces substantially plane, thereby guaranteeing a better adhesion of the casing layers 11 or 12. In embodiments of this type, as exemplified in FIGS. 25-27, the material of the layer 15 may be overmoulded on the layers 13 and/or 14, as for example for the meshed electrode layers of the type exemplified in FIGS. 23-24, or else the electrode layers 13 and/or 14 may be embedded in a heating layer 15 produced previously, for example after the respective surfaces thereof have been heated or melted and the layers 13 and/or 14 have been made to penetrate therein. As already mentioned, the possible compatibility between the materials of the electrode layer 15 and of the layers 11 and 12 and/or bonding and/or welding between them improve fixing of the casing of the device.

Figure 25:
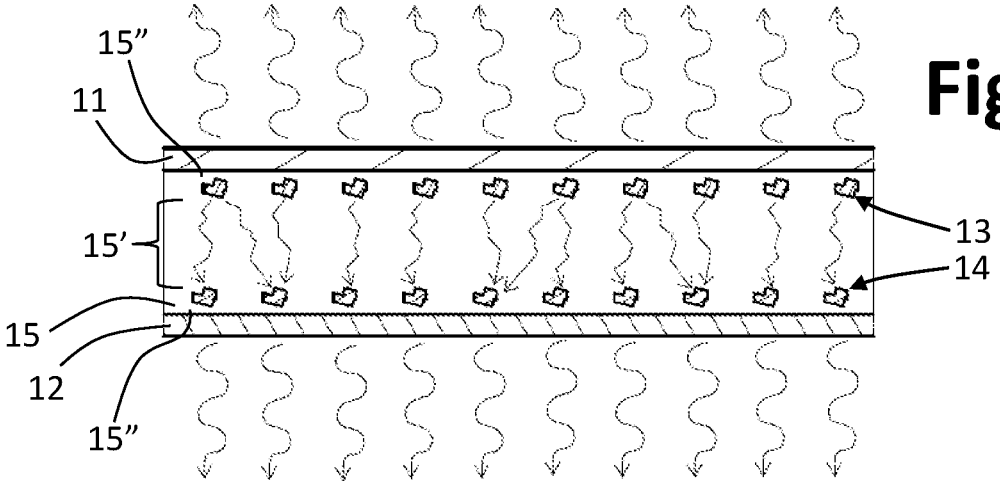
FIGS. 25, 26, and 27 are partial and schematic cross-sectional views of electrical heating devices according to possible embodiments of the invention.
Figure 26:
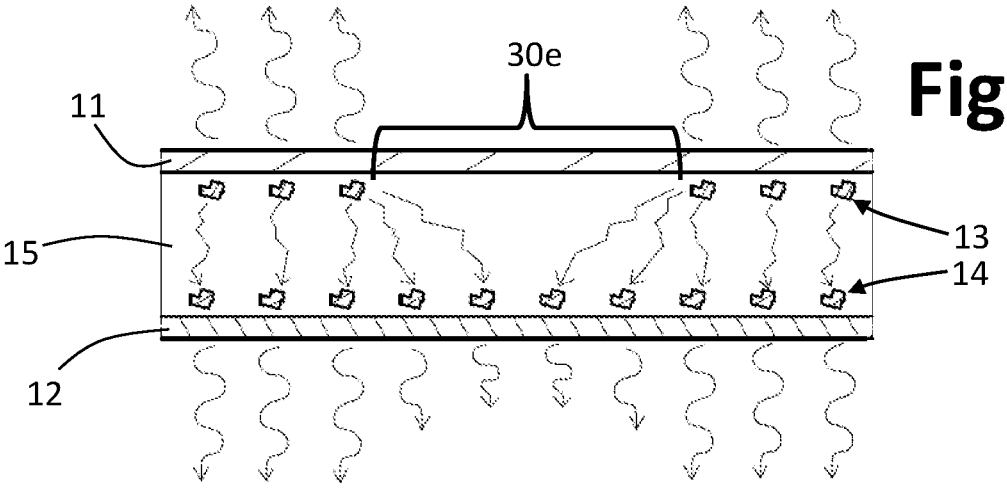
Figure 27:
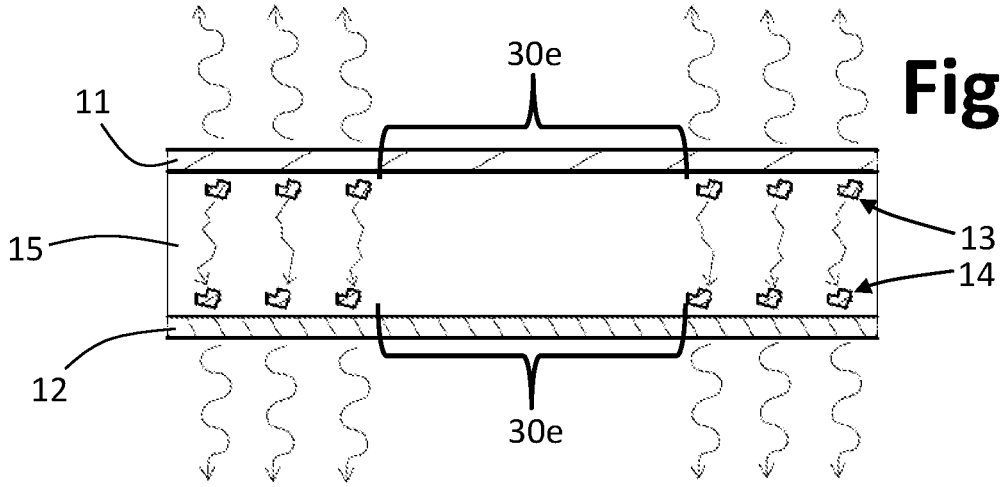

FIGS. 25-27 illustrate the case of meshed electrode layers 13 and 14 embedded in the material of the layer 15, with the casing layers 11 and 12 that extend directly on the outer surfaces of the layer 15, that are preferably plane surfaces that cover externally the layers 13 and/or 14, or else surfaces that extend at the same height as the layers 13 and/or 14, or again surfaces that extend beyond the outer profile of the layers 13 and/or 14.

The cross-sectional view of FIG. 25 substantially corresponds to a region of the electrode layers 13 and 14 devoid of holes or sites aimed at determining the type of heat emission, according to the teachings provided herein. As may be noted, the internal electrical paths represented schematically by the broken-line arrows are of a small length, substantially equal to or a little greater than the distance between the electrode layers 13 and 14. Corresponding to the smaller length of the electrical paths is a lower electrical resistance, and hence a higher current intensity, with consequent greater heating power: also in this case, the heat emission (or heating power density or emittance) is represented schematically by the wavy arrows present on the outside. As may be noted, in these cases, just a part of the layer 15—designated by 15' only in FIG. 25—is set between the electrode layers 13 and 14, where in particular this part 15' of the layer 15 forms the active portion for the purposes of heating. According to the preferential example, there is moreover present at least one outer part 15" of the layer 15 set between the layer 13 and the layer 11 and/or one outer part 15" of the layer 15 set between the layer 14 and the layer 12, where the outer part 15" transfers the heat emitted by the part 15' towards the respective casing layer 11 or 12, i.e., towards the outside of the device. The outer parts 15", if present, are of small thickness, for example of between 0.01 mm and 1 mm, to prevent or hinder transmission of heat towards the outside.

According to an aspect in itself inventive, the transfer of heat between the electrode layer 13 and/or 14 and the respective casing layer 11 and/or 12 may be improved via the addition of a thermally conductive filler present in the material of the layer 15, for example, in the part 15' and/or the parts 15".

The cross-sectional view of FIG. 26 substantially corresponds to a region in which the electrode layer 13 is provided with holes 30*e*, i.e., electrically non-conductive sites, whereas the corresponding region of the electrode layer 14 is devoid of holes 30*e*. As may be noted, the pattern of the electrical paths and the heat emission resemble those already described above with reference to FIG. 12, i.e., with a low or absent heat emission in the area of the holes 30*e* of the layer 13.

The cross-sectional view of FIG. 27, instead, substantially corresponds to the homologous regions of two electrode layers 13 and 14 that are both provided with holes 30*e*. The pattern of the electrical paths and the heat emission hence resemble the ones already described above with reference to FIG. 14.

Figure 23:
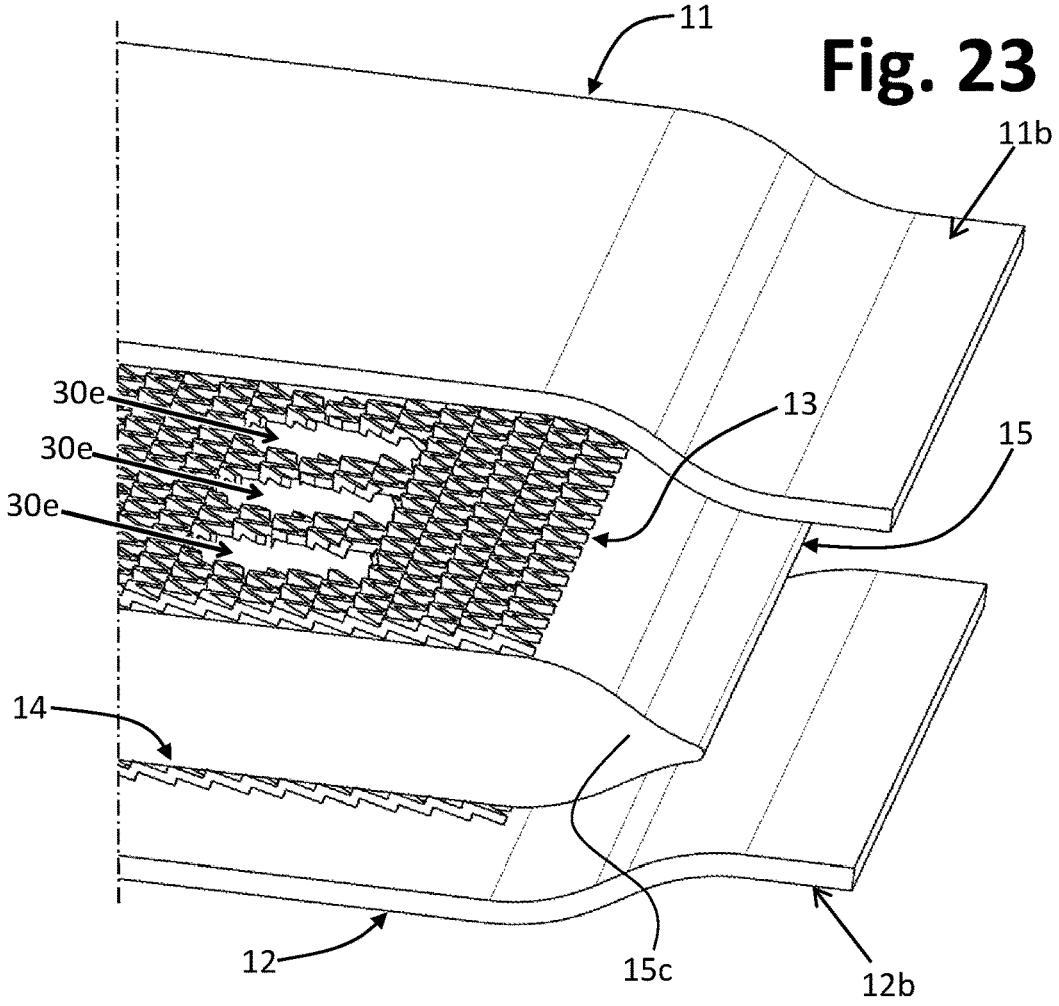
FIG. 23 is a partial and schematic sectioned view of an electrical heating device according to possible embodiments of the invention.
Figure 24:
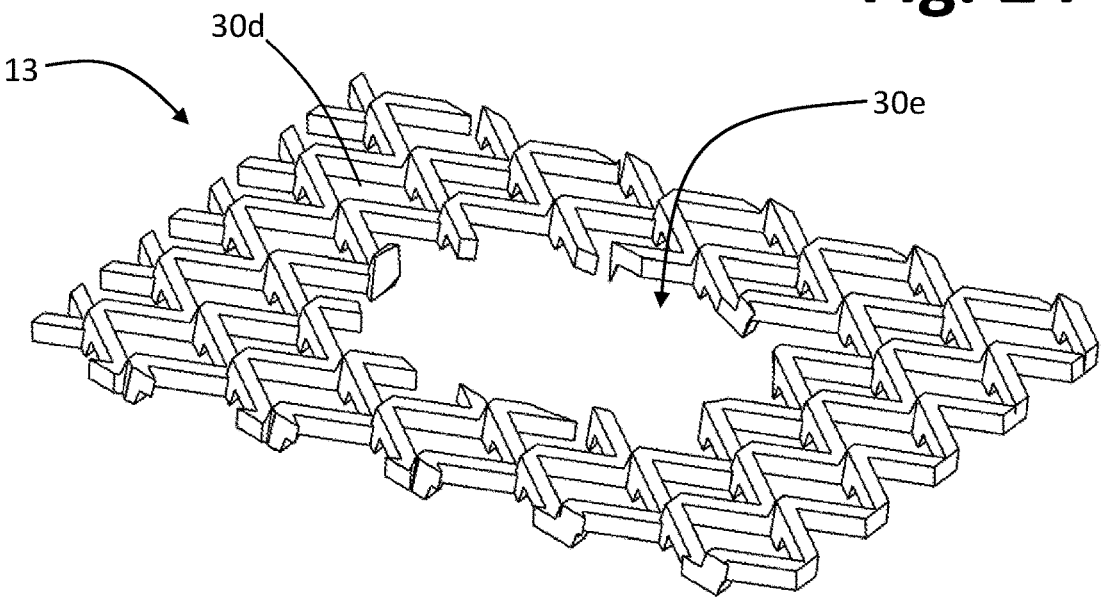
FIG. 24 is a detail at a larger scale of FIG. 23.
Figure 28:
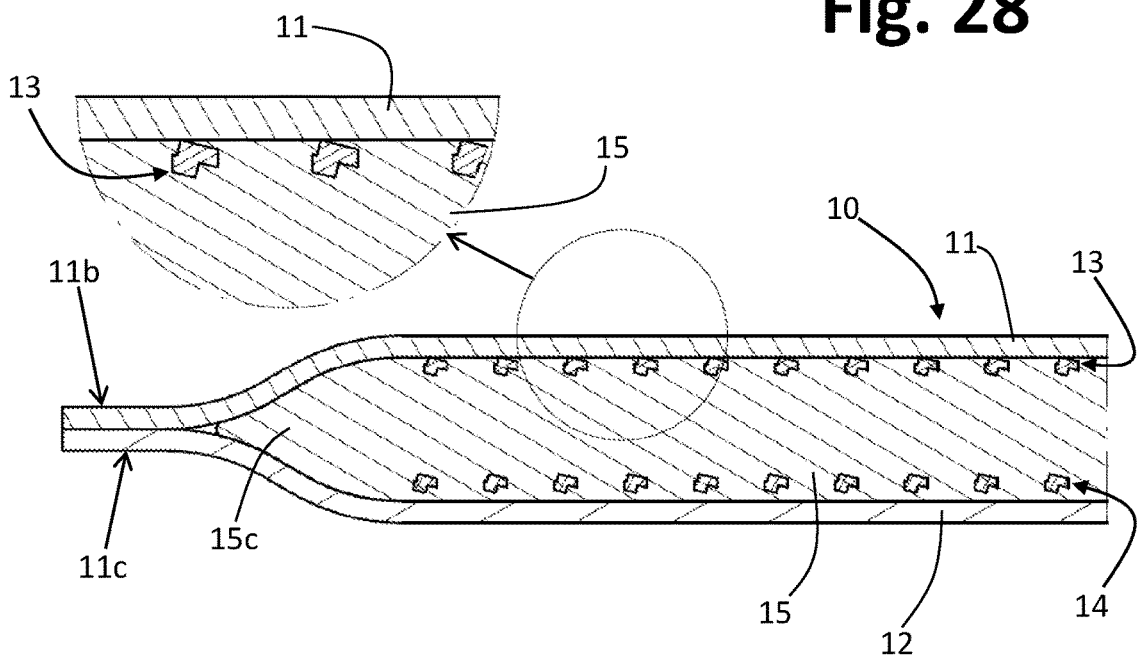
FIGS. 28, 29, and 30 are partial and schematic cross-sectional views, with corresponding details at a larger scale, of electrical heating devices according to possible embodiments of the invention.

As an alternative to overmoulding of the layer 15 on the layers 13 and 14, meshed electrode layers may be made to penetrate at least in part into the material of the layer 15 previously moulded in the form of a sheet, in particular by heating the layer 15 and then pressing the electrode layers into it. Such a case is exemplified in FIG. 28, where the electrode layers 13 and 14 with meshed structure, for example of the type illustrated in FIGS. 23-24, are made to penetrate into the layer 15, on the opposite faces of which the coating layers 11 and 12 are then applied, when envisaged, for example in the form of hot-laminated polymer films or layers or else in the form of overmoulded layers. As has been mentioned, this proves advantageous for the purposes of a better adhesion or bonding or welding between the casing 10*a* and the heating element constituted by the electrode layers and the heating layer, on the major faces of the latter.

Figure 29:
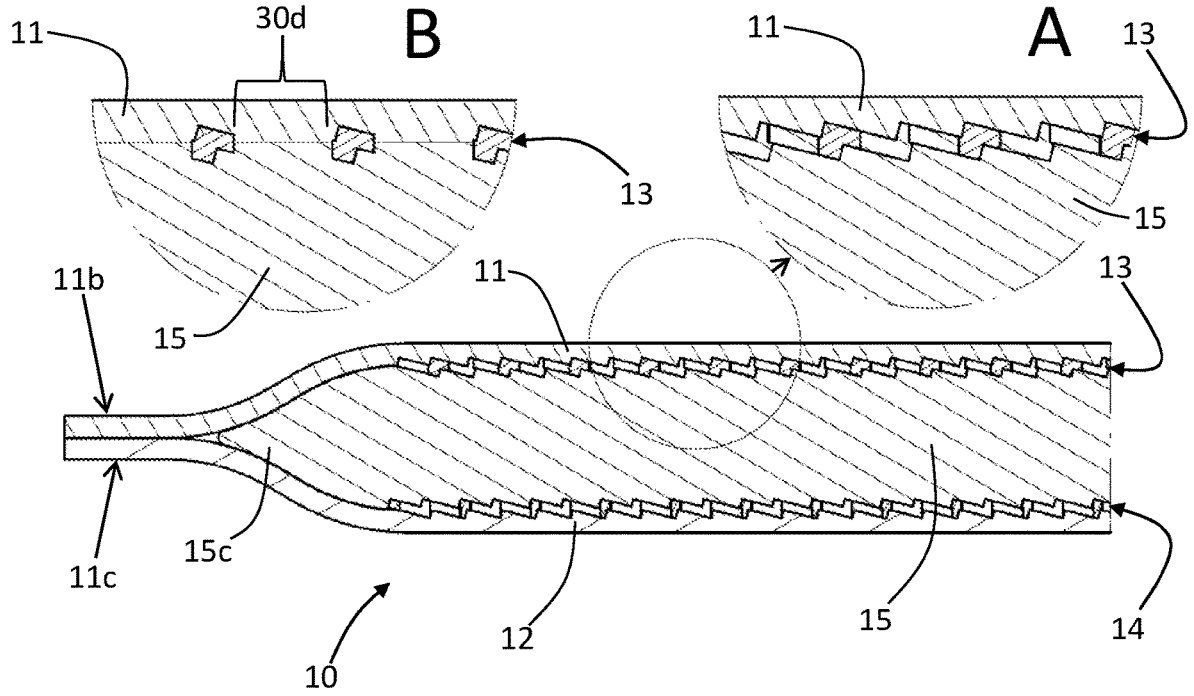

FIG. 29 illustrates the case of meshed electrode layers 13 and 14 that are made to penetrate only partially in the heating layer 15, i.e., that slightly project therefrom (it should be noted that the cross-sectional view of FIG. 29 and the corresponding detail A are represented schematically to clarify the arrangement of the layers 13 and 14). In embodiments of this type, the casing layers 11 and 12, which also in this case, for example, are in the form of hot-laminated polymer films or layers or else in the form of overmoulded layers, may be shaped so to adapt and be fixed to the profile of the layer 15 and of the layers 13, 14. With this solution, part of the electrode layers 13 and 14 remains on the outside of the material of the heating layer 15, thereby determining the presence of parts in relief (corresponding to the projecting parts of the layer 13 and/or 14), which makes it possible to improve further fixing of the casing of the heating device. Part of the material of the casing layers 11 and 12 (or of the overmoulded walls that replace them) may penetrate locally between the meshes of the meshed layers 13 and 14, and within the electrically non-conductive sites (such as the holes 30*e*, with reference for example to FIG. 24), thus fixing or welding also to at least part of the material of the heating layer 15 that is also present between the aforesaid meshes of the meshed structure (as highlighted in the detail B of FIG. 29, which represents a cross section in an area corresponding to the passages 30*d* of the layer 13—see FIG. 24) and within the electrically non-conductive sites (namely, the holes 30*e*, with reference for example to FIG. 24).

Figure 30:
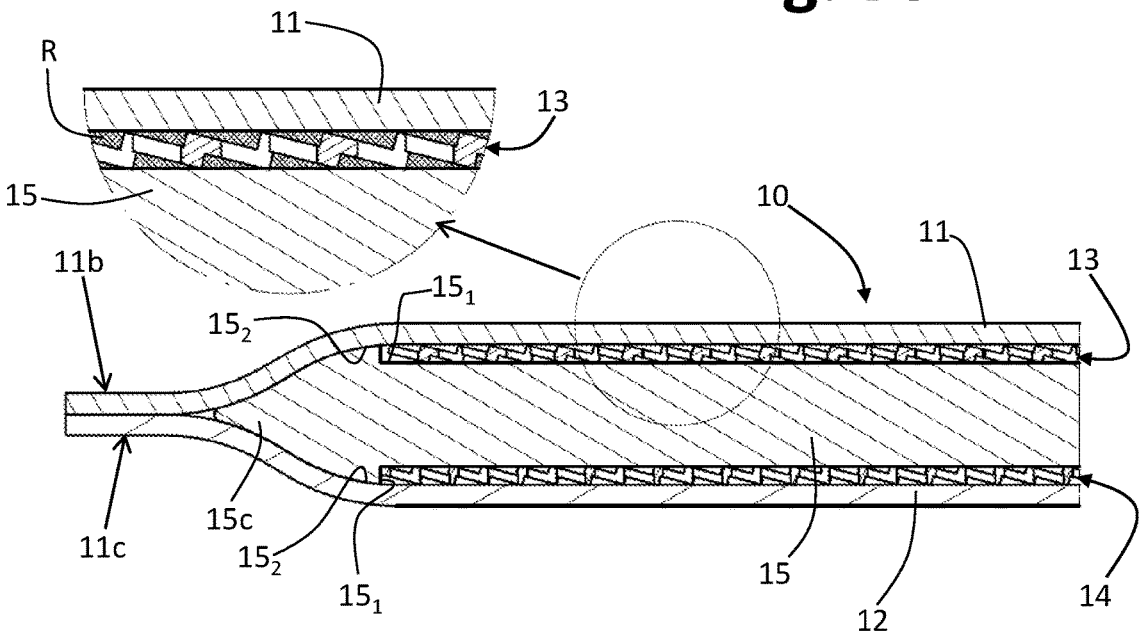

In various embodiments, defined on the two opposite faces of the heating layer 15 are recesses for housing and positioning at least part of the electrode layers, not necessarily electrode layers in the form of a mesh: an example of this type is illustrated in FIG. 30, where the aforesaid recesses are designated by $\mathbf{15}_1$. In embodiments of this type, the electrode layers 13 and 14 may be set only in contact with the layer 15*a*, for example glued thereto or else held in position by exploiting the casing layers 11 and 12, whether these are in the form of overmoulded films or walls. In the case of use of electrode layers 13 and/or 14 with meshed structure, for example of the type illustrated in FIGS. 23-24, it is also possible to provide a layer of glue or resin that covers the meshed structure, for example by pouring or moulding the glue or resin on the layer 13 and/or 14, to prevent any presence of air: such a layer of glue or resin is represented schematically only in the detail of FIG. 30, where it is designated by R (in FIG. 30, the representation of the layer R has been omitted for clarity of representation). The presence of the glue or resin R may advantageously be exploited also for defining a substantially plane surface for the layers 11 and 12, in the areas corresponding to the recesses $\mathbf{15}_1$, i.e., to the electrode layers. The glue or resin R is preferably of the thermally conductive type, such as a resin and/or an adhesive with a low value of thermal resistance. It will be appreciated that, also in embodiments of this type—even in the absence of the glue or resin R—, the casing layers 11, 12, in the form of applied films or else overmoulded walls, are preferably at least in part in contact with and/or fixed to the material of the heating layer 15, for example in areas that delimit the aforesaid recesses $\mathbf{15}_1$ peripherally, such as the areas designated by $\mathbf{15}_2$. The possible resin R is preferably a polymer of the type designed to fix and/or bind chemically and/or structurally to the material or polymer that forms the heating layer 15 and/or the casing layers 11, 12.

In various embodiments, even in the absence of the openings 11*a*-15*a* and of the body 16 of FIG. 4, the heating device 10 may be provided with intermediate areas of joining or fixing between the layers 11 and 12, preferably in a fluid-tight way, aimed, for example, at improving the packing between the stacked layers and/or facilitating mounting in position of the layered structure.

Figure 31:
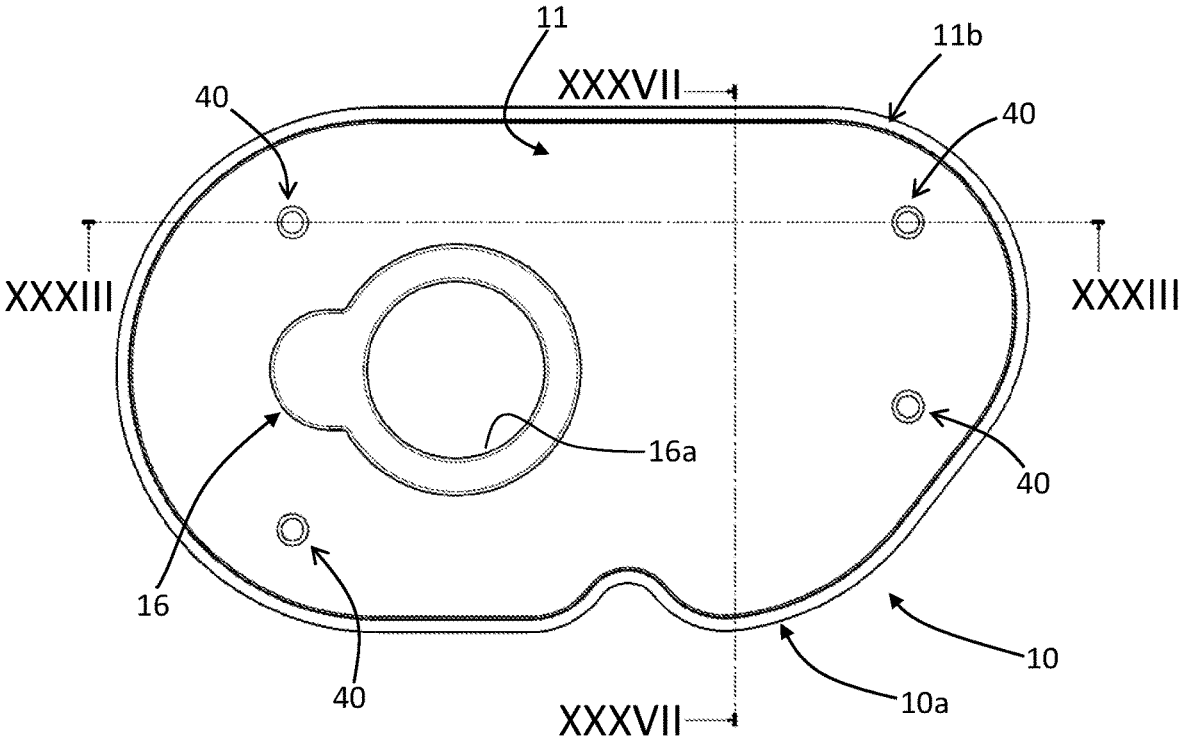
FIG. 31 is a schematic top plan view of an electrical heating device according to possible embodiments of the invention.

For instance, illustrated schematically in FIG. 31 is a sort of "quilt" structure, i.e., of the type in which the device 10 has intermediate areas of joining or fixing, represented as a whole by 40, where the casing layers 11 and 12 are fixed to one another, in addition to their perimetral joining areas 11*b*, 12*b*. For this purpose, the layers 13-15 are provided with openings arranged substantially coaxially to, or at least in part facing, one another. In FIG. 32, where the representation of the casing layer 11 has been omitted, designated by 40*a* are through openings 40*a* of the layer 13 provided in the region 22 (similar through openings are provided in the layer 14), and designated by 40*b* are through openings of the layer 15, here substantially coaxial to, or facing at least in part, respective openings 30 of the region 21 of the layer 13 (and also substantially coaxial to through openings of the underlying layer 14).

FIGS. 33 and 34 illustrate the configuration of an intermediate area 40 located in the regions 21 of the electrode layers 13 and 14, in this case both of which are provided with holes 30. As may be noted, thanks to the presence of these holes 30 and of the holes 40*b* of the heating layer 15, the casing sheets 12 and 14—purposely shaped or deformed—can be brought locally into contact with one another so as to be joined together, for example via welding or gluing. Preferentially, the edge 15*b* of the heating layer 15 around the openings 40*b* is substantially tapered in order to facilitate mutual contact between the layers 11 and 12, as well as for the purposes clarified hereinafter. In various embodiments, the above edge has at least one wall that is inclined, in particular towards the inside of the hole 30. Preferentially, two such inclined walls of the heating layer 15 are provided, inclined in opposite directions and designed to form an angle with one another, such as an angle of between 30° and 120°, preferably of between 45° and 75°. The at least one inclined wall, or each inclined wall, of the edge 15*b* may be considered as belonging to a corresponding major face of the heating layer 15, forming in fact a sort of prolongation thereof.

In the case exemplified, in the intermediate area 40 illustrated, also the casing layers 11 and 12 have substantially coaxial or at least partially facing through openings 11*d* and 12*d*, respectively, which may, for example, be exploited for fixing the device, or again for enabling passage of a fluid between the two opposite faces of the heating device. In the presence of the openings 11*d* and 12*d*, joining between the layers 11 and 12 in the area 40 will preferably be fluid-tight; however, in addition or as an alternative to fixing between the casing layers 11 and 12, tightness in regard to infiltration of liquids or other fluids within the heating device may be obtained via a sealed fixing between the casing layers 11 and the heating layer 15 (at least at its edge 15*b*), in particular via welding or gluing or overmoulding. In the case of welding or overmoulding, it is preferable to use polymers for the layers 11, 12, and 15 that are to melt at least in part and weld to one another, or polymers that are bind to one another, such as a layer 15 and at least one layer 11 and/or 12 comprising PE or HDPE and/or POM. The presence of the openings 11*d* and 12*d* must in any case be understood as optional and hence not indispensable.

Figure 35:
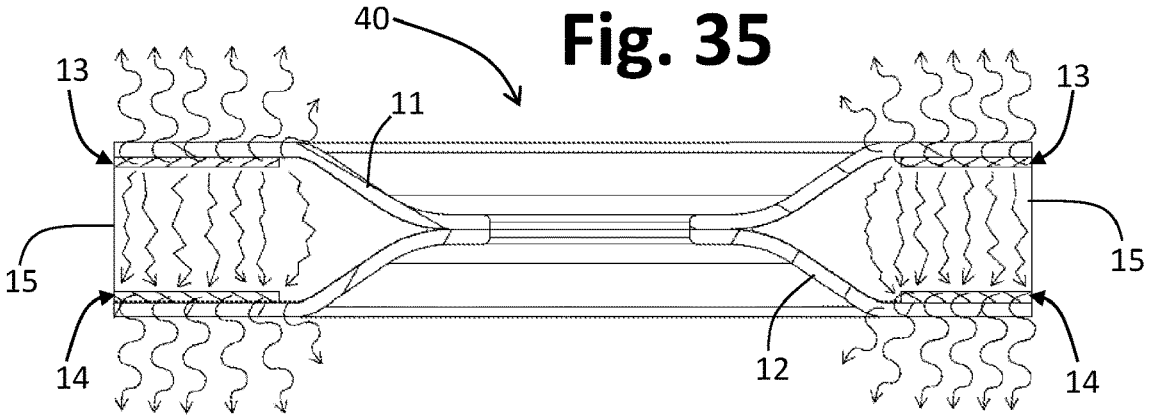
FIG. 35 is a partial and schematic cross-sectional view aimed at representing the pattern of electrical and heat-emission paths in the portion of the heating device of FIG. 34.
Figure 36:
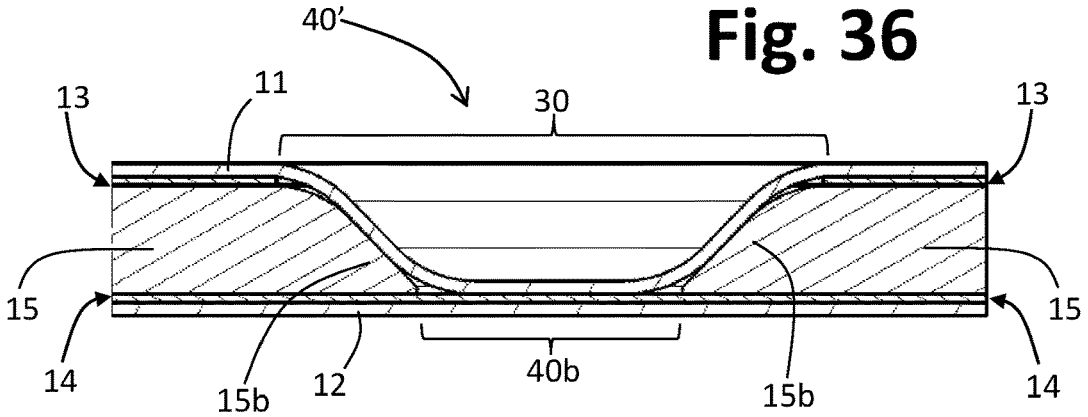
FIG. 36 is a partial and schematic cross-sectional view of an electrical heating device according to possible embodiments of the invention.

FIG. 35 represents the pattern of the electrical paths and of heat emission in the area 40 of FIG. 34. As may be noted, the operating condition resembles the one already described above with reference to FIG. 14. FIG. 36 illustrates, instead, the case of an intermediate area 40' in a region of the electrode layer 13 that is provided with holes 30, whereas the corresponding region of the electrode layer 14 is instead devoid of such holes. Here the heating layer 15 has its own through openings 40*b*, one or more of which are substantially coaxial to, or face, respective holes 30 of the layer 13, as represented precisely in FIG. 36. As may be noted, in this case, the upper casing layer 11 may be set directly up against the lower electrode layer 14, and secured to this, for example via gluing or some other type of adhesion or bonding. Also in this case, the edge 15*b* of the openings 40*b* is substantially tapered, in particular by means of a wall inclined towards the inside of the hole 30. Also this case, the inclined wall of the edge 15*b* may be considered as belonging to a corresponding major face of the heating layer 15, here its upper face.

As may be appreciated, also in the case of FIG. 36 the pattern of the electrical paths and heat emission in the area 40' resembles the one already described above with reference to FIG. 12.

In various embodiments, the heating layer 15 defines one or more edges, which have a substantially tapered profile, and the casing 10*a* of the device has one or more portions shaped in a substantially corresponding or complementary way. This characteristic has already been previously highlighted in relation to the intermediate fixing areas 40 of FIGS. 31-37, where the layer 15 has through openings 40*b* having preferentially edges 15*b* with a tapered shape, for example distinguished by one or two inclined walls, and with one or both of the casing layers 11, 12 shaped to adapt to this shape. In preferred embodiments, however, even in the absence of intermediate areas 40, at least one, and preferably all, of the peripheral edges of the heating layer 15, has/have a substantially tapered shape or a shape with decreasing thickness, for example by means of at least one inclined wall. Peripheral edges of this type are, for example, highlighted in FIGS. 23, 28, 29, and 30 and are designated by 15*c*. What has been exemplified previously in relation to the inclined walls of the edge 15*b* of FIGS. 34 and 36 may in general apply to the peripheral edges 15*c* of the layer 15. Also in this case, the at least one inclined wall, or each inclined wall, of the peripheral edge 15*c* may be considered as belonging to a corresponding major face of the heating layer 15.

Figure 37:
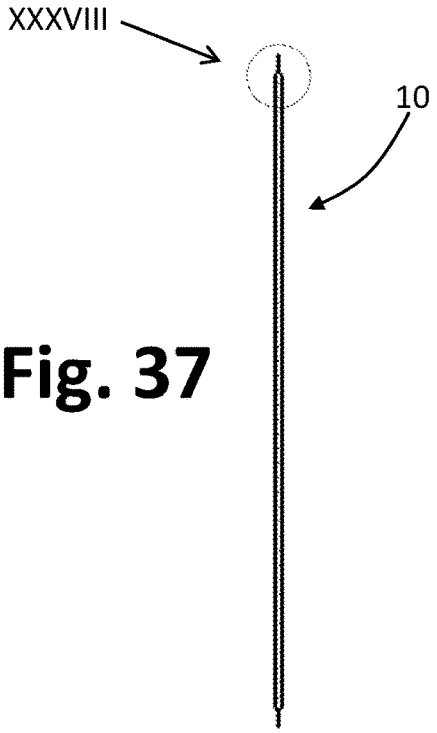
FIG. 37 is a schematic cross-sectional view according to the line XXXVII-XXXVII of FIG. 31.
Figure 38:
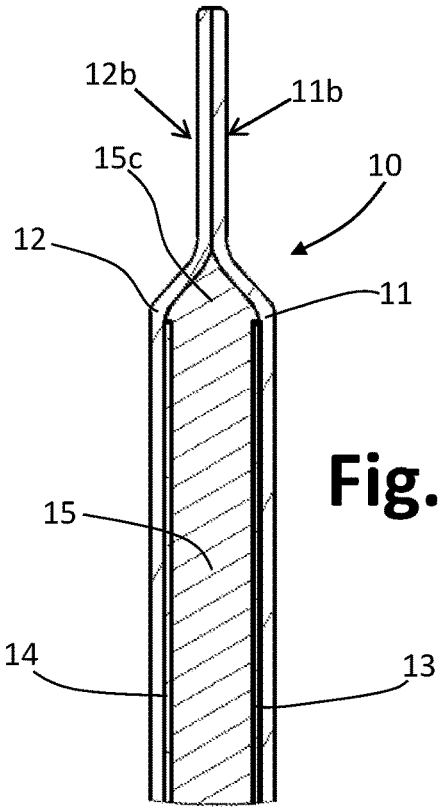
FIG. 38 illustrates at a larger scale the detail XXXVIII of FIG. 37.

As may be seen also with reference to FIGS. 37-38, the tapered or inclined shape of the edges 15*c* of the layer 15 enables an improved adhesion of the casing layers 11 and 12, in particular when these are in the form of polymeric sheets or films. The peripheral areas of the layers 11 and 12 close to the superposition areas 11*b* and 12*b* may in this way adapt and follow an inclined profile, which prevents, for example, formation of right-angle bends.

Figure 39:
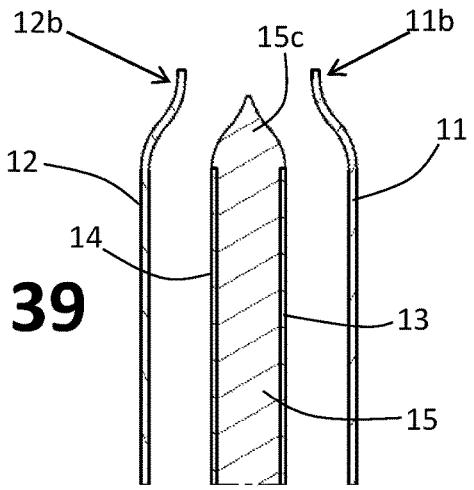
FIG. 39 is a partial and schematic cross-sectional view of a step of assembly of an electrical heating device according to possible embodiments of the invention.
Figure 40:
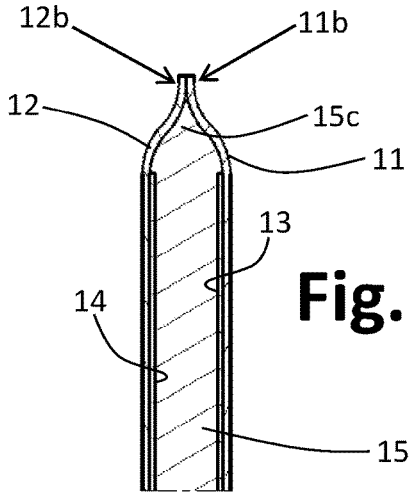
FIG. 40 is a partial and schematic cross-sectional view of the heating device following upon the step of assembly of FIG. 39.

The tapered or inclined peripheral profile of the edges 15*c* may be bestowed upon the layer 15 in the course of its production, for example in the course of its moulding, as highlighted in FIG. 39 (or in FIG. 23), with subsequent application of the casing layers 11 and 12 that adapts to the above profile, which is already shaped, the casing layers 11 and 12 being then sealingly joined together at the superposition areas 11*b* and 12*b*, as highlighted in FIG. 40, possibly also with fixing between the edge 15*c* of the layer 15 and the casing layers 11 and 12, for example via surface re-melting and/or bonding between the layers 11, 12, and 15 in the areas of mutual contact.

Figure 41:
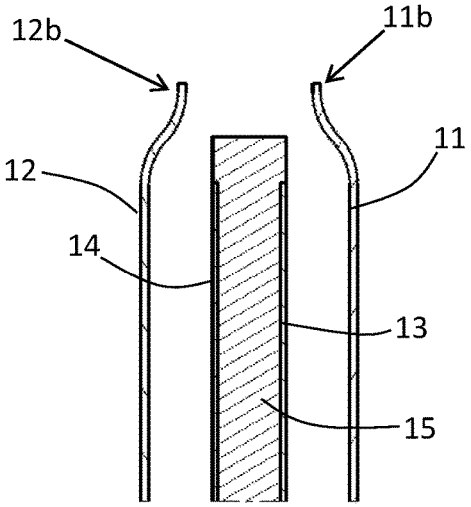
FIGS. 41 and 42 are partial and schematic cross-sectional views of respective steps of assembly of an electrical heating device according to possible embodiments of the invention.
Figure 42:
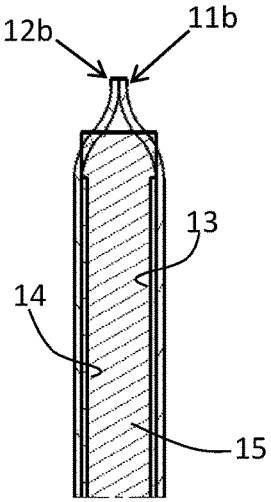
Figure 43:
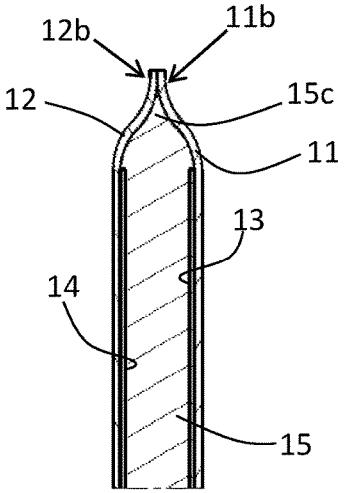
FIG. 43 is a partial and schematic cross-sectional view of the heating device following upon the step of assembly of FIG. 42.

Alternatively, the layer 15 may be initially formed with squared edges or edges of a different shape, for example having sharp corners, as highlighted in FIG. 41. In embodiments of this type, the layer 15 may subsequently undergo deformation, for example via heating after it has been obtained in order to enable a certain mouldability thereof, and in this condition the layers 11 and 12 are applied thereon by exerting thereon pressure or compressive force: such a step is represented schematically in FIG. 42. Application of the aforesaid compressive force enables a certain deformation of the layer 15 to be obtained, that brings it to assume the tapered profile 15*c*, with part of the material that translates and "fills" the corresponding tapered profile of the casing layers 11 and 12, as represented schematically in FIG. 43.

The presence of tapered edges in the layer 15 presents the further advantage of preventing formation of significant empty spaces (air bubbles) between the layers 11, 12 and the peripheral edge 15*c* of the layer 15, and risks of failure following upon high degrees of expansion during the operating cycles of the device 10, at the same time enabling proper propagation of the heat towards the outside.

Highlighted in part A of FIG. 44 is the case of two layers 11 and 12 bent at right angles at a squared edge of the heating element (electrode layers and heating layer). The casing layers 11 and 12 adhere precisely against the squared profile, i.e., against the wall of the heating layer 15 orthogonal to the electrode layers 13 and 14, and are then again bent at right angles to define the superposition areas 11*b*, 12*b*. This structure must, however, be deemed substantially theoretical, in so far as it is difficult to implement practically given that, in the course of production, it is unlikely for the layers 11 and 12 to be positioned perfectly in the way illustrated, on account of the risk of air remaining trapped between the layers 11 and 12 and/or between the latter layers and the layer 15. Moreover, the likelihood of the layers 11 and 12 maintaining the position represented is extremely low, considering the inevitable expansion and contraction of the material of the layers 11 and 12 and/or of the layer 15 during operation of the heating device.

The structure illustrated in part B of FIG. 44 is more realistic, i.e., with the layers 11 and 12 that could be arranged so as not to adhere to the aforesaid squared profile of the heating element (electrode layers and heating layer), for example determining the presence of an albeit reduced a "fillet" of air or sac of air, designated by G. It should be noted that this condition could be assumed also in the case of an initial structure as the one illustrated in part A of FIG. 44 where, following upon the cycles of heating and cooling (and/or the cycles of expansion and contraction) of the material of the layer 15 and/or of the layers 11 and 12, there could occur a detachment of the layers 11 and 12 from the vertical peripheral wall of the layer 15, the structure thereby assuming a configuration similar to that of part B of FIG. 44.

Part C of FIG. 44 highlights a condition of heating of the structure of the part B of FIG. 44, where the sac of air G expands, creating a greater detachment between the two layers 11 and 12 and/or between each layer 11 or 12 and the corresponding electrode layer 13 or 14, with consequent risks of failure and infiltration of a medium external to the heating device. It should be noted that the presence of the sac of air G has also the effect of reducing in this area heat emission towards the outside of the device, the heat emission being also here represented schematically by the wavy arrows. The heat must in fact propagate through the air of the sac G, which notoriously operates as thermal insulator.

As has been mentioned previously, at least one of the electrode layers 13, 14 and/or the heating layer 15 and/or the electrically non-conductive sites may be prearranged in such a way that heat emission is as a whole different from one electrode to another. This measure may be adopted, for example, in applications where it is desired to have a maximum heat emission from a major face of the heating device, corresponding for example to the electrode layer 13, and a lower heat emission from the other major face of the device, corresponding, for example, to the electrode layer 14.

In this perspective, in various embodiments, a first electrode layer, for example the layer 14, has a plurality of electrically non-conductive sites, and the second electrode layer, for example the layer 13, is substantially devoid of electrically non-conductive sites, or else comprises one or more respective electrically non-conductive sites prearranged in such a way that the overall surface of contact between the heating layer 15 and the first electrode layer 14 is smaller than the overall surface of contact between the heating layer 15 and the second electrode layer 13, the emission of heat at the first electrode layer 14 thereby being smaller than the emission of heat at the second electrode layer 13.

FIG. 45 highlights, for example, the case of an electrode layer 13 that is devoid of electrically non-conductive sites obtained according to the teachings provided herein, and an electrode layer 14 that has, instead, such sites, designated by 30, here in the form of gaps between the warp and weft of a sheet of fabric with electrically conductive strips. It should be noted that in FIG. 45, as in the subsequent FIGS. 46-49, the electrode layers 13 and 14 are represented in reverse order as compared to the previous figures, i.e., with the layer 13 at the bottom and the layer 14 at the top. It will be appreciated that, according to the principles set forth previously, heat emission will be greater at the electrode layer 13.

Likewise, FIGS. 46 and 47 illustrate the cases of an electrode layer 13 devoid of the electrically non-conductive sites and a corresponding electrode layer 14 provided with such sites 30, here in the form of quadrangular and round through holes, respectively. As may be noted, also with reference to FIG. 46, the sites 30 may be distributed in a more or less regular way substantially over the entire area of the layer 14, even though this is not strictly indispensable, as already highlighted for the previous embodiments. It is also possible to use two electrode layers with different general structure, for example one electrode layer meshed and the other electrode layer in the form of lamina devoid of electrically non-conductive sites.

In various embodiments, the two electrode layers 13 and 14 may both have a plurality of respective electrically non-conductive sites, where the two pluralities of sites are, however, different one another, for example in terms of shape, and/or size, and/or arrangement, and/or number, and/or density of the corresponding electrically non-conductive sites. For instance, FIG. 48 illustrates the case of electrode layers 13 and 14 both provided with electrically non-conductive sites, for example in the form of through holes, where the sites 30*a* of the layer 13 have a cross section smaller than that of the sites 30*b* of the layer 14, to obtain a greater emission of heat at the electrode layer 13. The general concept according to which the ratio between the total area of the electrically non-conductive sites 30*a* and the overall or "full" area of the electrode layer 13 is smaller than the ratio between the total area of the electrically non-conductive sites 30*b* and the area of the electrode layer 14 hence applies also to FIG. 48.

Figure 49:
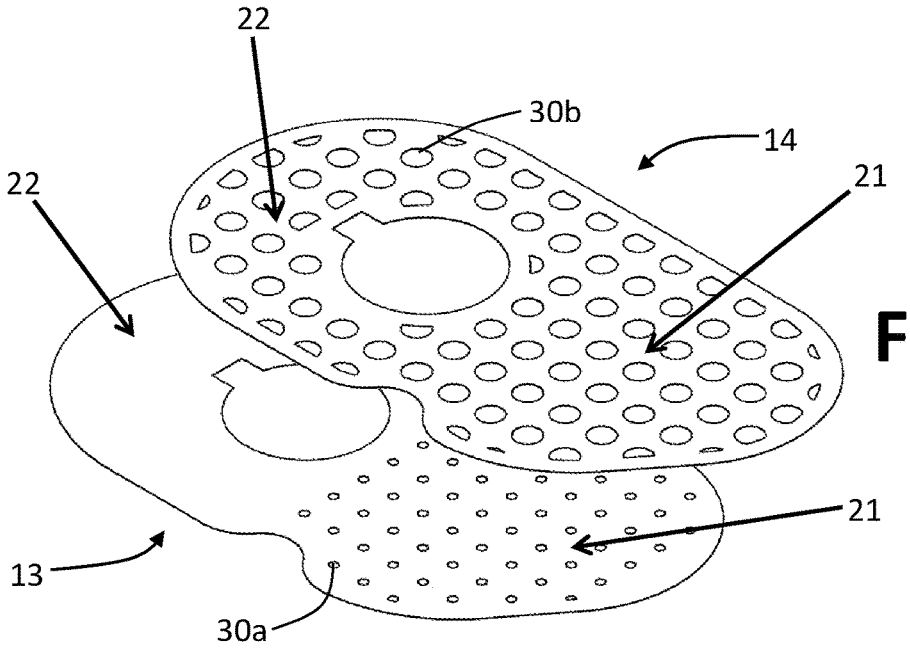

FIG. 49 highlights a case similar to that of FIG. 48, where, however, the array of sites 30*a* occupies just one region 21 of the electrode layer 13, another region 22 thereof being instead devoid of such sites, whereas both of the homologous regions 21 and 22 of the electrode layer 14 are occupied by an array of sites 30*b*. It will be appreciated that also in this case the emission of heat from the layer 13 will be as a whole higher than the emission of heat from the layer 14 and that the emission of heat will be higher in the regions 22 and less high in the regions 21.

In the embodiments described previously, the heating device 10 has been exemplified as a stand-alone component, designed for being mounted in a container or on a generic supplied device, such as a tank. It will be appreciated, however, that a heating device according to the invention may also be integrated in, or associated to, devices prearranged to perform functions different from heating or containment or conveying of a generic medium, such as functions of detection, for example, for detecting the level, and/or characteristics, and/or pressure of a substance, or else again functions of management of the aforesaid substance, such as dosing thereof.

In this perspective, in particularly advantageous embodiments, the heating device 10 forming the subject of the invention may be associated or coupled to a functional device used in combination with a container or tank, for example a device comprising a plurality of functional elements, such as a duct for a liquid and/or a pump, and/or sensors, and/or a further heater. Such a functional device may, for example, be a device for a fuel tank, or for managing an additive or a reducing agent used in an internal-combustion engine. Functional devices of this type, for example the ones known as UDM, are frequently mounted in a fluid-tight way at an opening of a tank containing a liquid reducing agent and in general comprise a pump and sensor means for detecting one or more characteristics of the liquid. As already highlighted, given that the liquid, in particular if it comprises water, is liable to freeze when the tank is exposed to low temperatures (indicatively temperatures lower than −11° C.), provision of a heating device according to the invention enables melting of the frozen liquid to be achieved.

Figure 50:
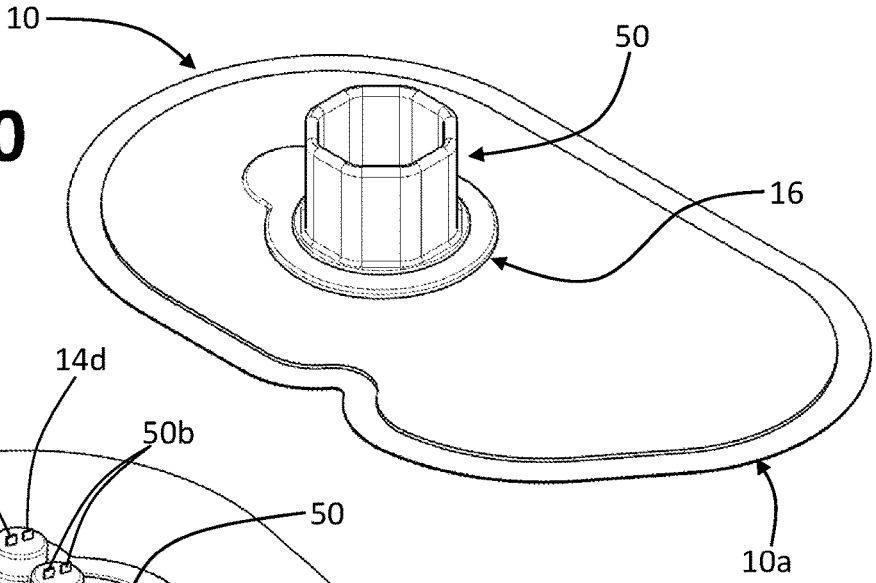
FIGS. 50 and 51 are schematic perspective views of an electrical heating device according to possible embodiments of the invention, combined with a different functional device.
Figure 51:
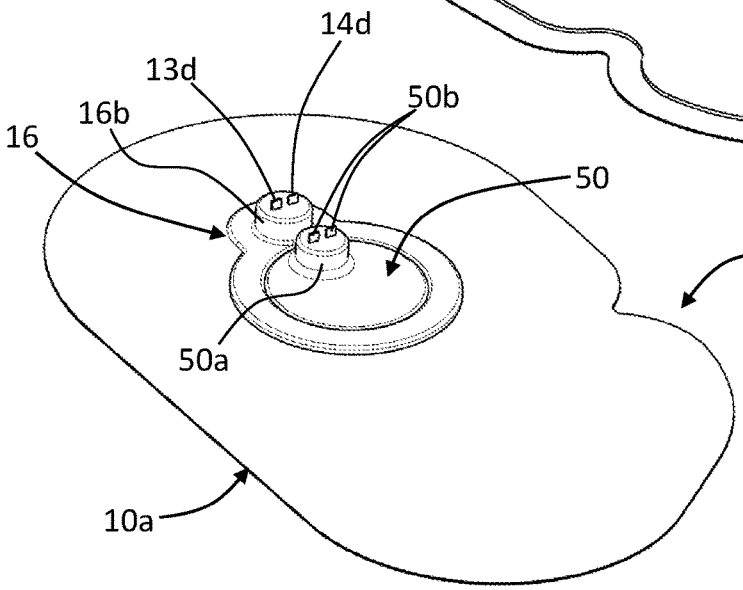
Figure 52:
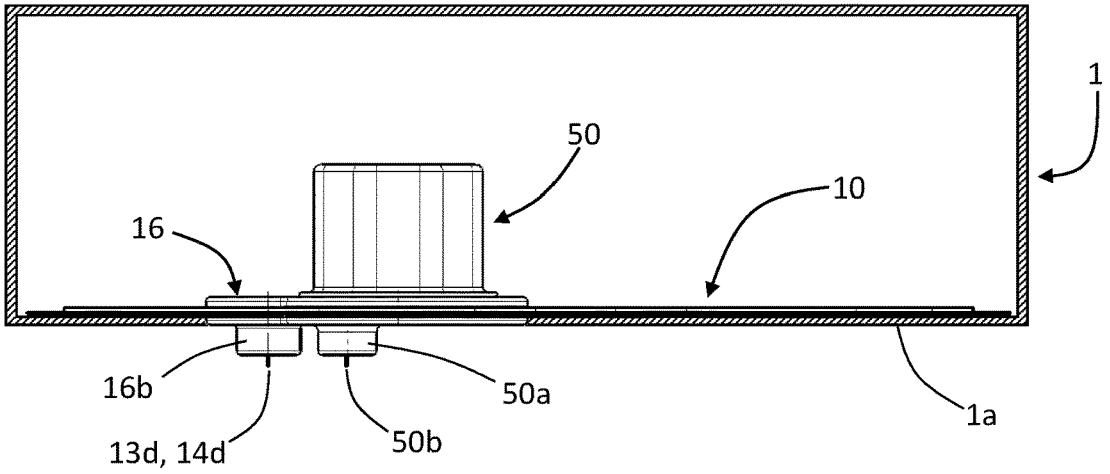
FIG. 52 is a schematic cross-sectional view of a generic container of a substance, equipped with the combined devices of FIGS. 50-51, represented in side elevation.

FIGS. 50-52 illustrate, in a merely schematic way, the case of combination of a heating device 10 according to the invention to another functional device, designated as a whole by 50, for example of the type responsible for detection of characteristics of a liquid, including its level. In the case exemplified, the device 50 is preferably mounted in a sealed way at an opening or seat of the device 10, such as the through opening (16*a*, FIG. 3) of the body 16 of the device 10, with the latter that is in turn mounted in a fluid-tight way at an opening of the bottom wall 1*a* of a tank 1 (the outlet of the tank 1, not visible in FIG. 52, may be set in a position different from what is represented in FIG. 1). As may be noted, the body of the device 50 has, in its lower part, a respective body portion that may project on the outside of the tank 1 and is provided with an electrical connector 50*a* with electrical-connection terminals 50*b* of its own.

Preferably, the electrical-connector body 16*b* of the heater 10 and the electrical-connector body 50*a* of the device 50 and/or the respective terminals 13*d*, 14*d*, and 50*b* are arranged in a position where they are close to one another and/or arranged in such a way as to facilitate electrical connection, preferably via a single connector or electrical wiring of the vehicle.

In various inventive embodiments, also the heating layer alone of a device according to the invention may be prearranged for bringing about differentiated heat emission in at least one region thereof. In various embodiments of this type, for example, the heating layer has at least one region set between the respective electrode layers that is provided with electrically non-conductive sites, for example in the form of holes or cavities. This solution may be implemented in addition or as an alternative to the presence of electrically non-conductive sites in one or both of the electrode layers, in order to bring about differentiated heat emission by the heating device.

Figure 53:
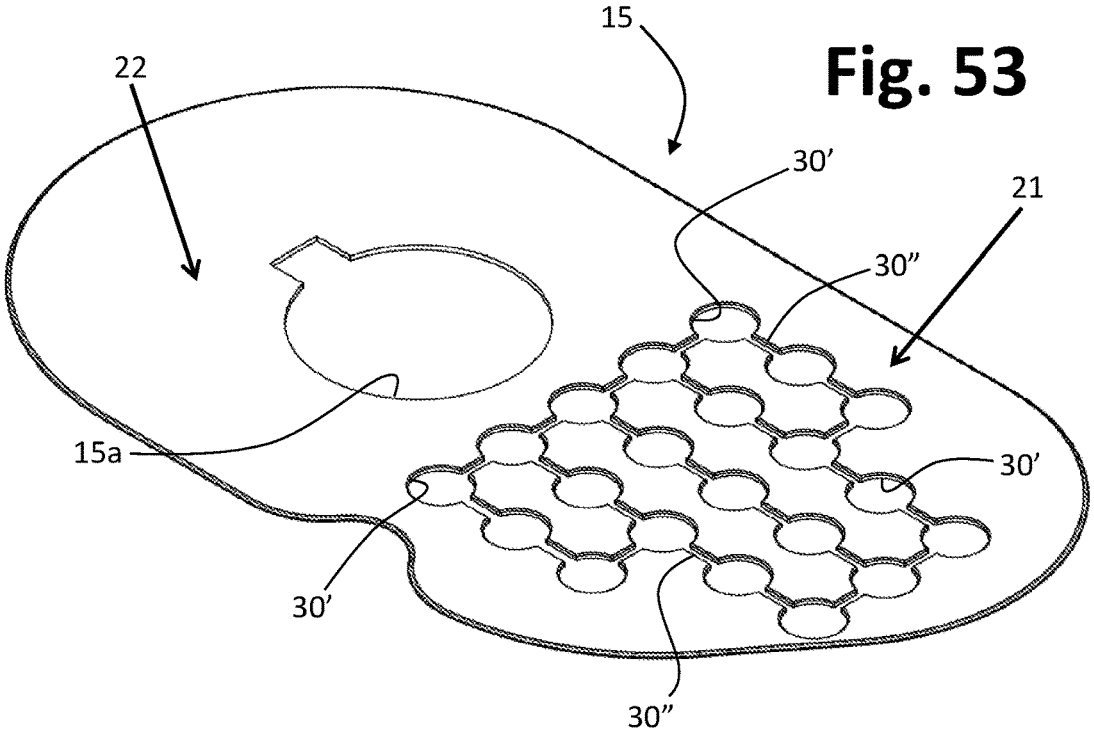
FIG. 53 is a schematic perspective view of a heating layer of a device according to possible embodiments of the invention.

An inventive implementation of this type is illustrated schematically in FIG. 53, which illustrates a heating layer 15 having a region 21 provided with electrically non-conductive sites, some of which are designated by 30', and a region 22 devoid of such sites. Also in the case of the non-limiting example illustrated, the electrically non-conductive sites 30' comprise through seats or through holes or through cavities 30' of the heating layer 15, here arranged according to a substantially orderly array. The non-conductive sites 30' preferentially have a circular cross section, even though other shapes are not excluded (for example, triangular or quadrangular or polygonal shapes or shapes with profiles comprising curved stretches and/or linear stretches, the sites possibly being in the form of through holes or holes closed at one end).

Figure 54:
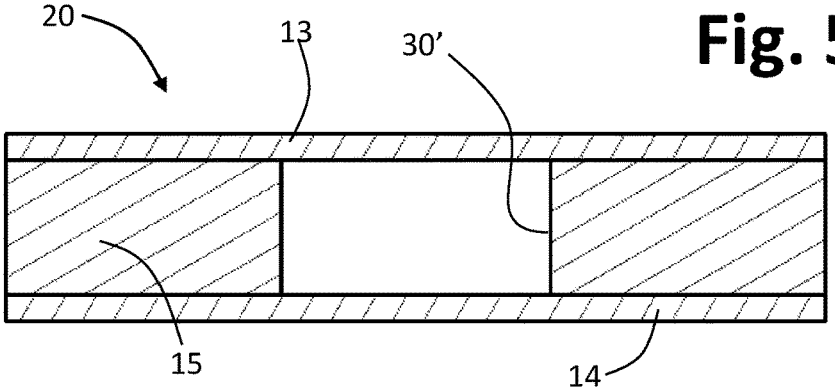
FIG. 54 is a partial and schematic cross-sectional view of a heating element that includes the heating layer of FIG. 53.

FIG. 54 illustrates, in partial cross-sectional view, a portion of a heating element 20 comprising electrode layers 13 and 14 with a heating layer 15 of the type illustrated in FIG. 53 set in between. As may be noted, in implementations of this type, each non-conductive site or hole 30' of the layer 15 has the two ends closed by means of the electrode layers 13 and 14, i.e., at each hole 30' the electrode layers 13 and 14 are not in contact with the material of the layer 15.

In various embodiments, when the sites 30' comprise through holes of the layer 15, at least some of the holes 30' are connected to at least one other hole 30', by means of voids or connection passages, some of which are designated by 30" in FIG. 53. Obviously, the electrode layers 11 and 12 will not be in contact with the material of the layer 15 even in the area of the passages 30", which themselves constitute electrically non-conductive sites.

The connection passages 30" may be provided in order to facilitate formation of the holes 30' in the production stage, for example in the course of an operation of injection moulding of the layer 15, or else when the holes themselves are blanked or dinked from a layer 15 formed previously. The presence of the passages 30" proves advantageous also in those embodiments in which the holes 30' and the passages themselves are provided for being occupied by a different material, for example a material that is electrically insulating, and possibly also thermally insulating, or else a second heating material, such as a second resistive or PTC-effect material, in particular of the type having a different heating temperature and/or heat-emission capacity as compared to a first heating or PTC-effect material, as described hereinafter.

It should, however, be noted that, in various embodiments, the holes that constitute electrically non-conductive sites of the layer 15 may be separate holes or holes not connected to one another, i.e., formed even in the absence of connection passages 30".

Figure 55:
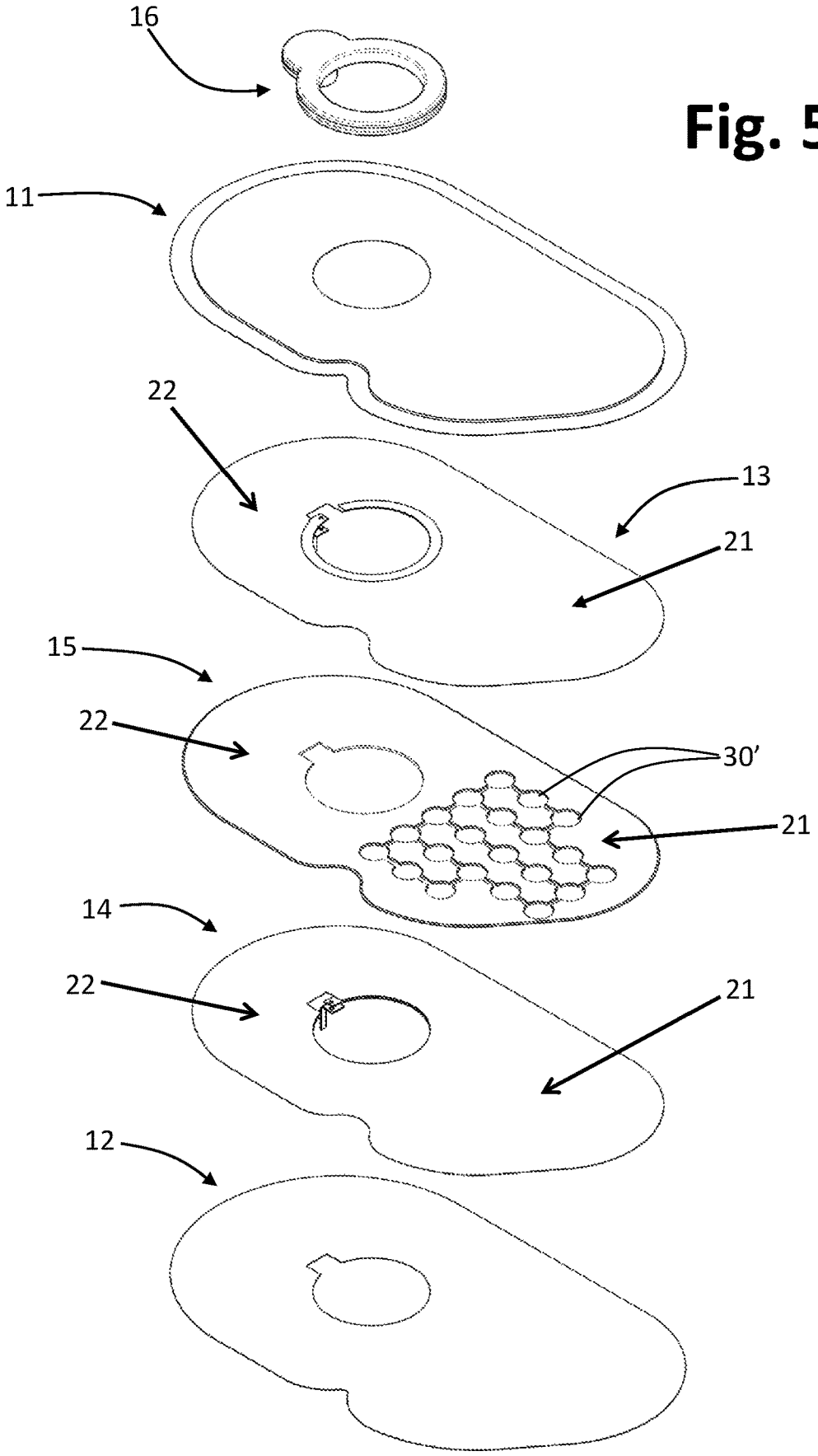
FIG. 55 is a partially exploded schematic view of an electrical heating device according to possible embodiments of the invention, which uses a layer of the type illustrated in FIG. 53.

FIG. 55 illustrates, in exploded view, a heating device according to the invention having a structure substantially similar to that of FIG. 4, where, however, the electrode layers 13 and 14 are devoid of electrically non-conductive sites and the heating layer 15 has an array of holes 30' and passages 30" in its region 21. As will be appreciated, on the basis of the same principles described previously, the presence of the holes 30' and of the passages 30" (i.e., the absence of PTC-effect material at these holes and passages) brings about in the region 21 of the heating layer 15 a heat emission (or heating power density or emittance) lower than in the region 22 of the layer 15 itself, and consequently a heat emission (or heating power density or emittance) in the regions 21 of the two electrode layers 13 and 14 lower than in the respective regions 22.

Of course, the electrode layer 13 and/or the electrode layer 14 of FIG. 55 could also be provided with electrically non-conductive sites, according to what has been explained previously.

Figure 56:
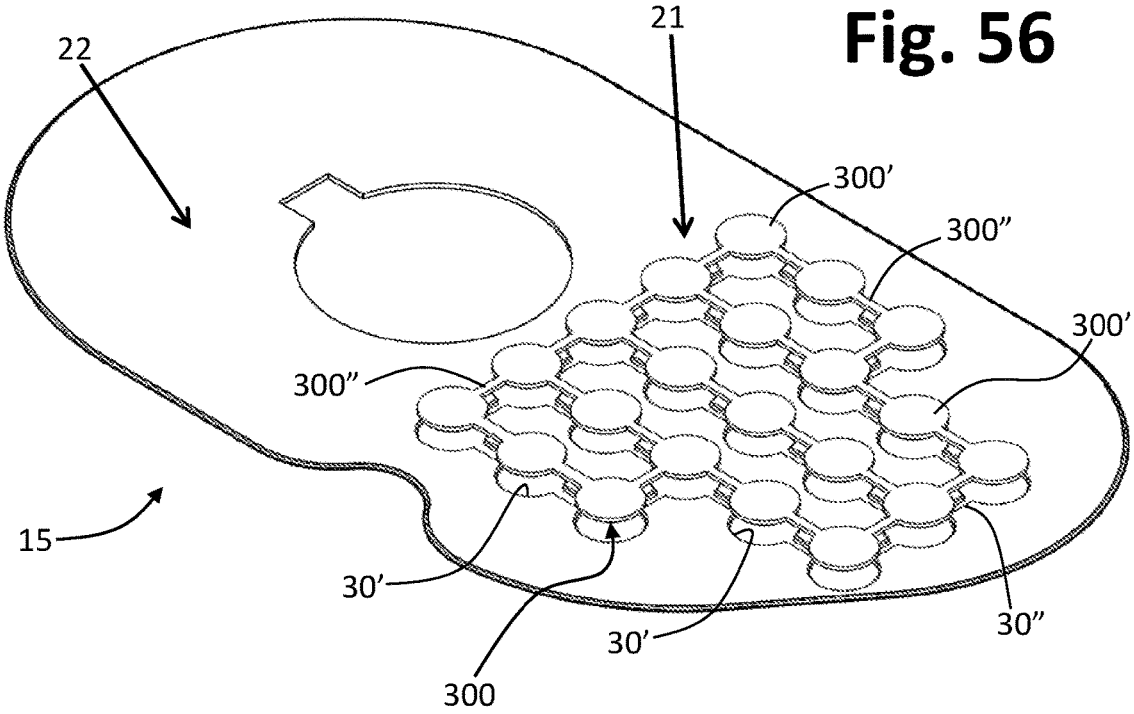
FIG. 56 is an exploded schematic view of a heating layer of a device according to possible embodiments of the invention.

FIG. 56 illustrates in exploded view a heating layer 15 of a conception similar to that of FIG. 53, but where the holes 30' and the connection passages 30" are designed to be occupied by a second material different from the material of the layer 15, such as a second electrically insulating and/or thermally insulating (or substantially electrically insulating and/or substantially thermally insulating) material, designated as a whole by 300. As will be seen, on the other hand, the material 300 could itself be a heating or PTC-effect material.

In the case exemplified, the second material 300 is shaped so as to provide a shape substantially complementary to that of the array of holes 30' and of the corresponding connection passages 30"; for example it comprises an array of elements or inserts 300'—here substantially disk-shaped—joined together by means of connection portions 300"—here substantially rectilinear.

The material 300 may be configured as a whole as a single body, as in the case exemplified in the figures, distinct or obtained separately with respect to the heating layer 15 and defining the inserts 300' and the portions 300", which is subsequently applied or fitted, preferably with slight interference, on the layer 15, so as to occupy the corresponding holes 30' and passages 30". In other embodiments, the material 300 may be applied directly on the layer 15, filling the holes 30' and the passages 30" of the layer 15 itself with the material 300: this filling may, for example, be obtained by overmoulding or co-moulding of the material 300 on or with the layer 15, or else by pouring the material 300 (for example, a resin) into the holes 30' and passages 30". For this purpose the passages 30" may advantageously serve to get the second material to flow and distribute between the various holes 30'. However, the passages 30" could also be totally or in part absent, as explained hereinafter.

Of course, it is also possible to mould first a single body made of the material 300 and, subsequently, overmould thereon or co-mould therewith the material designed to provide the remaining part of the heating layer 15 (i.e., the part defining the holes 30' and passages 30").

Figure 57:
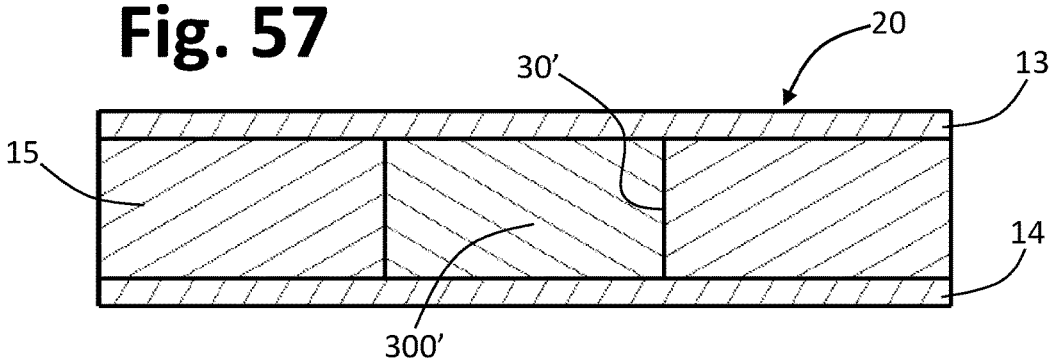
FIG. 57 is a partial and schematic cross-sectional view of a heating element that includes a heating layer of the type illustrated in FIG. 56.

FIG. 57 illustrates, in partial cross-sectional view, a portion of a heating element 20 comprising electrode layers 13 and 14, with a heating layer 15 provided with a single body made of the second material 300, according to an example that substantially amounts to what is illustrated in FIG. 56. As may be noted, in implementations of this type, each hole 30' of the layer 15 is occupied by a respective insert or second material 300, the two ends of which are in contact with the electrode layers 13 and 14. Preferably, the material 300 is a polymer-based material (i.e., a material comprising at least one polymer), for example a material compatible with a polymeric material of the layers 11 and 12 and/or with the material of the layer 15, in particular to enable mutual re-melting and surface welding thereof and/or to enable mutual chemical and/or mechanical bonding (for example, the material 300 and the material of the layers 11, 12 and/or of the layer 15 could have common components, for example PE, or HDPE, and/or POM).

In the case of a heating layer 15, the sites 30' of which are constituted by distinct holes (i.e., without the connection passages 30"), the inserts 300' may be configured as bodies distinct from one another, or else the corresponding material may be moulded or poured into the individual holes 30' of the layer 15. The embodiment illustrated in FIG. 56, with holes 30' and passages 30", as well as inserts 300' and connection portions 300", must, however, be deemed preferable. In the case of moulding or pouring of the material 300, in fact, there is allowed the presence of just one point of injection or pouring of the material 300, or of a few injection or pouring points, with the passages 300" that then enable the material in the fluid state to flow into all the holes 30' and fill them. On the other hand, a single body, made of the material 300 separately from the layer 15, that defines the inserts 300' joined together by means of the portions 300", is easier to handle in the production stage, for example when such a single body is moulded apart and/or stored and/or applied on the layer 15 provided with holes 30' and passages 30", or when the layer 15 is overmoulded on the aforesaid single body.

As may be appreciated, operation of a heating device integrating a heating layer 15 of the type illustrated in FIGS. 56-57 is similar to what has been described with reference to FIGS. 53-55.

Figure 58:
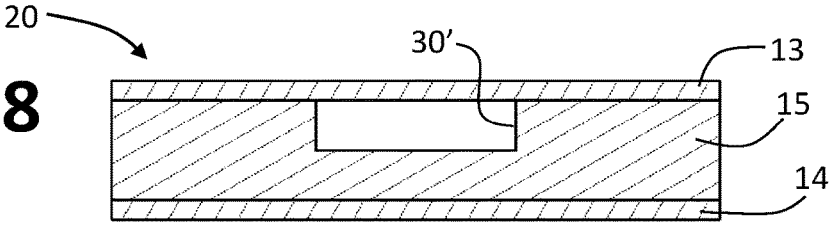
FIGS. 58 and 59 are partial and schematic cross-sectional views of heating elements that include a heating layer according to possible variant embodiments of the invention.

In the embodiments exemplified, with a relatively thin heating layer 15, the holes 30' and possible passages 30' are preferentially holes and passages formed through the layer 15. In other embodiments, when the heating layer 15 has a sufficient thickness, the holes 30' and possible passages 30' may, instead, be configured as blind cavities, i.e., provided with a bottom. Embodiments of this type are exemplified also in the partial cross-sectional views of FIGS. 58 and 59, which regard heating elements 20 similar to the ones of FIGS. 54 and 57, respectively, but where the sites 30' are constituted by blind holes, i.e., by cavities having a respective bottom.

It will be appreciated that the solution of providing electrically non-conductive sites in the form of blind cavities or cavities with a bottom may be implemented also in relation to the electrode layers 13 and/or 14, when these layers have a thickness sufficient for the purpose.

According to a different inventive aspect, the heating layer provided in a device according to the invention is prearranged for differentiated heat emission obtained with the use of at least two different materials having a PTC effect, or else two different thermistor materials, distinguished by heating temperatures and/or heat-emission capacity that are different from one another. In solutions of this type, in a heating layer formed prevalently with a first PTC-effect material there made be provided one or more areas or islands made of a second PTC-effect material, distinguished by a heat-emission capacity higher or lower than that of the first material.

Figure 59:
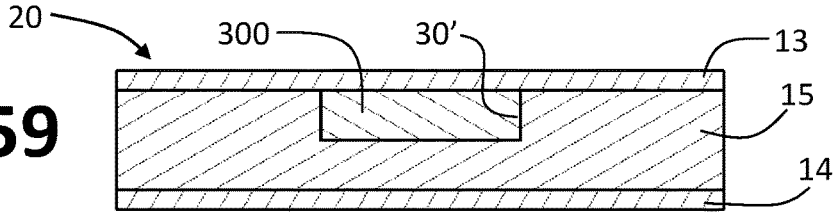

For instance, and as previously designated by reference to FIGS. 56, 57, and 59, the material 300 designed to fill the holes 30' and the possible passages 30" of the layer 15 does not necessarily have to be an electrically insulating material, itself possibly being a PTC-effect material, such as a second PTC-effect material having a heating temperature and/or a heating power different (higher or lower) from that of another first PTC-effect material that forms the layer 15. For instance, the material 300 may be a PTC material having a base structure similar to that of the heating layer 15 (for example, both materials comprising a mixture of polymers), but distinguished by a different coefficient of thermal expansion and/or by the possible presence of a thermally conductive filler, which is instead absent or different in the material of the layer 15, thus being able to emit or dissipate more heat when electrically supplied.

A similar effect may be obtained by providing in a PTC-effect material 300 an electrically conductive filler in a different proportion (for example, a lower proportion) with respect to the material of the layer 15, so as to vary or increase its electrical resistance. Yet another possibility is to use a PTC-effect material 300 similar to that of the layer 15 (for example, both materials being HDPE+POM), but distinguished by a higher amount of filler constituted by electrically conductive particles so as to reduce its electrical resistance and thus develop less heat. As has been said, the PTC materials used may differ from one another also for the specific composition of the material of the matrix or of its electrically conductive filler, for example in the sense that the polymer or polymers of a first PTC material may differ from the polymer or polymers of a second PTC material. Similar considerations apply to the materials constituting the possible electrically conductive and/or thermally conductive fillers.

What has been described previously with reference to FIGS. 53-59 in relation to the material 300 and to its inclusion in the layer 15 also applies in the case where the material is itself a resistive material or a material having a PTC effect.

From the foregoing description, the characteristics of the present invention emerge clearly, as likewise its advantages. The electrical heating device according to the invention is as a whole simple and inexpensive to produce, and reliable in operation, as well as being able to heat relatively extensive areas, but with limited power consumption, by virtue of the possibility of differentiating heat emission from the device, i.e., of defining one or more regions with high heat emission and one or more other regions with low heat emission. The invention enables a heating device to be obtained having at least two areas with different distribution of the heating power and/or with different electric-power consumption and/or with different temperature, without the use of electronic control circuits and without having to associate the areas to different electrical connections.

The protective casing of a heating element of a device according to the invention, when envisaged, is itself simple to produce and reliable, at the same time guaranteeing an increased adhesion, and/or fixing, and/or bonding thereof to the corresponding heating element. The characteristics of adhesion, and/or fixing, and/or bonding of the casing to the corresponding heating element, and in particular adhesion, and/or fixing, and/or bonding of the casing to the heating material, at least in part set between the electrodes, make it possible to improve and guarantee in time contact between the casing and the heater, and/or prevent corresponding detachment, and/or prevent formation of albeit minimal air gaps or voids between the casing and the heater. It is thus possible in this way to prevent an increase in the thermal resistance and/or a reduction in the propagation of heat from the heater to the casing, and hence to the fluid to be heated. Preferably, the protective casing described enables total elimination or in any case reduction of the risk of stagnation of air that might possibly have negative effects.

The protective casing described makes it possible, wherever necessary, to provide a heating device that is more protected from the medium that is to be heated, such as chemically aggressive or corrosive liquids; i.e., it makes it possible to provide a heating device that can be appropriately insulated from the medium to be heated, in particular in order to prevent any contamination of the medium itself by the materials of the heating device.

The intrinsic elasticity of the casing according to various embodiments, and of the heating device as a whole, contributes to reducing the risks of failure due to the thermal cycles of the heating device and to the consequent expansion/contraction of the materials involved.

It is clear that numerous variations may be made by the person skilled in the branch to the electrical heating device described by way of example, without thereby departing from the scope of the invention as defined in the ensuing claims.

In the preferential versions, the electrically non-conductive sites provided in one or both of the electrode layers are constituted by holes prearranged in a specific way for the purposes of the invention. However, in variant embodiments, the aforesaid sites could be obtained in some other way, in particular by providing the specific areas of one or each electrode layer with pads or spots of electrically insulating or substantially insulating material, on the face of the electrode layer that is to be set on top of the heating layer. In this perspective, the phrase "electrically non-conductive sites", which is present in various points of this description and in the attached claims, is hence to be understood as comprising also substantially electrically insulated or insulating sites, as well as sites with high electrical resistance, i.e., distinguished by an electrical resistance significantly higher than the electrical resistance of the electrode layers 13 and 14 and/or of the heating layer 15 (or, conversely, distinguished by an electrical conductivity lower than the electrical conductivity of the electrode layers 13 and 14 and/or of the heating layer 15). In this perspective, also the phrase "substantially electrically insulating" and the like (used also previously, for example in relation to the material 300) is meant to include the case of materials with high electrical resistance (or low electrical conductivity) as compared to the material of the electrode layers and of the heating layer.

According to the above variants, and with reference, for example, to FIG. 10, the holes designated by 30*a*, 30*b* and 30*c* could be replaced by elements or pads of electrically insulating or substantially electrically insulating material, for example a polymeric material, deposited or mounted on the face of the electrode 13 that is to be set on top of the heating layer, with these elements or pads having, for example a surface or perimetral profile similar to that of the holes 30*a*, 30*b*, and 30*c*. Possibly, the material used may also be thermally insulating. A solution of this type may be used, in principle, in all the embodiments illustrated previously. Deposition or application of the electrically insulating or substantially electrically insulating spots or pads on the corresponding electrode layer, for example in the form of laminas, fabric, or meshwork, may be made using any known technique suitable for the purpose, for example silk-screen printing, overmoulding, spraying, fixing of preformed electrically insulating elements, etc. The solution considered may also be applied when—as has been mentioned previously—one or both of the electrode layers is/are provided with blind cavities, in which case the (substantially) electrically and/or thermally insulating material may be applied so as to fill or coat the blind cavities at least in part.

The same concept may be implemented also in the case of electrode layers obtained via deposition or fixing of material directly on the heating layer, in which case there will be envisaged deposition of a first electrically insulating or substantially electrically insulating material for formation of the electrically non-conductive sites, and deposition of a second electrically conductive material for formation of the electrode layers. In the same way, the electrically non-conductive sites may be defined in electrode layers made of fabric, using for the warp and weft either electrically conductive wires or strips or electrically insulating or substantially electrically insulating wires or strips, or else wires or strips or fabrics that are electrically conductive but coated locally with electrically insulating or substantially electrically insulating material. It will be appreciated that, by appropriately weaving such wires or strips, it is possible to define in the final fabric both electrically conductive areas and electrically insulating (and possibly also thermally insulating) areas.

FIG. 60 illustrates a variant embodiment in which the device 10 is not provided with a through opening, as in embodiments described previously, but its casing 10*a* is instead shaped so as to define a lateral seat 16*a*'. In the example represented, the casing 10*a* is made of a polymeric material overmoulded on a heating element including layers 13-15 and the corresponding electrical-contact elements, which will have in this case profiles different from those of the previous embodiments. In particular, with reference to the example illustrated, the through openings 13*a*, 14*a* and 15*a* of the previous embodiments will be replaced by peripheral recesses of the layers 13-15 (here recesses with arched profile), with the electrical-contact elements that comprise axial terminals connected to the respective electrode layers. In embodiments of this type, the sealing body 16 of the embodiments described previously may be defined directly by a portion 16' of the overmoulded coating: in the example illustrated, the portion 16' is substantially arched, shaped so as to define the lateral seat 16*a*', and preferably also an electrical-connection body or connector body.

FIGS. 61 and 62 illustrate, in different views, the condition of coupling of the heating device 10 of FIG. 60 with a functional device 50 similar to that of FIGS. 50-52, but here also equipped with a level sensor 50*c* (FIG. 61). As may be appreciated, the body of the device 50 is coupled to the device 10 at the peripheral seat 16*a*' of FIG. 60, defined by the portion 16' of the overmoulded casing 10*a*. As may be noted from FIG. 62, the portion 16*b* of the casing of the device 10 is here shaped to define also at least part of an electrical-connector body, which surrounds corresponding connection terminals.

Figure 63:
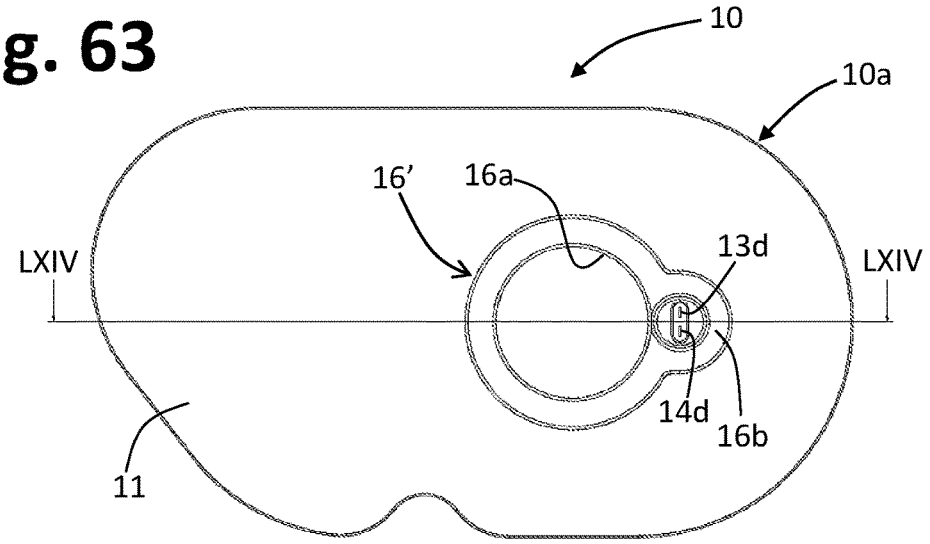
FIG. 63 is a schematic top plan view of an electrical heating device according to possible embodiments of the invention.
Figure 64:
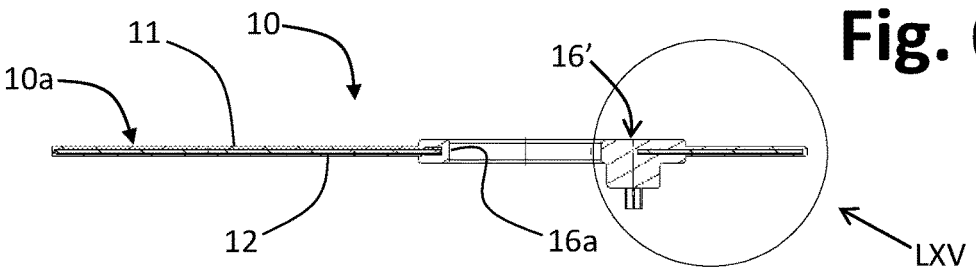
FIG. 64 is a schematic cross-sectional view according to the line LXIV-LXIV of FIG. 63.
Figure 65:
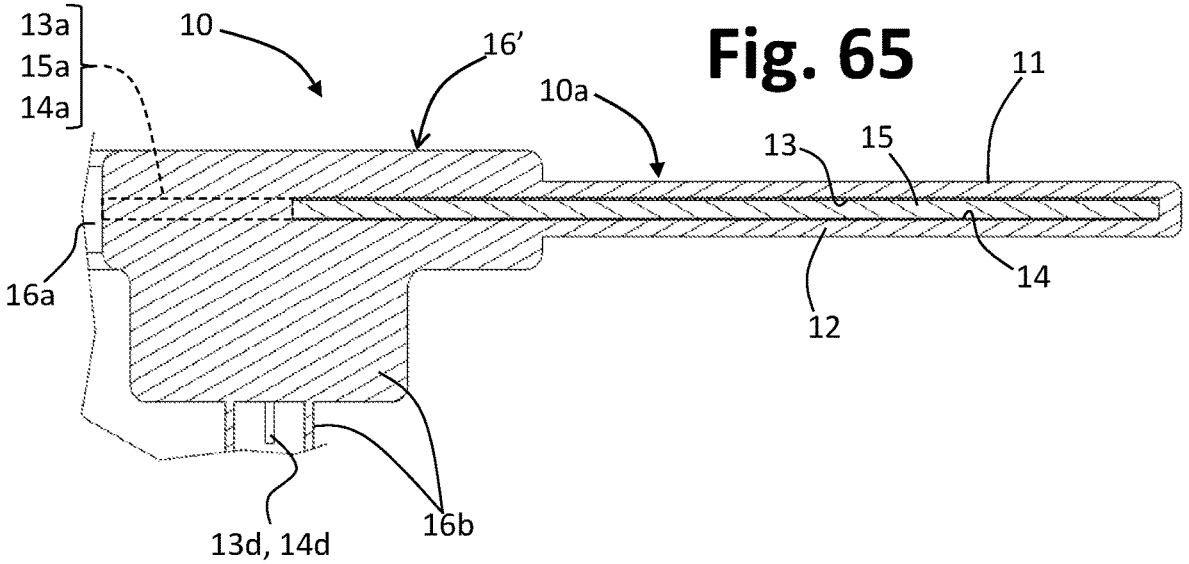
FIG. 65 illustrates the detail LXV of FIG. 63 at a larger scale.

FIGS. 63-65 illustrate schematically a heating device 10 according to the invention, the casing 10*a* of which is formed via overmoulding, i.e., by coating a heating element (for example, of the type designated by 20 in FIGS. 6-7) with a suitable electrically insulating polymeric material. In embodiments of this type, the functions of the sealing body designated by 16 with reference to the embodiments represented in FIGS. 1-59 may be provided directly by a part of the overmoulded casing, such as the part designated by 16' in FIGS. 63-65, which defines a respective through opening

16*a* in a position corresponding to through openings 13*a*, 14*a*, and 15*a* of the layers 13, 14 and 15, respectively.

It will be appreciated that, also in the case of the overmoulded casing 10*a*, one or both of the overmoulded walls that form the casing layers 11 and 12 may be locally in contact with the material of the heating layer 15, for example at the through holes (electrically non-conductive sites) of a corresponding electrode layer 13 and/or 14, and/or at the openings between the meshes of a meshed electrode layer, as already mentioned previously, to improve thereby fixing and adhesion of the casing 10*a* to the heating element 20. Preferentially, the material of the overmoulded casing 10*a* is in any case in contact with the material of the layer 15 at least at the peripheral edge of the latter. What has been described previously in relation to the use of compatible polymers for providing the layer 15 and the layers 11 and 12 applies, of course, also to the case of an overmoulded casing 10*a*. The aforesaid characteristics and/or technologies for producing the casing could be combined together in different ways, for example by providing a casing 10*a* in part obtained using a film or laminate and in part overmoulded, or else a casing 10*a* in part moulded separately and in part overmoulded.

Figure 66:
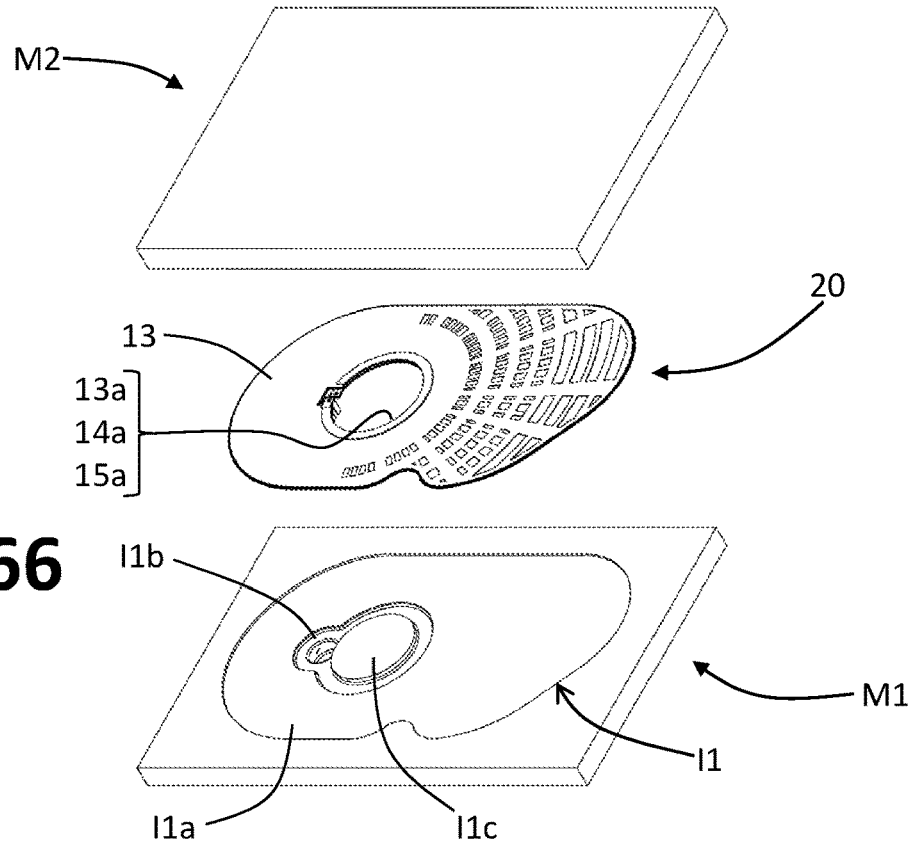
FIGS. 66 and 67 are schematic representations of equipment that can be used for moulding a casing of the electrical heating device of FIG. 63.
Figure 67:
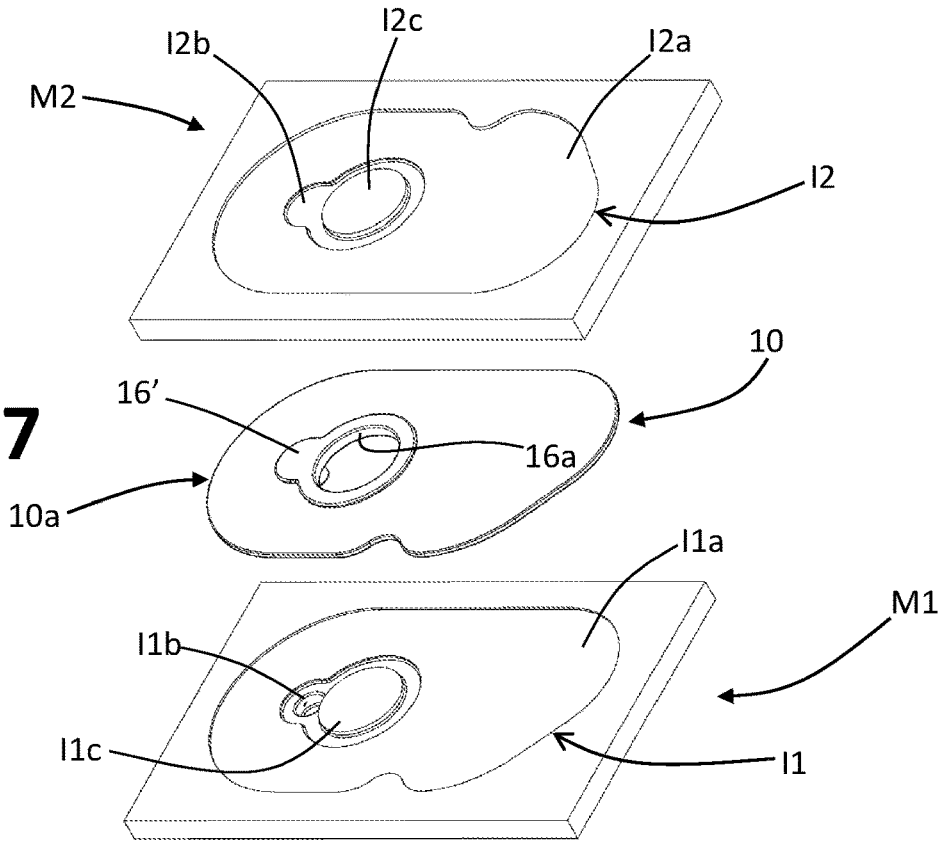

FIGS. 66 and 67 illustrate, merely by way of example, possible equipment that can be used for moulding a casing 10*a* on a heating element 20. In the example, the equipment basically consists of two mould parts M1 and M2, which have respective impressions I1 and I2, shaped for receiving within them the heating element 20 and defining the outer shape of the casing 10*a* (it should be noted that in FIG. 67 the mould part M2 is represented turned upside down, in order to highlight the corresponding impression I2). As may be noted, the impressions I1 and I2 have respective parts I1*a*-I2*a* for defining the general shape of the casing 10*a* (i.e., of the layers or walls 11 and 12), as well as parts I1*b*-I2*b* for defining the portion 16' of the casing 10*a* with the corresponding connector body 16*b* (see FIG. 62), and parts I1*c*-I2*c* for defining a through opening 16*a* in an area corresponding to the portion 16'.

Figure 68:
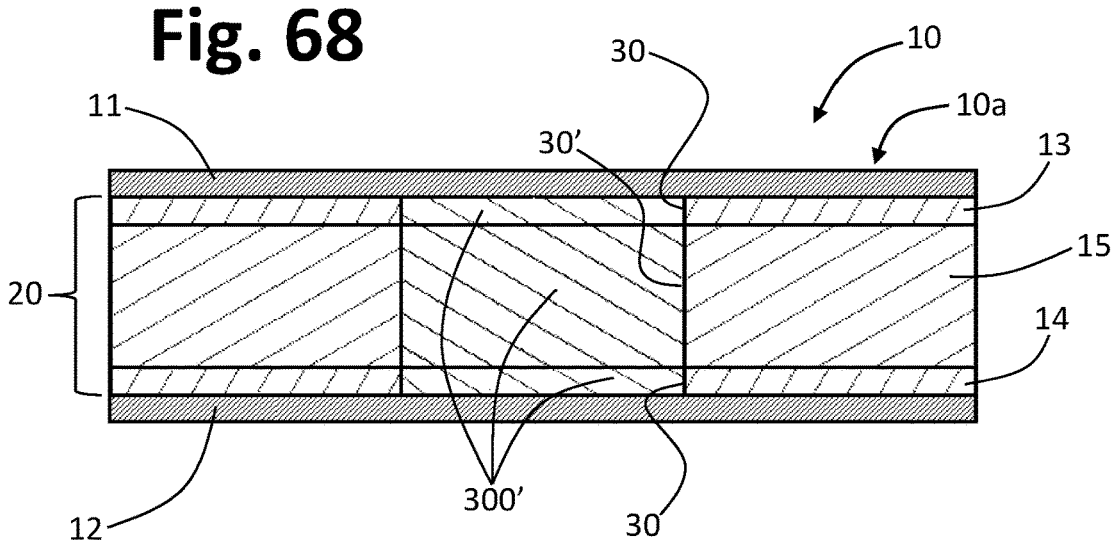
FIGS. 68, 69, and 70 are partial and schematic cross-sectional views of heating devices according to possible variant embodiments of the invention.
Figure 69:
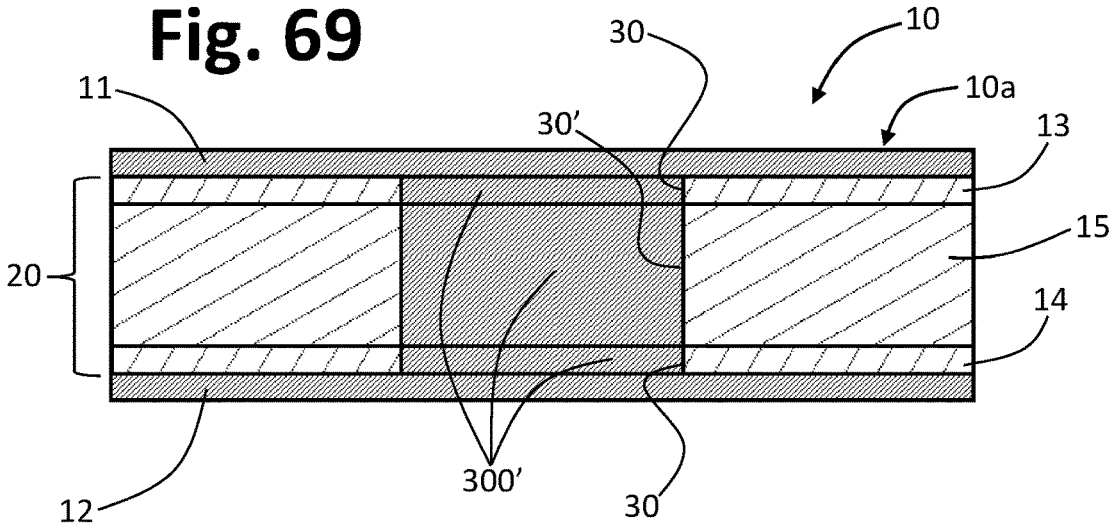
Figure 70:
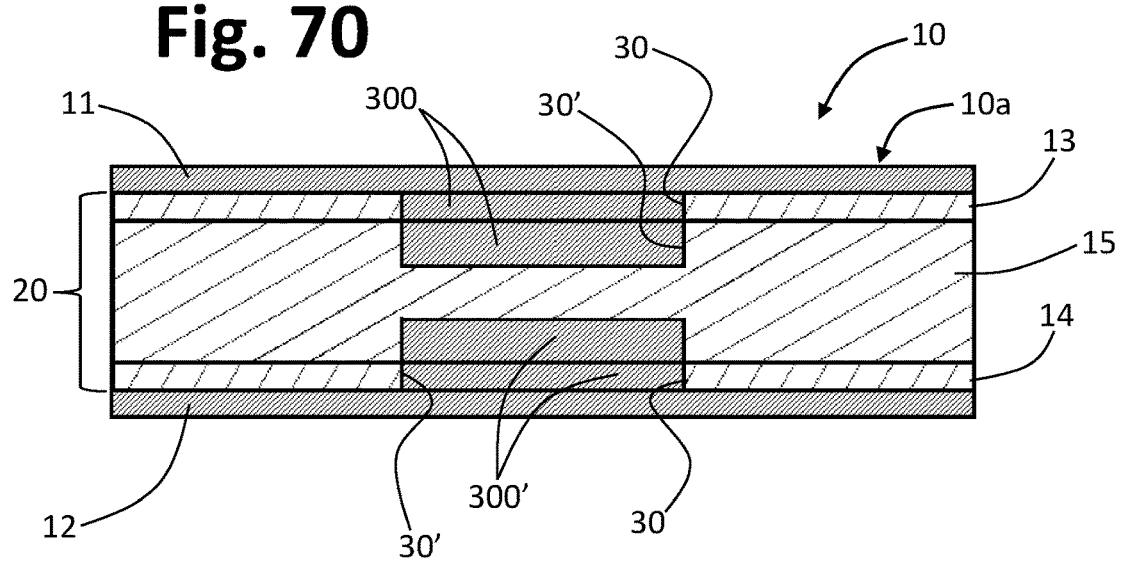

As has been said, the material 300 used for filling the holes 30' of the layer 15 (see FIGS. 56, 57 and 59) is preferentially a polymer-based material (i.e., a material comprising at least one polymer) compatible with a polymeric material (i.e., a material comprising at least one polymer) of the layers 11 and 12, and/or with the material of the layer 15, in particular to enable mutual re-melting and surface welding, and/or to enable a mutual chemical and/or mechanical bonding. In this perspective, in various embodiments, the electrode layers 13 and 14 have one or more holes 30 that are substantially coaxial to one another and to respective holes 30' of the layer 15, or at least in part face one another and the respective holes 30'. As exemplified in FIG. 68, in embodiments of this type, both the holes 30 of the layers 13 and 14 and the holes 30' of the layer 15 may be filled with the material 300, for example via overmoulding, so that the material of the casing layers 11 and/or 12 can adhere locally also to the material 300. As may be appreciated, in this way, the material 300 forms in practice "columns", at the two ends of which the casing layers 11 and 12 locally adhere, with an improved fixing of the casing 10*a* as a whole on the heating element. In the case of the overmoulded casing 10*a*, as exemplified in FIG. 69, the material 300 that fills the holes 30 of the layers 13 and 14 and the holes 30' of the layer 15 may advantageously be the same overmoulding material that forms the layers 11 and 12 in order to obtain a further improved fixing between the casing and the heating element 20. The concepts just set forth evidently apply also in the case where the holes 30' are of the type illustrated in FIG. 58 or FIG. 59, i.e., in the form of blind holes or cavities. For instance, FIG. 70 illustrates the case of a layer 15 with two substantially facing blind cavities 30' that each open at a respective major face of the layer 15, where the aforesaid cavities are filled with the material 300, which may be a material different from, but compatible with, that of the casing layers 11 and 12, or else the same material as that of the layers 11 and 12, as exemplified in FIG. 70. Of course, with reference to FIG. 70, the blind cavities 30' could also be provided at just one major face of the layer 15, or else be provided at both of the faces but in axially staggered positions.

In embodiments alternative to the ones so far described, the heating layer 15 could be made of a material other than a polymer-based material, such as a ceramic-based material having a PTC effect. The use of a polymer-based PTC material for the layer 15 is to be deemed preferential, in so far as its capacity for being modelled and/or adapted and/or bent slightly is higher than in the case of a ceramic-based material. This enables, for example, the device to adapt, to a certain extent, during assembly or use, to the possible tolerances or dimensional variations of a tank for vehicles, which is typically made of polymer and is subject to deformations during moulding and/or during use in the various environmental conditions and/or during heating of the fluid. Also handling of the device 10 and its assembly and installation in the final working position proves less critical. The use of a polymer-based PTC material proves even more advantageous from the production standpoint, rendering modelling of the layer 15 and/or its possible overmoulding on the electrode layers 13 and 14 more convenient.

The heating layer 15 may itself present a multilayer structure, i.e., be formed by a plurality of layers of material set on top of one another, such as a number of heating layers (even made of different materials) fixed or bonded to one another, for example via welding, or hot lamination, or co-moulding, or overmoulding, with the various layers that form in any case a single heating layer 15 in contact with the two electrode layers 13 and 14.

At least one part of the polymer-based material of at least one of the casing layers 11 and 12 may be joined, or welded, or bonded to at least one part to the material of at least one of the electrode layers 13 and 14, according to what has already been described, in particular when at least one electrode layer is made of an electrically conductive material having a polymeric base compatible with a polymer of the at least one casing layer. Likewise, at least one part of the electrically conductive polymer-based material of at least one electrode layer may be joined, or welded, or bonded to at least one part of a polymeric material compatible therewith that belongs to the heating layer 15.

According to possible further variant embodiments, the heating device forming the subject of the invention may have a shape different from the one exemplified in the attached figures. In particular, what has been described with reference to adhesion, or joining, or welding, or bonding between at least one of the casing layers or walls 11 and 12 and at least one of the opposite major faces of the heating layer 15 may also refer to a device having a different shape and/or a different arrangement of the electrode layers, for example with a first electrode layer and a second electrode layer arranged in the proximity or at minor opposite faces of a heating layer.

The invention claimed is:

1. An electrical heating device comprising a first electrode layer, made of electrically conductive material, a second electrode layer, made of electrically conductive material, and a heating layer, wherein the first electrode layer and the second electrode layer face one another, with at least one part of the heating layer that is set between the first electrode layer and the second electrode layer, in contact therewith, wherein at least one first region of at least one from among the first electrode layer, or the second electrode layer, or said at least one part of the heating layer, has a plurality of first electrically non-conductive sites, wherein at least on second region of at least one from among the first electrode layer, or the second electrode layer, or said at least one part of the heating layer;

is substantially devoid of electrically non-conductive sites, or has a density of second electrically non-conductive sites lower than a density of the first electrically non-conductive sites in the at least one first region, or has second electrically non-conductive sites smaller that the first electrically non-conductive sites in the at least one first region, or has a ration between a total area of the second electrically non-conductive sites and an overall area of the at least one second region which is lower than a ratio between the total area of the first electrically non-conductive sites and an overall area of the at least one first region, wherein the heating layer is made of a material having a positive temperature coefficient (PTC) effect, and wherein the first electrically non-conductive sites in the at least one first region are arranged for causing:

an emission of heat by the heating device in the at least one first region that is lower than an emission of heat by the heating device in the at least one second region of the at least one from among the first electrode layer, or the second electrode layer, or said at least one part of the heating layer; and/or an emission of heat by the heating device at the at least one first region in the first electrode layer that is lower than an emission of heat by the heating device at the at least one second region in the second electrode layer.

2. The device according to claim 1, wherein the electrically non-conductive sites comprise at least one from among:

through holes or cavities, blind holes or cavities, elements or inserts made of electrically insulating or substantially electrically insulating material, which are prearranged for reducing the emission of heat by the heating device at said electrically non-conductive sites.

3. The device according to claim 1, wherein the at least one from among the first electrode layer, or the second electrode layer, or said at least one part of the heating layer comprises the at least one first region and the at least one second region, the at least one first region having a density of electrically non-conductive sites that is greater than the density of electrically non-conductive sites of the at least one second region.

4. The device according to claim 1, wherein the first electrode layer and the second electrode layer have a different density of electrically non-conductive sites.

5. The device according to claim 1, wherein:

at least one of the first electrode layer and the second electrode layer has a plurality of electrically non-conductive sites that have a shape and/or size different from one another; and/or the first electrode layer has a plurality of electrically non-conductive sites, which have a shape, and/or size, and/or arrangement, and/or density different from those of a plurality of electrically non-conductive sites of the second electrode layer.

6. The device according to claim 1, wherein the at least one first region and the at least one second region are in the first electrode layer, the plurality of second electrically non-conductive sites in the at least one second region have perimetral dimensions smaller than perimetral dimensions of the plurality of first electrically non-conductive sites of the at least one first region.

7. The device according to claim 1, wherein the first electrode layer has a plurality of first electrically non-conductive sites and the second electrode layer is substantially devoid of electrically non-conductive sites, or else comprises one or more second electrically non-conductive sites prearranged in such a way that an area of contact between the heating layer and the first electrode layer is smaller than an area of contact between the heating layer and the second electrode layer, the emission of heat by the heating device at the first electrode layer thereby being lower than the emission of heat by the heating device at the second electrode layer.

8. The device according claim 1, wherein the first electrode layer and the second electrode layer have areas of contact with the heating layer that are substantially similar, and wherein a ratio between a total area of the first electrically non-conductive sites of the first electrode layer and an area of contact of the first electrode layer with the heating layer is different from a ratio between a total area of the second electrically non-conductive sites of the second electrode layer and an area of contact of the second electrode layer with the heating layer.

9. The device according to claim 7, wherein the first electrode layer has a plurality of first electrically non-conductive sites that differ from the plurality of second electrically non-conductive sites of the second electrode layer in terms of shape, and/or size, and/or arrangement, and/or density of the corresponding electrically non-conductive sites.

10. The device according to claim 1, wherein said at least one part of the heating layer has a plurality of regions that are in contact with the first electrode layer and the second electrode layer, and that are prearranged for diversified emission of heat, the plurality of regions comprising the at least one first region and at least one second region, wherein the at least one first region of the at least one part of the heating layer has a plurality of first electrically non-conductive sites prearranged for defining in the at least one first region an area of contact between the at least one part of the heating layer and the first electrode layer, which is smaller than an area of contact between the at least one part of the heating layer and the second electrode layer in the at least one second region of the second electrode layer, in such a way that the emission of heat by the heating device in the at least one first region of the at least one part of the heating layer is lower than the emission of heat by the heating device in the at least one second region of the at least one part of the heating layer.

11. The device according to claim 2, wherein the through holes or cavities or the blind holes or cavities contain a material that is electrically insulating or substantially electrically insulating and/or thermally insulating or substantially thermally insulating.

12. The device according to claim 1, moreover having a casing that comprises:

a first casing layer or wall and a second casing layer or wall which are sealingly joined together along the edges thereof.

13. The device according to claim 1, wherein at least one of the first electrode layer and the second electrode layer comprises at least one from among a lamina of electrically conductive material, a mesh or grid of electrically conductive material, a fabric including electrically conductive material, and an electrically conductive material deposited on the heating layer.

14. The device according to claim 13, wherein the heating layer defines one or more edges that have a substantially inclined or tapered profile, and the heater has a casing that defines one or more corresponding edges that have a substantially inclined or tapered profile.

15. The device according to claim 12, wherein the first electrode layer, the second electrode layer, the heating layer, and the casing are coupled together so as to define a structure of the electrical heater that is substantially planar and at least in part flexible.

16. An electrical heating device comprising a first electrode layer, made of electrically conductive material, a second electrode layer, made of electrically conductive material, and a heating layer, wherein the first electrode layer and the second electrode layer face one another, with at least one part of the heating layer that is set between the first electrode layer and the second electrode layer, in contact therewith, wherein the heating layer comprises at least one co-continuous polymeric composite having a positive temperature coefficient (PTC) effect, the co-continuous polymeric composite having a matrix that comprises at least two immiscible polymers and at least one electrically conductive filler in the matrix, wherein at least one of the at least two immiscible polymers is high-density polyethylene and at least another one of the at least two immiscible polymers is polyoxymethylene, and wherein at least one from among the first electrode layer, the second electrode layer, and the heating layer has a plurality of electrically non-conductive sites configured as through holes or as blind cavities, arranged for causing an emission of heat by the heating device at the first electrode layer that is lower than the emission of heat by the heating device at the second electrode layer.

17. The device according to claim 16, moreover having a casing that comprises a first casing layer or wall and a second casing layer or wall, which are made at least in part of a polymer-based material, and wherein said at least one part of the polymer-based material of the first casing layer or wall and the second casing layer or wall comprises at least one from among high-density polyethylene, polyoxymethylene, polyethylene.

18. An electrical heating device comprising a first electrode layer, made of electrically conductive material, a second electrode layer, made of electrically conductive material, and a heating layer, wherein the first electrode layer and the second electrode layer face one another, with at least one part of the heating layer that is set between the first electrode layer and the second electrode layer in contact therewith, wherein the heating layer has at least one first region and at least one second region prearranged for differentiated emission of heat obtained with the use of at least two different resistive materials or materials having a positive temperature coefficient (PTC) or thermistor effect, the first region comprising a mass of a first resistive material or material having a PTC or thermistor effect, defined within which are one or more areas or islands made of a second resistive material or material having a PTC or thermistor effect, the second material having a temperature or heat-emission capacity different from that of the first material, in such a way that the emission of heat by the heating layer in the at least one first region is different from the emission of heat by the heating layer in the at least one second region.

19. The device according to claim 18, wherein the first material forms a layer defined in which are holes or cavities, located in which is the second material.

* * * * *